US006456015B1

(12) United States Patent
Lovell et al.

(10) Patent No.: US 6,456,015 B1
(45) Date of Patent: Sep. 24, 2002

(54) INDUCTIVE-RESISTIVE FLUORESCENT APPARATUS AND METHOD

(75) Inventors: Walter C. Lovell, Wilbraham, MA (US); Edward Duhon, Setauket, NY (US); Sheldon B. Brooks, Kings Park, NY (US); Dana Geiger, Port Washington, NY (US)

(73) Assignee: Tapeswitch Corporation, Farmingdale, NY (US)

( * ) Notice: Subject to any disclaimer, the term of this patent is extended or adjusted under 35 U.S.C. 154(b) by 0 days.

(21) Appl. No.: 09/777,715

(22) Filed: Feb. 6, 2001

Related U.S. Application Data

(63) Continuation-in-part of application No. 09/566,595, filed on May 8, 2000, now Pat. No. 6,184,622, which is a continuation of application No. 09/218,473, filed on Dec. 22, 1998, now Pat. No. 6,100,653, which is a continuation-in-part of application No. PCT/US97/18650, filed on Oct. 16, 1997, which is a continuation-in-part of application No. 08/729,365, filed on Oct. 16, 1996, now Pat. No. 5,834,899.

(51) Int. Cl.[7] ..... H05B 37/02
(52) U.S. Cl. ..... 315/248; 315/246; 315/291
(58) Field of Search ..... 315/39–46, 246, 315/248, 291, 307, 219, 244

(56) References Cited

U.S. PATENT DOCUMENTS

| | | | |
|---|---|---|---|
| 4,005,330 A | 1/1977 | Glascock, Jr. et al. | 315/57 |
| 4,758,815 A | 7/1988 | Lovell | 338/212 |
| 4,823,106 A | 4/1989 | Lovell | 338/212 |

(List continued on next page.)

FOREIGN PATENT DOCUMENTS

| | | |
|---|---|---|
| EP | 0 358 502 A1 | 3/1990 |
| EP | 0 361 748 A1 | 4/1990 |
| EP | 0 560 255 A1 | 9/1993 |
| EP | 0 593 312 A2 | 4/1994 |
| EP | 0 647 086 A1 | 4/1995 |

OTHER PUBLICATIONS

10 *McGraw–Hill Encyclopedia of Science and Technology* 295, 299–300 (6th Ed. 1987).

Teccor Catalog Sales Sheets on Sidacs, pages not numbered, undated.

(List continued on next page.)

*Primary Examiner*—David Vu
*Assistant Examiner*—Wilson Lee
(74) *Attorney, Agent, or Firm*—Hoffmann & Baron, LLP

(57) ABSTRACT

A fluorescent illuminating apparatus includes an inductive-resistive structure that induces fluorescence in a fluorescent lamp when an electric current is passed through the inductive-resistive structure while an electric potential is applied across the fluorescent lamp A source of rippled/pulsed direct current is responsive to a control sub-circuit, which outputs a lamp voltage signal representative of the electric potential to be applied to the fluorescent lamp. A power supply sub-circuit is responsive to the control sub-circuit and imposes the electric potential at the value indicated by the lamp voltage signal. A method of inducing fluorescence includes passing a current through an inductive structure adjacent to a fluorescent lamp. An alternating current drive circuit for illuminating the fluorescent lamp includes a source of rippled/pulsed DC voltage, a polarity-reversing circuit and a controller connected to the polarity-reversing circuit, which periodically generates a signal to reverse the polarity of the voltage applied to the lamp. The electric potential applied to the fluorescent lamp is delayed for a first time period until the fluorescent lamp heats to a first temperature. The electric potential is then applied to the fluorescent lamp at a first level, and delays to allow the value of the rippled/pulsed direct current to stabilize. The direct current is then measured, and the electric potential is applied to the fluorescent lamp at a second level. The value of the dimming voltage is measured, and the electric potential applied to the lamp is adjusted accordingly by varying its duty cycle.

18 Claims, 50 Drawing Sheets

U.S. PATENT DOCUMENTS

| | | | | |
|---|---|---|---|---|
| 4,899,088 | A | 2/1990 | Black, Jr. et al. | 315/291 |
| 4,928,038 | A | 5/1990 | Nerone | 315/209 R |
| 4,945,278 | A | 7/1990 | Chern | 315/209 R |
| 4,972,126 | A | 11/1990 | Nilssen | 315/324 |
| 5,180,900 | A | 1/1993 | Lovell | 219/517 |
| 5,300,860 | A | 4/1994 | Godyak et al. | 315/39 |
| 5,381,073 | A | 1/1995 | Godyak et al. | 315/58 |
| 5,382,879 | A | 1/1995 | Council et al. | 315/248 |
| 5,385,785 | A | 1/1995 | Lovell | 428/408 |
| 5,412,286 | A | 5/1995 | Kazi et al. | 315/242 |
| 5,416,386 | A | 5/1995 | Nilssen | 315/307 |
| 5,434,476 | A | 7/1995 | Franke | 315/184 |
| 5,466,992 | A | 11/1995 | Nemirow et al. | 315/276 |
| 5,491,387 | A | 2/1996 | Saito | 315/DIG. 5 |
| 5,494,610 | A | 2/1996 | Lovell | 252/511 |
| 5,495,405 | A | 2/1996 | Fujimura et al. | 363/133 |
| 5,712,533 | A | 1/1998 | Corti | 315/307 |
| 5,834,899 | A | 11/1998 | Lovell et al. | 315/41 |
| 6,100,653 | A * | 8/2000 | Lovell et al. | 315/307 |
| 6,184,622 | B1 * | 2/2001 | Lovell et al. | 315/248 |

OTHER PUBLICATIONS

Theodore Baumeister et al., Editor, *Marks' Standard Handbook for Mechanical Engineers* 12–119 through 12–121 (8th Ed., 1978).

7 *McGraw–Hill Enecyclopedia of Science and Technology* 210–212 (6th Ed. 1987).

Alphonse J. Sistino, *Essentials of Electronic Circuitry* 42–47 (1996).

* cited by examiner

FIG. 39 TYPICAL CURRENT WAVEFORMS
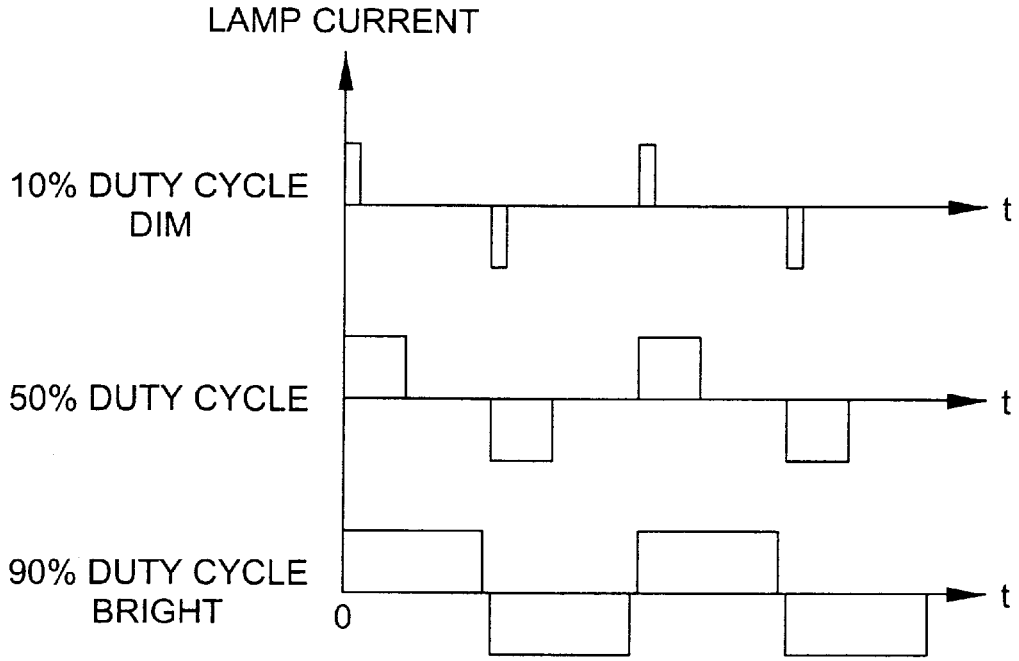

3900
+15
R24
2.2K
U10
3846
R38
1M
R13
3.3K
C8
0.1UF
V2+
U4
VDD
VSS
3848
R8
10K
3716'
R3
100
Q3
V2-
3738'
FLUOR. TUBE
LAMP
3726'
3714'
Q1
R1
100
V1-
R6
10K
650VDC
U2
V1+
C1
0.1UF
R10
3.3K
R35
1M
R25
2.2K
U6
FROM

U11
R37
1M
R21
3.3K
C22
0.1UF
V3-
U3B
R9
10K
R4
100
Q4
3720'
3924
3718'
Q2
R2
100
R7
10K
U3A
C2
0.1UF
R11
3.3K
R36
1M
U7
Q5
3852
TO FIG. 41D

FIG. 43 TIMER INTERRUPT SERVICE ROUTINE (DUTY CYCLE WAVEFORM GENERATOR)
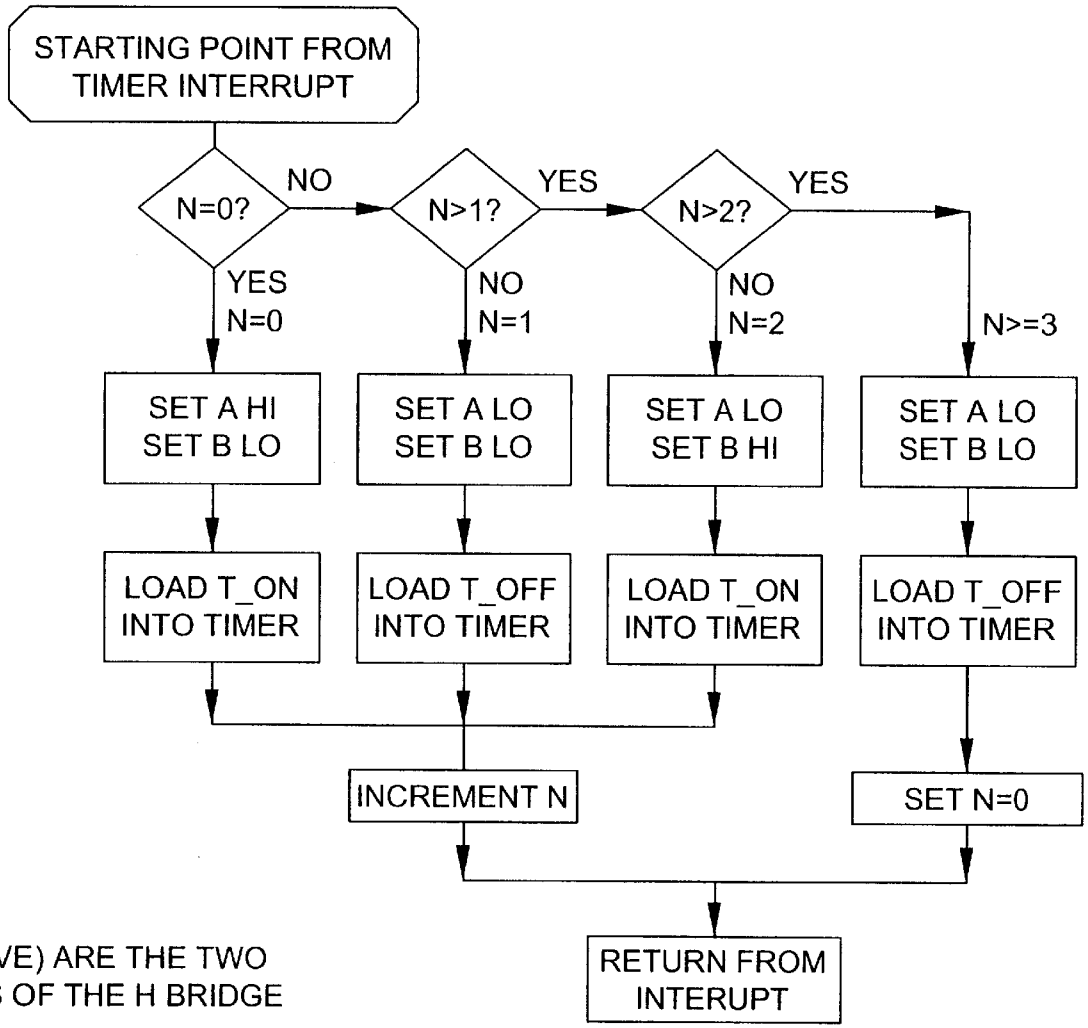
NOTE:
1. A AND B (ABOVE) ARE THE TWO DRIVING POINTS OF THE H BRIDGE

INDUCTIVE-RESISTIVE FLUORESCENT APPARATUS AND METHOD

This application is a continuation-in-part of U.S. patent application Ser. No. 09/566,595 filed May, 8, 2000 now U.S. Pat. No. 6,184,622, which is a continuation of U.S. patent application Ser. No. 09/218,473 filed Dec. 22, 1998, which issued as U.S. Pat. No. 6,100,653 on Aug. 8, 2000, which is a continuation-in-part of International Application No. PCT/US97/18650 filed Oct. 16, 1997 and which designated the United States, which is a continuation-in-part of U.S. patent application Ser. No. 08/729,365 filed Oct. 16, 1996 and which issued as U.S. Pat. No. 5,834,899 on Nov. 10, 1998.

BACKGROUND OF THE INVENTION

The present invention relates generally to fluorescent illuminating devices, and, more particularly, to an inductive-resistive fluorescent apparatus and method.

Fluorescent lamps are well known in the prior art. There are three basic types of such lamps. These are the preheat lamp, the instant-start lamp, and the rapid-start lamp. In each type of lamp, a glass tube is provided which has a coating of phosphor powder on the inside of the tube. Electrodes are disposed at opposite ends of the tube. The tube is filled with an inert gas, such as argon, and a small amount of mercury. Electrons emitted from the electrodes strike mercury atoms contained within the tube, causing the mercury atoms to emit ultraviolet radiation. The ultraviolet radiation is absorbed by the phosphor powder, which in turn emits visible light via a fluorescent process.

The differences between the three lamp types generally relate to the manner in which the lamp is initially started. Referring now to FIG. 1, in a preheat lamp circuit, designated generally as 10, a starter bulb 12 is included. Preheat lamp 14 includes first and second electrodes 16 and 18, each of which has two terminals 20. During initial start-up of the preheat lamp, starter bulb 12, which acts as a switch, is closed, thus shorting electrodes 16 and 18 together. Current therefore passes through electrode 16 and then through electrode 18. This current serves to preheat the electrodes, making them more susceptible to emission of electrons. After a suitable time period has elapsed, during which the electrodes 16 and 18 have warmed up, the starter bulb 12 opens, and thus, an electric potential is now applied between electrodes 16 and 18, resulting in electron emission between the two electrodes, with subsequent operation of the lamp.

A relatively high voltage is applied initially for starting purposes. A lower voltage is used during normal operation. A reactance is placed in series with the lamp to absorb any difference between the applied and operating voltages, in order to prevent damage to the lamp. The reactance, suitable transformers, capacitors, and other required starting and operating components are contained within a device known as a ballast (designated generally as 22). Ballasts are relatively large, heavy and expensive, with inherent efficiency limitations and difficulties in operating at low temperatures. The components within ballasts are typically potted with a thermally conductive, electrically insulating compound, in an effort to dissipate the heat generated by the components of the ballast. Difficulties in heat dissipation are yet another disadvantage of conventional ballasts.

Referring now to FIG. 2, an instant-start lamp circuit, designated generally as 24, is shown. Instant-start lamp 26 includes first and second electrodes 28 and 30.

Electrodes 28 and 30 each only have a single terminal designated as 32. In operation of the instant-start lamp, no preheating of the electrodes is required. Rather, an extremely high starting voltage is typically applied in order to induce current flow without preheating of the electrodes. The high starting voltage is supplied by a special instant-start ballast, designated generally as 34. Instant-start type ballasts suffer from similar disadvantages to those of the preheat type. Further, because of the danger of the high starting voltage from the instant-start ballast 34, a special disconnect lamp holder 36 must be employed in order to disconnect the ballast when the lamp 26 is not properly secured in position.

Referring now to FIG. 3, a rapid-start lamp circuit, designated generally as 38, is shown. Rapid start lamp 40 includes first and second electrodes 42 and 44, each of which has two terminals 46, similar to the preheat lamp 14, discussed above. The rapid-start ballast, designated generally as 48, contains transformer windings, which continuously provide the appropriate voltage and current for heating of the electrodes 42 and 44. Rapid heating of electrodes 42 and 44 permits relatively fast development of an arc from electrode 42 to electrode 44 using only the applied voltage from the secondary windings present in ballast 48. The rapid start ballast 48 permits relatively quick lamp starting, with smaller ballasts than those required for instant-start lamps, and without flicker which may be associated with preheat lamps. Further, no starter bulb is required. However, ballast 48 is still relatively large, heavy, inefficient, and unsuitable to low ambient-temperature operation. Dimming and flashing of rapid-start lamps are possible, albeit with the use of special ballasts and circuits.

It will be appreciated that operation of the prior art lamps described above is dependent on heating of the electrodes and/or application of a high voltage between the electrodes in order to start the operation of the lamp. This necessitates the use of ballasts and associated control circuitry, having the undesirable attributes discussed above. Recently, there has been interest in employing other physical phenomena to enable efficient starting and operation of fluorescent lamps. For example, EPO Publication Number 0 593 312 A2 discloses a fluorescent light source illuminated by means of an RF (radio frequency) electromagnetic field. However, the device of the '312 publication still suffers from numerous disadvantages, including the complex circuitry required to generate the RF field and the potential for RF interference.

In the parent international Application No. PCT/US97/18650, a ballast-free drive circuit is disclosed which, in one embodiment, employs a direct current (DC) or pulsed DC source (see FIG. 25). It has been found, however, that operating a fluorescent lamp with a DC or pulsed DC source can lead to mercury migration in the lamp and an associated reduction of light output over time. This mercury migration problem may, therefore, substantially shorten the usable life of the fluorescent lamp.

Through experimentation, it was additionally observed that the fluorescent lamp drive circuit disclosed in the parent International Application exhibited unreliable starting of the fluorescent lamp, particularly when used with certain types of fluorescent lamps (e.g., T8 lamps). This starting problem was found to be related, at least in part, to an insufficient voltage being generated across the output capacitors in the drive circuit. In such instances, the capacitors were not always fully charged to an appropriate voltage level necessary to form the arc in the fluorescent medium.

There is, therefore, a need in the prior art for an inductive-resistive fluorescent apparatus which permits simple, economical and reliable starting and operation of fluorescent lamps with low-cost, light weight, low-volume components which are capable of efficiently operating the lamp, even at relatively low ambient temperatures, which afford efficient heat dissipation and which are capable of operating at ordinary household AC frequencies. It is desirable to adapt such an inductive-resistive fluorescent apparatus to substantially eliminate mercury migration in the fluorescent lamp. It is additionally desirable to provide a fluorescent apparatus having the flexibility for enhanced features, including the ability to remotely control the fluorescent apparatus via a proportional industrial controller (PIC) or similar building controller. Furthermore, it is desirable to adapt such an inductive-resistive apparatus to direct "plug-in" replacement of incandescent bulbs.

SUMMARY OF THE INVENTION

The present invention, which addresses the needs of the prior art, provides an inductive-resistive fluorescent apparatus and method. The apparatus includes a translucent housing having a chamber for supporting a fluorescent medium, and having electrical connections configured to provide an electrical potential across the chamber. A fluorescent medium is supported within the chamber. An inductive-resistive structure is fixed sufficiently proximate to the housing in order to induce fluorescence in the fluorescent medium when an electric current is passed through the inductive-resistive structure, while an electric potential is applied across the housing. In a preferred embodiment, the translucent housing and fluorescent medium are contained as part of a conventional fluorescent lightbulb.

In one aspect, the present invention includes a fluorescent illuminating apparatus comprising a fluorescent lightbulb; an inductive-resistive structure; and a source of rippled/pulsed direct current. The fluorescent lightbulb includes a translucent housing with a chamber for supporting a fluorescent medium; electrical connections on the housing to provide an electrical potential across the chamber; a fluorescent medium supported in the chamber; and first and second electrodes at first and second ends of the translucent housing, which are electrically interconnected with the first and second electrical terminals. The inductive-resistive structure is fixed sufficiently proximate to the housing of the lightbulb to induce fluorescence in the fluorescent medium when an electric current is passed through the inductive-resistive structure while an electric potential is applied across the housing. The inductive-resistive structure has third and fourth electrical terminals. The second and third electrical terminals are electrically interconnected.

The source of rippled/pulsed direct current has first and second output terminals interconnected with the first and fourth electrical terminals and has first and second alternating current input terminals. The source includes a first diode having its anode electrically interconnected with the second output terminal and its cathode electrically interconnected with the first AC input terminal; a second diode with its anode electrically interconnected with the first AC input terminal and its cathode electrically interconnected with the first output terminal; a third diode having its anode electrically interconnected with the second AC input terminal and having its cathode electrically interconnected with the first output terminal; a fourth diode having its anode electrically interconnected with the second output terminal and its cathode electrically interconnected with the second AC input terminal; a first capacitor electrically interconnected between the first output terminal and the second AC input terminal; and a second capacitor electrically interconnected between the second output terminal and the second AC input terminal.

In another aspect a fluorescent illuminating apparatus includes a fluorescent lightbulb as in the first aspect. The apparatus further includes an inductive-resistive structure fixed sufficiently proximate to the housing of the lightbulb to induce fluorescence in the fluorescent medium when an electric current is passed through the inductive-resistive structure while an electric potential is applied across the housing. The inductive-resistive structure has third and fourth electrical terminals. In the second aspect, the apparatus further includes a source of rippled/pulsed direct current including a first transistor; a first capacitor; and a step-up transformer. The step-up transformer has a primary and a secondary winding with the secondary winding electrically interconnected to the first and second electrical terminals of the fluorescent lightbulb and the primary winding electrically interconnected with the first transistor, the first capacitor and the inductive-resistive structure to form an oscillator, such that when a source of substantially steady direct current is electrically interconnected with the oscillator, the first capacitor charges during a first repeating time period when the first transistor is off and the first capacitor discharges during a second repeating time period when the first transistor is active. The oscillator produces a time-varying voltage waveform across the primary winding of the transformer in accordance with the charging and discharging of the first capacitor during the first and second repeating time periods, such that a stepped-up rippled/pulsed direct current is produced in the secondary winding. A source of substantially steady direct current (DC voltage), such as a storage battery, can be electrically interconnected with the oscillator.

In yet another aspect of the present invention, a fluorescent illuminating apparatus includes a translucent housing having a chamber for supporting a fluorescent medium and having electrical connections thereon to provide an electrical potential across the chamber. The housing generally has the size and shape of an ordinary incandescent lightbulb, and the electrical connections are in the form of first and second electrical terminals adapted to mount into an ordinary light socket. The apparatus further includes a fluorescent medium supported in the chamber and first and second spaced electrodes located within the chamber. Yet further, a first inductive-resistive structure is included, preferably located within the chamber, and a source of rippled/pulsed direct current (DC voltage) is included which has first and second alternating current input terminals electrically interconnected with the first and second electrical terminals. The source also has first and second output terminals. The first electrode is electrically interconnected with the first output terminal and the second electrode is electrically interconnected with the second output terminal through the first inductive-resistive structure.

In still another aspect of the present invention, the source of rippled/pulsed direct current is converted to a low-frequency alternating current (AC) drive source. The AC drive source preferably includes an H-bridge circuit and an associated controller. The H-bridge circuit in combination with the controller performs a polarity reversing function, thereby substantially eliminating the mercury migration problem of the prior art. In addition to periodically reversing the polarity of the fluorescent lamp current, the controller preferably controls and maintains a lamp current having a predefined duty cycle, thereby providing enhanced dimming capabilities for the fluorescent lamp in accordance with the apparatus and method of the present invention.

A preferred method of the present invention includes delaying the presentation of the drive source voltage to the fluorescent lamp for a predetermined amount of time so as to enable the output capacitors in the voltage multiplier circuit to fully charge, thereby substantially eliminating the starting problems which exist in prior art fluorescent apparatus. The method further preferably includes measuring the current passing through the fluorescent lamp and providing a control circuit, whereby the duty cycle of the lamp current, and therefore the lamp brightness, can be variably adjusted by the user in predetermined increments.

Any of the apparatuses of the present invention can be configured with a spike delay trigger or voltage sensing trigger to enhance starting at low voltage, and can include a fluorescent bulb having an inductive-resistive strip mounted therein. The inductive-resistive structures can include first and second spaced (preferably elongate) conductors, with a conductive-resistive medium electrically interconnected between the conductors. The conductive-resistive medium may be, for example, a solid emulsion consisting of an electrically conductive discrete phase dispersed within a non-conductive continuous phase. A preferred emulsion includes powdered graphite and an alkali silicate (such as china clay) dispersed in a polymeric binder. The medium may also be a coating portion of a magnetic recording tape. One or more discrete resistors can also be employed.

The conductive-resistive medium may be located on a separate substrate, or a may be applied to the surface of the fluorescent lightbulb itself. Further, the inductive-resistive structure may be positioned in thermal communication with the translucent housing in order to aid in low-temperature operation of the inductive-resistive fluorescent apparatus, by means of transferring ohmic heat from the inductive-resistive structure to the translucent housing. (Even when there is no such heat transfer, the present invention provides better low-temperature operation than a conventional ballast.) It is believed that the inductive-resistive structure of the invention assists in starting and operation of the fluorescent lightbulb by means of an electromagnetic (e.g., magnetic and/or electrostatic) field interaction.

Another method of the present invention includes passing a current through an inductive-resistive structure, which is adjacent, a fluorescing medium, in an amount sufficient to induce fluorescence in the presence of an electric potential imposed on the fluorescing medium. Preferably, the inductive-resistive structure comprises a conductive-resistive medium electrically interconnected between first and second spaced (most preferably elongate) conductors. The conductive-resistive medium is preferably maintained within about one inch (2.5 cm) or less of the fluorescing medium, at least for starting purposes, in order to maximize the electromagnetic field interaction between the inductive-resistive structure and the fluorescing medium. In alternative embodiments discussed herein, the inductive-resistive structure may be maintained at a greater distance from the fluorescing medium.

Various types of conductive-resistive media are described in detail in Applicants' U.S. Pat. Nos. 4,758,815; 4,823,106; 5,180,900; 5,385,785; and 5,494,610. The disclosures of all of the foregoing patents are incorporated herein by reference. Specific details regarding preferred media for use with the present invention are given herein.

As a result of the foregoing, the present invention provides an inductive-resistive fluorescent apparatus offering relatively low Weight, low volume, simplicity and low cost compared to prior ballast-operated systems. The apparatus is capable of low-ambient-temperature operation, which may be enhanced by configuring the inductive apparatus to generate ohmic heat and transfer at least a portion of the heat into the fluorescent lamp. Inductive structures which are relatively thin and which have a relatively large surface area can be fabricated according to the invention, resulting in efficient heat dissipation. The present invention also provides an inductive-resistive fluorescent apparatus which can be operated from DC battery power and which can be utilized for direct "plug-in" replacement of incandescent bulbs.

The invention further provides a method of inducing fluorescence via electromagnetic field interaction between an inductive-resistive structure and a fluorescent lamp. The method can be carried out using reliable, compact, lightweight and inexpensive hardware according to the present invention.

Still another method of the present invention includes delaying the application of the electrical potential to the fluorescent lamp for a first time period until the electrical potential imposed on the fluorescent lamp causes the fluorescent lamp to heat to a first temperature. The electric potential is then imposed on the fluorescent lamp at a first level, and there is a delay for a second time period to allow the value of the rippled/pulsed direct current to stabilize. The value of the rippled/pulsed direct current is measured, and the electric potential is imposed on the fluorescent lamp at a second level. The value of the rippled/pulsed direct current is then measured again. The value of a dimming voltage is measured and the electric potential imposed on the fluorescent lamp is adjusted in response to the measured dimming voltage.

In still another aspect of the present invention, a fluorescent illuminating apparatus includes a source of rippled/pulsed direct current responsive to a control sub-circuit. The control sub-circuit outputs a lamp voltage signal representative of a value of the electric potential to be imposed on the fluorescent lamp. A power supply sub-circuit, is responsive to the control sub-circuit, and the power supply sub-circuit imposes the electric potential on the fluorescent lamp at the value represented by the lamp voltage signal.

For a better understanding of the present invention, together with other and further objects and advantages, reference is made to the following description, taken in conjunction with the accompanying drawings, and its scope will be pointed out in the appended claims.

BRIEF DESCRIPTION OF THE DRAWINGS

FIG. 33(*a*2) depicts a second form of spike delay trigger suitable for use with the present invention;

FIG. 33(*b*) depicts the spike delay trigger of FIGS. 33(*a*1) and 33(*a*2) interconnected with an inductive-resistive fluorescent apparatus of the present invention;

FIG. 34(*a*2) depicts a front elevation view of the clip of FIG. 34(*a*1);

FIG. 34(*b*) depicts a pictorial view of a second type of clip similar to the clip shown in FIGS. 34(*a*1) and 34(*a*2);

FIG. 34(*c*) depicts an installation of the clips of FIGS. 34(*a*1)–34(*b*) on a typical illuminating apparatus structure;

FIG. 39 depicts an output current waveform of the fluorescent lamp drive circuit shown in FIG. 38.

FIG. 43 depicts a flowchart of an exemplary timer interrupt service routine for the microcontroller shown in FIGS. 38, 40 and 41.

DETAILED DESCRIPTION OF THE INVENTION

Figure 4:
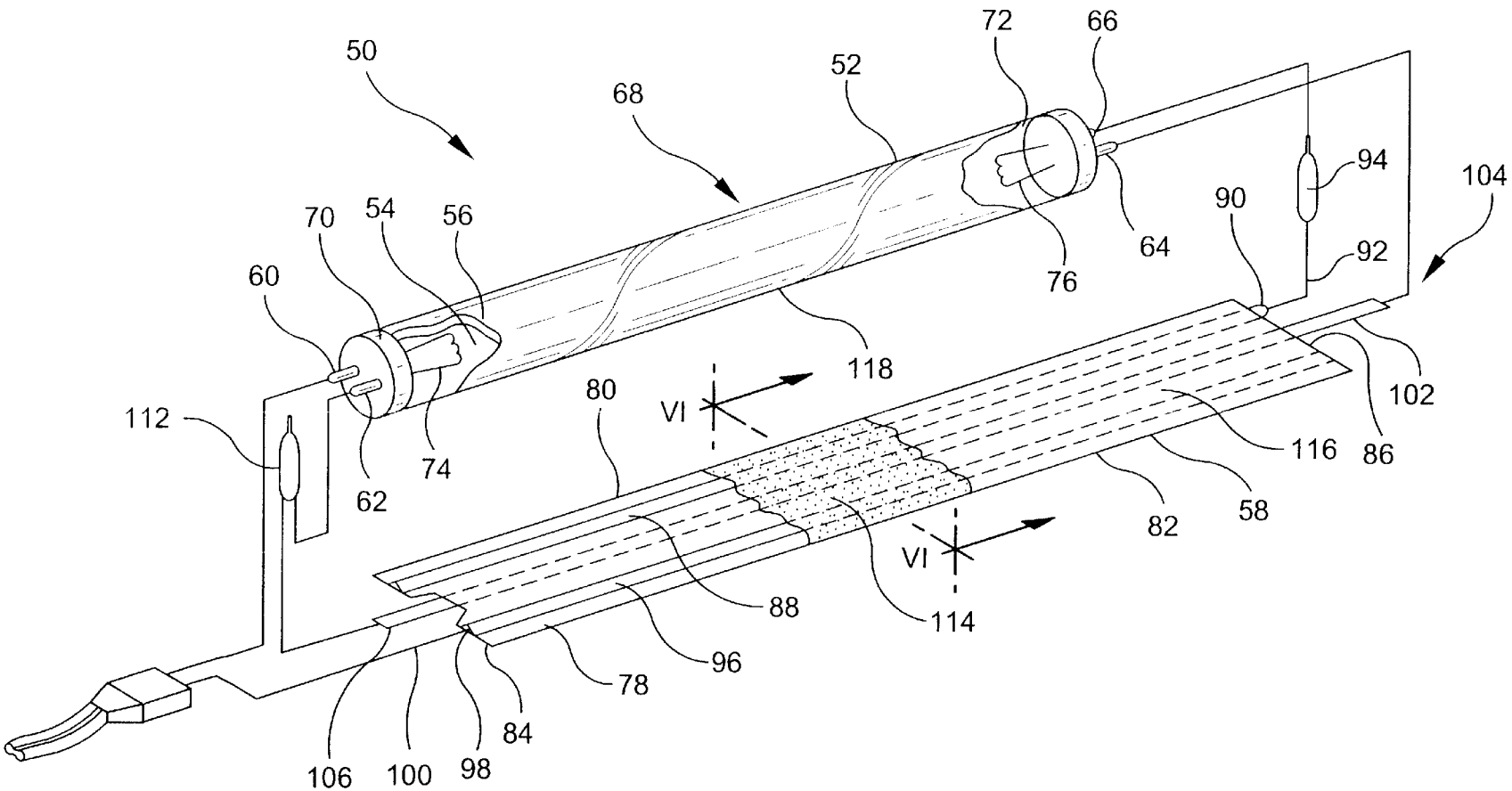
FIG. 4 is a perspective view of a first embodiment of the present invention employing a preheat type bulb along with an inductive-resistive structure made from conductive-resistive material.

Referring to the drawings, FIG. 4 shows a first embodiment of an inductive-resistive fluorescent apparatus 50. The apparatus includes a translucent housing 52 having a chamber 54. A fluorescent medium 56 is supported within chamber 54. An inductive-resistive structure such as conductive-resistive medium and substrate assembly 58 is fixed sufficiently proximate to housing 52 so as to induce fluorescence in fluorescent medium 56 when an electric current is passed through assembly 58 while an electric potential is applied across housing 52. Appropriate electrical connections such as first, second, third and fourth electrical terminals 60, 62, 64 and 66 are present on housing 52 for providing the electric potential across chamber 54.

As used herein, the term "inductive-resistive structure" is intended to refer to an electrical structure which is capable of inducing fluorescence in a fluorescent medium when an electric current is passed through the structure, while the structure is in proximity to the fluorescent medium, and while an electric potential is applied across the fluorescent medium. As noted below, it is believed that the inductive-resistive structures disclosed herein work by means of an electromagnetic (e.g., magnetic and/or electrostatic) field interaction with the contents of the fluorescent bulb per se. The term "inductive-resistive structure" is not intended to refer to inductive reactances, transformer coils, etc., which may be found in a conventional ballast, and which do not exhibit the properties of the present invention, i.e., the apparent electromagnetic field interaction with the contents of the fluorescent bulb.

Most preferably, housing 52 and fluorescent medium 56 form part of a preheat-type fluorescent lightbulb 68. Housing 52 preferably has first and second ends 70 and 72. As discussed above, in bulb 68, translucent housing 52 would be in the form of a hollow tube (preferably glass) having inside and outside surfaces with fluorescent medium 56 (typically, a fluorescent powder such as a phosphor powder) being coated onto the inside surface.

Bulb 68 preferably includes first and second electrodes 74, 76 disposed in spaced-apart relationship in housing 52, and most preferably located at first and second ends 70, 72 of housing 52 respectively. First electrode 74 is preferably connected across first and second terminals 60, 62, while second electrode 76 is preferably connected across third and fourth terminals 64, 66. Bulb 68 typically includes a quantity of gaseous material within housing 52, with the gaseous material (preferably mercury) being capable of emitting ultraviolet radiation when struck by electrons emanating from one of the electrodes 74,76. Fluorescent medium 56 fluoresces in response to the ultraviolet radiation.

Conductive-resistive medium and substrate assembly 58 (shown it its preferred form as an elongate tape structure) preferably includes substrate 78, which is preferably an electrically insulating material such as 0.002 inch polyester film. Substrate 78 preferably has top edge 80, bottom edge 82, left edge 84 and right edge 86. An elongate top conductor strip 88 is preferably secured to substrate 78 adjacent top edge 80, and preferably has a first exposed end 90 forming a fifth electrical terminal 92 adjacent right edge 86 of substrate 78. Fifth terminal 92 is preferably electrically interconnected with fourth terminal 66, preferably through fusible link 94 (for safety reasons).

Assembly 58 preferably also includes an elongate bottom conductor strip 96 which is secured to substrate 78 adjacent bottom edge 82, and which has a first exposed end 98 forming a sixth electrical terminal 100 adjacent left edge 84 of substrate 78. Second and third electrical terminals 62,64 are electrically interconnected through a starter switch such as starter bulb 112. In lieu of a starter bulb, a semiconductor power switch such as a thyristor device (e.g., a "SIDAC") may be employed for any of the applications herein where a starter bulb is employed. Any type of appropriate wiring may be used to connect starter bulb 112 between terminals 62,64. However, it has been found to be convenient to provide a connection in the form of intermediate conductor strip 102 having first exposed end 104 and second exposed end 106. Intermediate conductor strip 102 can be fastened to substrate 78 intermediate top and bottom conductor strips 88 and 96 and on an opposite side therefrom, and intermediate strip 102 can be electrically insulated from the remainder of conductive-resistive medium and substrate assembly 58 and can be covered by bottom cover film 117 (see FIG. 6). First and second exposed ends 104,106 of intermediate conductor strip 102 may be electrically interconnected with third electrical terminal 64 and second electrical terminal 62 respectively.

Figure 6A:
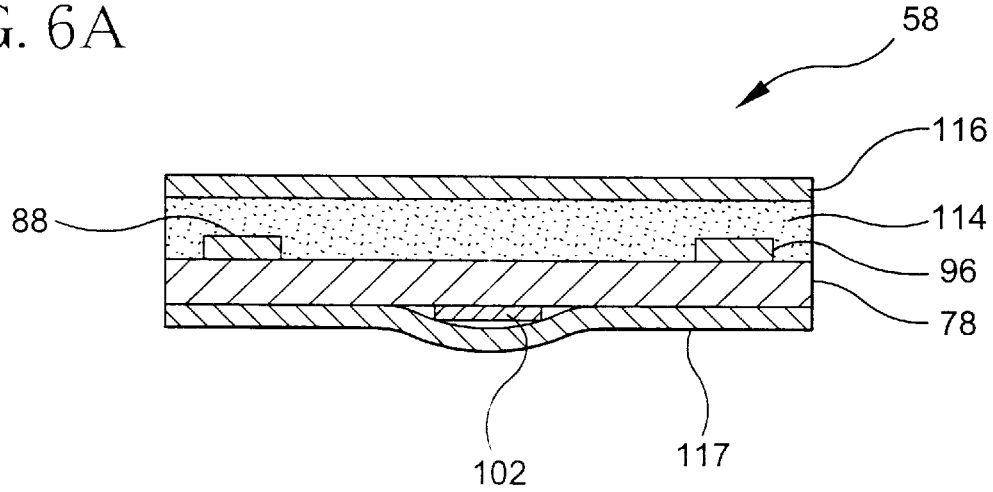
FIG. 6A is a cross-sectional view through the inductive-resistive structure of FIG. 4 taken along line VI—VI of FIG. 4.

Conductive-resistive coating 114 is located on substrate 78, and is electrically interconnected with top and bottom conductor strips 88,96. FIG. 6A shows a cross section through conductive-resistive medium and substrate assembly 58. Assembly 58 may be covered with a suitable cover film 116, preferably of an electrically insulating material such as polyester.

A number of materials are suitable for forming conductive-resistive coating 114. In general, suitable materials will include a non-continuous electrically conductive component suspended in a substantially non-conductive binder. Typically, the material constitutes a solid emulsion comprising an electrically conductive discrete phase dispersed within a non-conductive continuous phase. U.S. Pat. No. 5,494,610 to Walter C. Lovell, a named inventor herein, sets forth a variety of medium-temperature conductive-resistant (MTCR) coating compositions suitable for use as coating 114. The disclosure of this patent has been previously incorporated herein by reference.

Typically, the MTCR materials are prepared by suspending a conductive powder in a polymer based activator and water; the material is applied to a substrate and allowed to dry. A preferred conductive powder is graphite powder with a mesh size of 150–325 mesh. The activator can be a water-based resin dispersion such as a latex paint; for example, polyvinyl acetate latex. A graphite slurry can be formed of about 10–30 weight percent graphite (preferably about 15–25 weight %), about 22–32 weight percent water, and about 48–58 weight percent of a high-temperature polymer-based activator. Alternatively, the graphite slurry can be formed of about 10 to about 30 weight percent graphite (preferably about 15–25 weight %), about 6 to about 60 weight percent water (preferably about 20–40 weight %), and about 20 to about 65 weight percent polymer latex (preferably about 25–50 weight %).

U.S. Pat. No. 5,385,785 to Walter C. Lovell, a named inventor herein, previously incorporated by reference, discloses a high-temperature conductive-resistant coating composition suitable for use as coating 114. The coating includes a substantially non-continuous electrically conductive component suspended in a substantially non-conductive binder such as an alkali-silicate compound. The electrically conductive component can be included in an amount of about 4–15 weight percent and the binder can be included in an amount of about 50–68 weight percent. These components can be combined with about 2–46 weight percent water. Following deposition of the material, it is dried to provide the desired coating. The electrically conductive component is preferably graphite or tungsten carbide. The preferred binder includes an alkali-silicate compound containing sodium silicate, china clay, in silica, carbon and/or iron oxide and water. It is to be understood that when weight percentages include water, the dried composition will have a different weight composition due to substantial evaporation of the water.

A graphite composite which has been found to be especially preferred for use as coating 114 of the present invention includes powdered graphite and an alkali silicate dispersed in a polymeric binder. Most preferably, the composite is a solid emulsion of graphite and china clay dispersed in polyvinyl acetate polymer. The composite can be deposited as a liquid coating composition, comprising from about 1 to about 30 weight percent graphite (preferably about 10 to about 30 weight percent for desirable resistivity values), about 20 to about 55 weight percent of an alcoholic carrier fluid, about 9 to about 48 weight percent of polyvinyl acetate emulsion, and about 4 to about 32 weight percent of china clay. The alcoholic carrier fluid comprises from about 0 to about 100 weight percent ethyl alcohol; with the remainder of the carrier fluid comprising water. A higher proportion of alcohol is selected for faster drying. Excessive graphite (beyond about 30 weight %) can cause undesirable coagulation, while excessive alcoholic carrier fluid (beyond about 55 weight % of the coating composition) can cause the mixture to separate.

One highly preferred exemplary composite is formed by preparing a mixture of 97.95 parts by weight water (33.42 weight %), 58.84 parts by weight ethyl alcohol (20.08 weight %), 48.30 parts by weight graphite (16.65 weight %), 52.38 parts by weight polyvinyl acetate emulsion (17.87 weight %), and 35.09 parts by weight china clay (11.97 weight %). This mixture is applied to a substrate and allowed to dry. Additional details regarding preferred components are discussed below in Example 1. It has been found that increasing the weight percentages of water and graphite decreases the resistivity, while decreasing the weight percentages of water and graphite increases the resistivity.

As discussed below in Example 1, the preferred polyvinyl acetate emulsion is known as a heater emulsion, and is available from Camger Chemical Company. This product includes polyvinyl acetate, silica, water, ethyl alcohol and toluene in an emulsion state. In forming the above-described slurry, suitable solvents other than ethyl alcohol can be employed. However, it has been found that isopropyl alcohol is relatively undesirable for use with the Camger heater emulsion, as it can cause the heater emulsion to separate. It is to be appreciated that upon drying, volatiles such as water, alcohol and toluene will substantially evaporate, thus resulting in different weight percentages of components in the dried coating.

Alternatively, substrate 78 and coating 114 may be part of a magnetic recording tape. U.S. Pat. Nos. 4,758,815; 4,823,106; and 5,180,900, all to Walter C. Lovell, a named inventor herein, the disclosures of which have been previously incorporated herein by reference, disclose techniques for constructing electrically resistive structures from magnetic recording tape. Such tapes are well known in the art, and are also discussed in 10 McGraw-Hill Encyclopedia of Science and Technology 295, 299–300 (6th Ed. 1987); basically, they consist of magnetic particles (such as gamma ferric oxide or chromium dioxide) dispersed in a binder and coated onto a base substrate such as a polyester film. Preferred tapes for use with the present invention include 3M #806/807 1" wide recording tape with carbon coating or 3M "Scotch Brand" (0227–003) 2" wide studio recording tape with carbon coating, both as provided by the Minnesota Mining and Manufacturing Company.

Figure 6B:
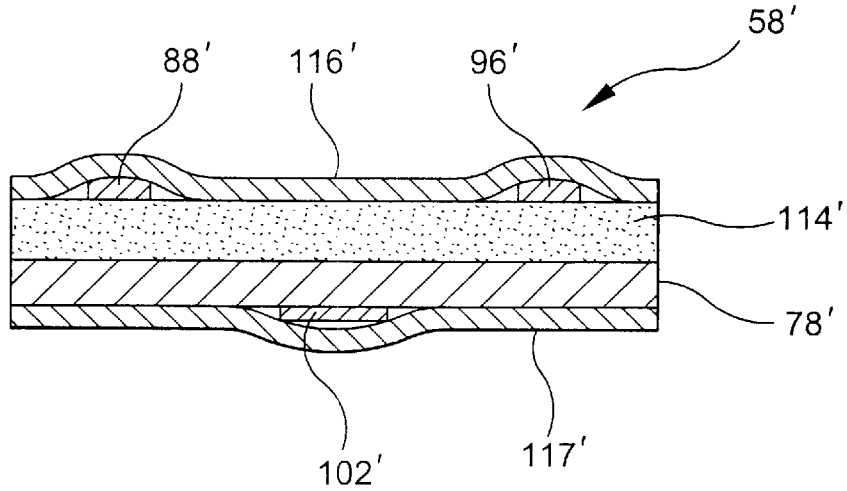
FIG. 6B is a view similar to FIG. 6A for an inductive-resistive structure employing a magnetic recording tape.

FIG. 6B shows a cross-section through a conductive-resistive medium and substrate assembly 58' formed with magnetic recording tape. Items similar to those in FIG. 6A have received a "prime." It will be seen that construction is similar to FIG. 6A, except that strips 88', 96' are located on top of coating 114', since coating 114' and substrate 78' are preformed as the magnetic recording tape. Strips 88', 96' may be copper strips having an electrically conductive adhesive on one side thereof, to ensure electrical contact with coating 114'. Suitable strips are available from McMaster-Carr Supply Co. of New Brunswick, N.J.

Figure 7:
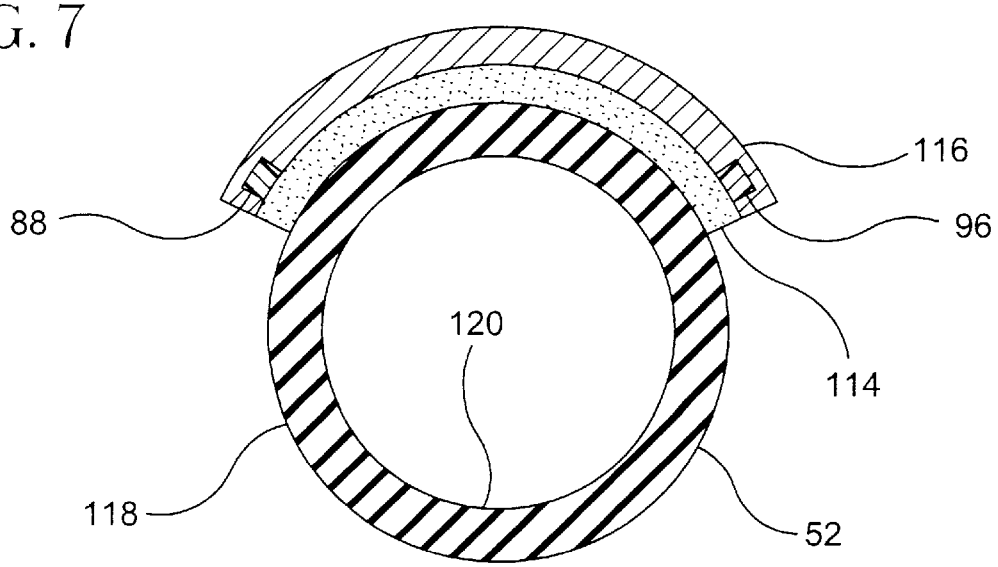
FIG. 7 shows a cross-section through a fluorescent bulb having an inductive-resistive structure mounted directly thereon.

It will be appreciated that conductive-resistive medium and substrate assembly 58 may take many forms. For example, in lieu of substrate 78, a surface of translucent housing 52 may be used as a substrate and conductive-resistive medium may be applied to at least a portion of the surface to form the conductive-resistive medium and substrate assembly, as shown in FIG. 7. It is envisioned that outside surface 118 of housing 52 would normally be the most convenient to which to apply the conductive-resistive material. However, it is to be appreciated that it would also be possible to apply the material to inside surface 120. Furthermore, it is to be appreciated that magnetic recording tape, when used in the inductive structure, could also be applied directly to either outside surface 118 or inside surface 120. Of course, application of materials to inside surface 120 of housing 52 would potentially complicate fabrication of lightbulb 68 and therefore, as noted, outside surface 118 would normally be preferred. However, embodiments with inside coating are set forth herein.

It will be appreciated that inductive-resistive structures according to the invention, such as assembly 58, may be formed relatively thin and with relatively high surface area to achieve efficient heat dissipation.

Referring again to FIG. 4, conductive-resistive medium and substrate assembly 58 is preferably positioned within about 1 inch (2.5 mm) or less of outside (exterior) surface 118 of translucent housing 52. The significance of this spacing will be discussed further hereinbelow, as will an embodiment of the invention where the spacing can be increased to, e.g., 12 inches (30 cm). Still referring to FIG. 4, it will be noted that housing 52 is preferably elongate, and conductive-resistive medium and substrate assembly 58 is preferably substantially coextensive with translucent housing 52. However, as discussed below, in other embodiments of the invention it is not necessary for the housing 52 and conductive-resistive medium and substrate assembly 58 to be coextensive.

Figure 1:
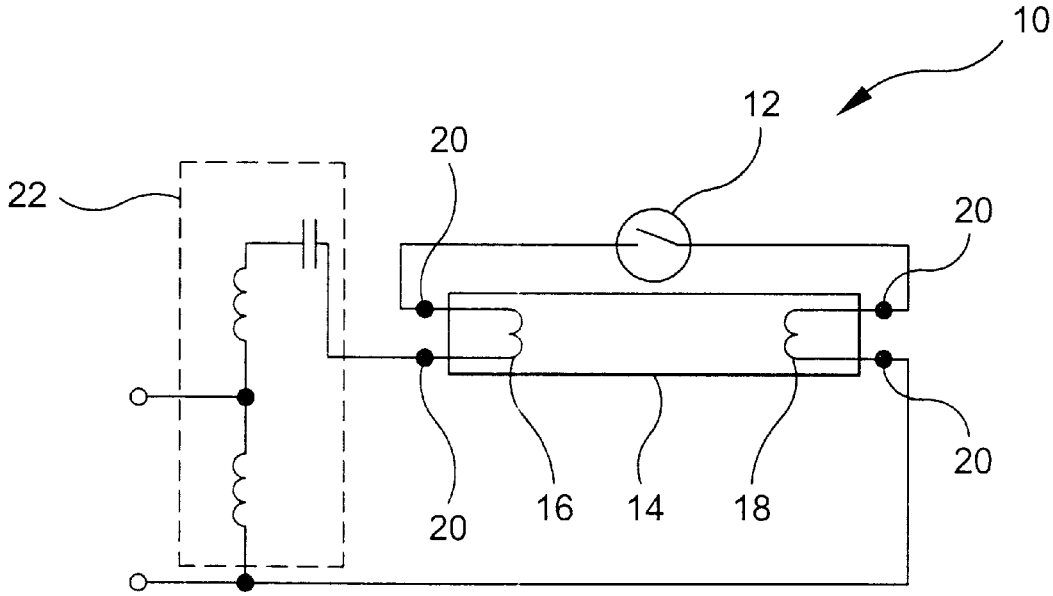
FIG. 1 PRIOR ART
FIG. 1 is a schematic diagram of a preheat lamp circuit according to the prior art.
Figure 2:
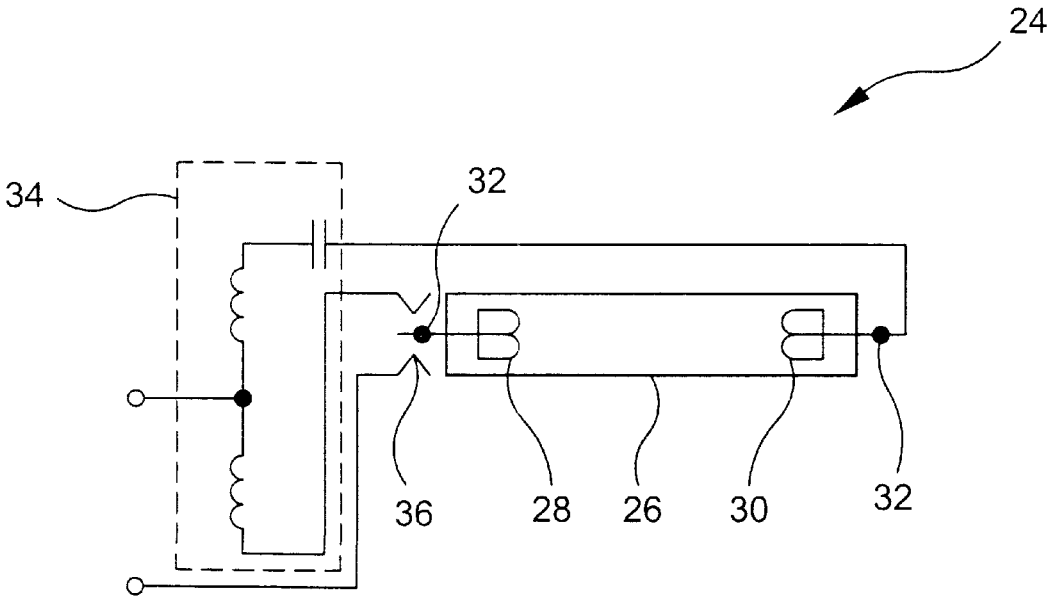
FIG. 2 PRIOR ART
FIG. 2 is a schematic diagram of an instant-start lamp circuit according to the prior art.
Figure 3:
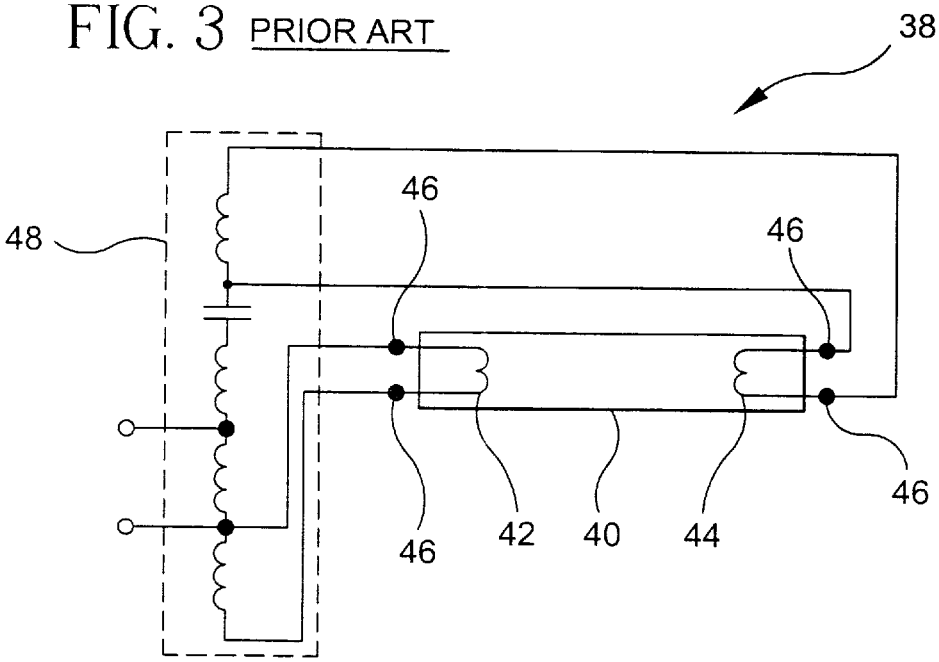
FIG. 3 PRIOR ART
FIG. 3 is a schematic diagram of a rapid-start lamp circuit according to the prior art.
Figure 5:
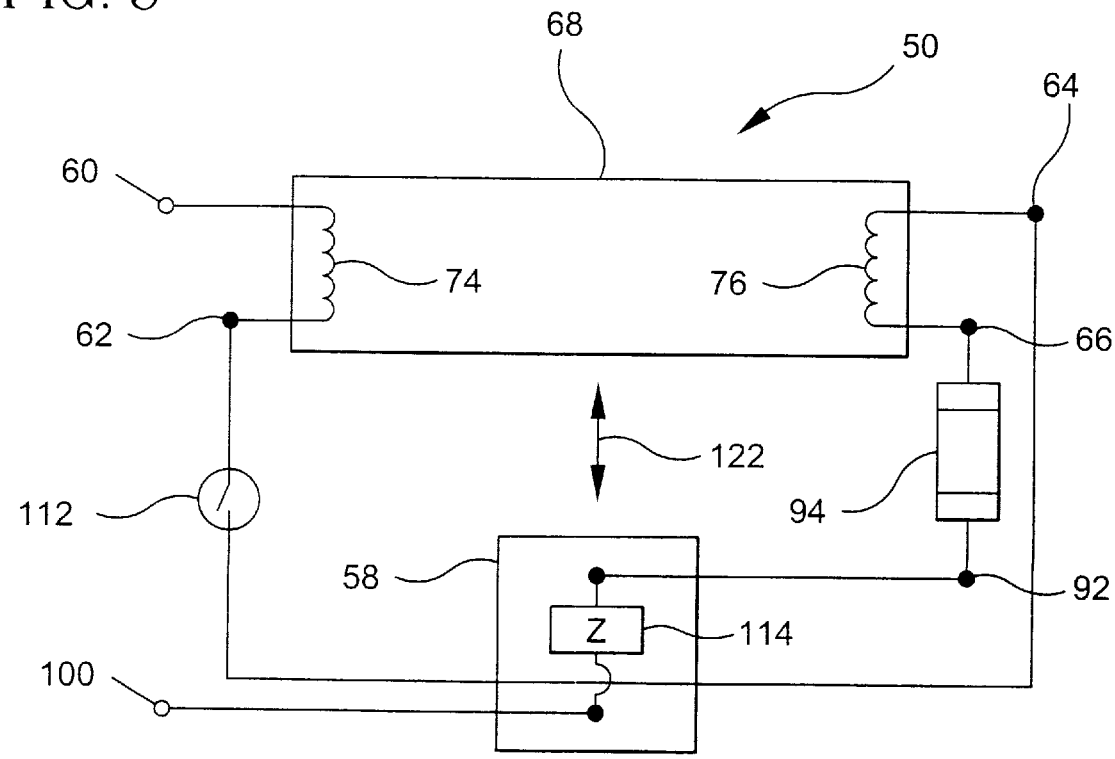
FIG. 5 is a circuit diagram of the apparatus of FIG. 4.

Referring now to FIG. 5, which is a circuit diagram of the embodiment shown in FIG. 4, operation of the first embodiment of the invention will now be described. An AC voltage, such as ordinary household voltage (i.e., 120 VAC, 60 Hz), is applied between first terminal 60 and sixth terminal 100. Upon initial application of the voltage, a starter switch such as starter bulb 112 closes, allowing electrical current to pass through electrodes 74,76, causing them to heat and become susceptible to emission of electrons. At the same time, the electrical current passes through conductive-resistive coating 114 of conductive-resistive medium and substrate assembly 58. The coating 114 is shown in the circuit diagram of FIG. 5 as a generalized impedance Z.

It is believed that the passage of ordinary alternating current (such as 60 Hz household current) through the coating 114 results in an electromagnetic field interaction (symbolized by double headed arrow 122) between conductive-resistive medium and substrate assembly 58 and fluorescent lightbulb 68. In particular, it is believed that the electromagnetic field interaction influences at least one of the fluorescent medium 56 and the gaseous material (such as mercury) contained within housing 52. In other embodiments of the invention, discussed below, a direct current having a "pulsed" or "rippled" component, or similarly an alternating current, is passed through a coating similar to coating 114. Such alternating current or "pulsed" or "rippled" components have been found to yield a measured "frequency," with a frequency meter, on the order of 60–1000 Hz. Thus, it is believed that the electromagnetic field interaction is also a low-frequency phenomena, on the order of 0–1000 Hz, depending on the frequency input to the inductive-resistive structure.

As discussed further below in the examples section, bulb 68 will normally only start if conductive-resistive medium and substrate assembly 58 is maintained sufficiently proximate to housing 52, preferably within about 1 inch (2.5 cm). (An alternative embodiment which permits increasing the distance to about 12 inches (30.5 cm) is discussed below). Thus, the present invention permits the starting of a fluorescent bulb without the use of a ballast. Once the electrodes 74,76 have become sufficiently hot, bulb 112 opens resulting in current flow between electrodes 74,76 and full illumination of lightbulb 68. Once lightbulb 68 is fully illuminated, conductive-resistive medium and substrate assembly 58 may be removed from the proximity of housing 52, and lightbulb 68 will remain illuminated.

In view of the foregoing description of the operation of the first embodiment of the invention, it will be appreciated that in a method according to the invention, electric current is passed through an inductive-resistive structure such as conductive-resistive medium and substrate assembly 58 adjacent a fluorescing medium, such as the fluorescent medium contained within lightbulb 68. Current is passed through assembly 58 in an amount sufficient to induce fluorescence in the presence of an electrical potential imposed on the fluorescing medium, in particular, between electrodes 74, 76. As discussed above, it will be appreciated that the method may also include the step of maintaining the conductive-resistive medium of assembly 58 within about one inch (2.5 cm)or less of the fluorescing medium contained within lightbulb 68. The inductive-resistive structure used in the method can be any of the structures discussed herein, including the solid emulsion materials (such as the graphite composite) and the magnetic recording tape materials.

It has been found that conductive-resistive medium and substrate assemblies 58 for use with the present invention are best specified by their resistance, in ohms, at DC. For a given composition of conductive-resistive coating 114, a given length of opposed conductor strips 88,96, and a given distance between the conductor strips, the DC resistance will be set by the thickness of conductive-resistive coating 114. The required thickness of coating can be determined by solving the following equation:

$$R=\rho d_s/(L_s t)$$

where:

R=desired DC resistance, Ω

ρ=resistivity of coating material being used, Ω-inches (Ω-m)

$d_S$=distance between conductor strips, inches (m)

$L_S$=length of conductor strips, inches (m)

t=required thickness of coating, inches (m).

The resistivity value p should be determined for each batch of coating 114 by measuring R for a coating of known dimensions; for the preferred composition used in Example 2, the value of ρ is about 16.5 Ω-inches (0.419 Ω-m).

The appropriate DC resistance value for conductive-resistive medium and substrate assemblies 58 for use with a given fluorescent lightbulb is generally that which will result in the same voltage drop across the bulb in steady state operation with the assembly 58 as with a conventional ballast. It is determined by a process of trial and error. However, an initial approximation can be made as follows. First, operate the bulb with a conventional ballast and measure the RMS voltage drop across the bulb and the RMS current through the bulb (during steady-state operation). Next, calculate a "resistance" value for the bulb, R=V/I, where R="resistance" in ohms, V=voltage drop across bulb in volts, and I=current through bulb in amperes. It is to be understood that, as is well known in the art, fluorescent bulbs have highly nonlinear volt-ampere characteristics; the calculated "resistance" value is for approximation purposes only.

The DC resistance value for the conductive-resistive medium and substrate assembly should then be selected so as to achieve the same voltage drop across the to bulb as for operation with the ballast. This can be done by applying the well-known voltage divider law to the series combination of the conductive-resistive medium and substrate assembly and the fluorescent lightbulb, using the bulb "resistance" calculated above and the applied (e.g., line) voltage, to solve for the required nominal In resistance of the assembly 58 [hereinafter, "calculated nominal R"]. It is to be understood that, although the conductive-resistive medium and substrate assemblies 58 are specified by their DC resistance, they are not necessarily believed to be purely resistive; indeed, it is believed that they may exhibit both resistive and reactive (i.e., inductive or capacitive) components of impedance at typical alternating current (AC) frequencies. However, the preceding procedure has been found adequate for initial sizing of assemblies 58. Further, it is believed that the current passing through assemblies 58 is, at least substantially, an ordinary conduction current. Yet further, inductive-resistive structures which are purely resistive (or substantially so) are contemplated by this (and the parent) application. Such structures can include discrete resistors, either singly or in assemblies. It is possible that such individual resistors, or assemblies thereof, could be utilized with the embodiments of the invention, for example, depicted in FIGS. 17 and 22 herein, and discussed elsewhere herein. While such (substantially) purely resistive structures would be dissipative, they would tend to minimize undesirable phase shifts as compared with reactive structures/ballasts.

Figure 23:
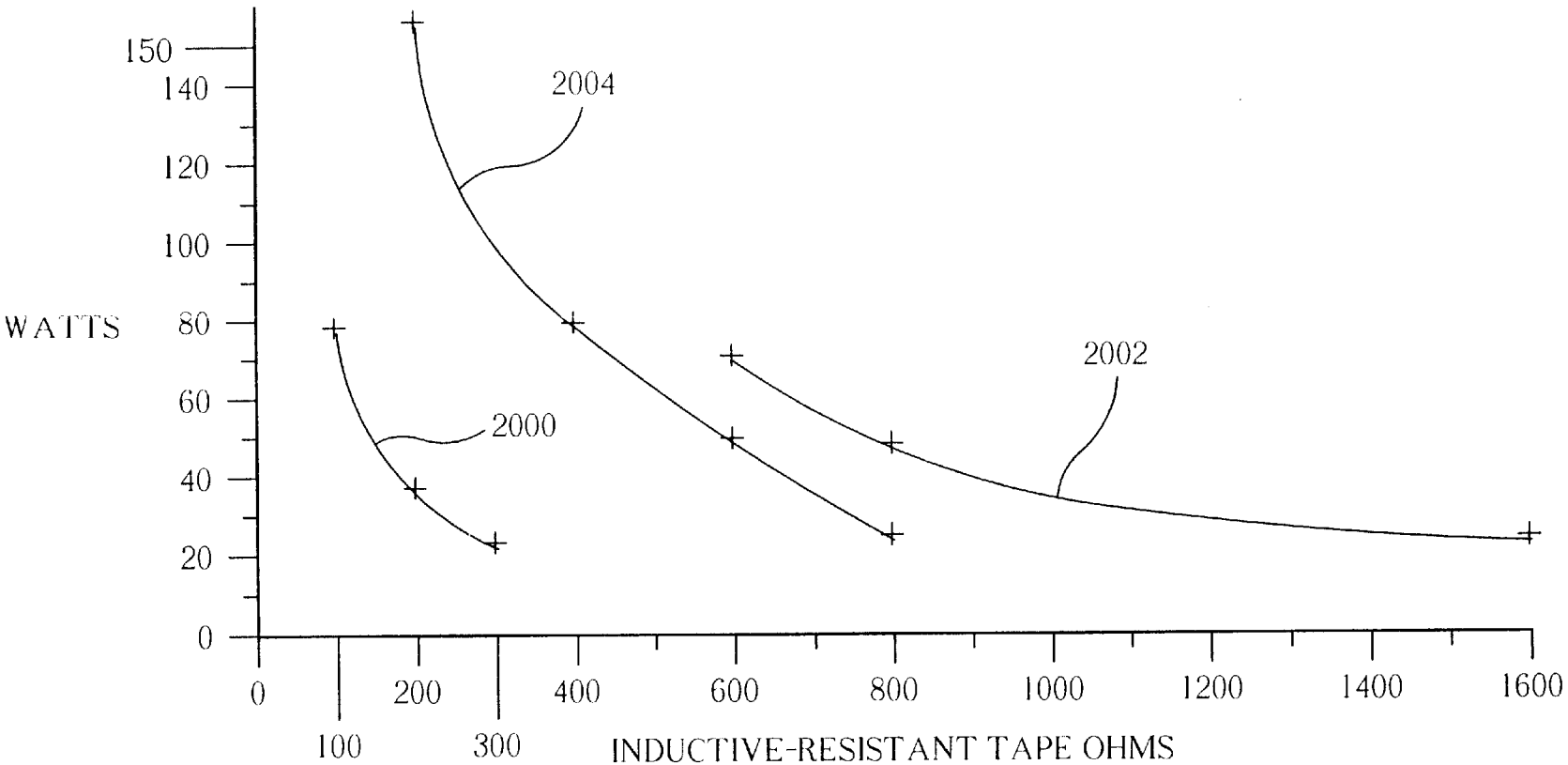
FIG. 23 is a plot of nominal wattage versus inductive-resistive structure nominal resistance for several preheat type bulbs.
Figure 24:
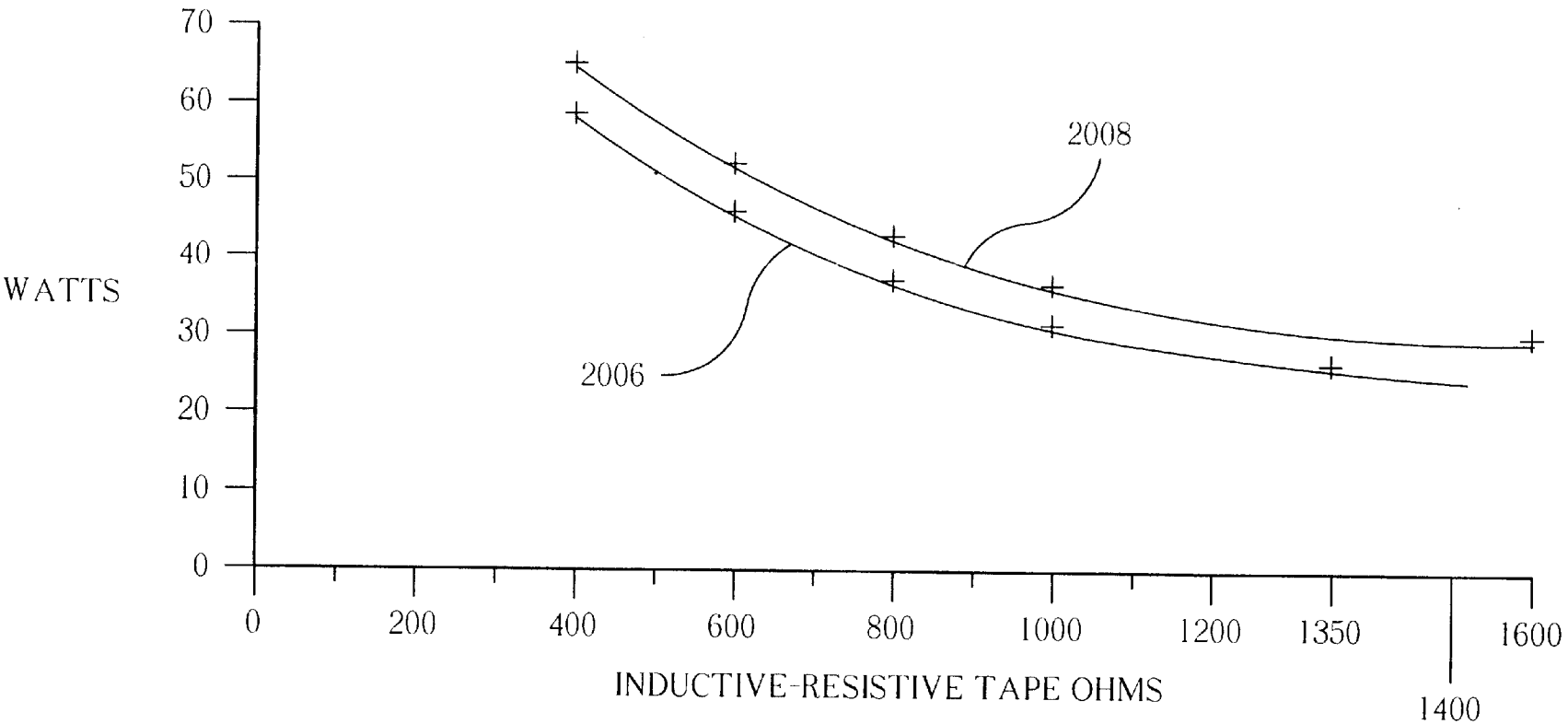
FIG. 24 is a plot similar to FIG. 23 for several instant-start type bulbs.

FIG. 23 shows plots of nominal wattage versus resistance value (nominal R) for various preheat type bulbs. Curve 2000 is for a 24 inch (0.61 m) bulb operated on 114 VAC (line voltage across inductive structure and bulb); curve 2002 is for a 24 inch (0.61 m) bulb operated on 230 VAC; and curve 2004 is for a 48 inch (1.2 m) bulb operated on 230 VAC. The nominal wattage is the RMS line voltage times the line current drawn (also RMS), uncorrected for power factor. FIG. 24 is a similar plot for instant-start bulbs operating off a capacitor tripler circuit producing pulsed DC varying from 109 to 320 Volts, with 115 VAC, 60 Hz line input. Curve 2006 is for a 72 inch (1.8 m) bulb and curve 2008 is for a 24 inch (0.61 m) bulb. FIGS. 23 and 24 illustrate the nonlinearity of the resistance-selecting process.

It is known in the art that ballasts are generally incapable of operating at low temperatures. For example, standard ballasts typically cannot operate below 50–60° F.; operation down to 0° F. is possible only with specialized, expensive, high power units. The present invention is capable of providing low-temperature operation (down to freezing temperatures). Such operation can be aided by using heating properties of the conductive-resistive medium employed with the present invention. Referring again to in FIG. 4, coating 114 also generates ohmic heat in response to the passage of electrical current therethrough. Conductive-resistive medium and substrate assembly 58 can be disposed in thermal communication with housing 52 in order to transmit at least a portion of the heat to housing 52, thus further aiding low-ambient-temperature operation. This effect can be still further enhanced by mounting the conductive-resistive medium 114 directly on housing 52, as shown, for example, in FIG. 7.

Figure 8:
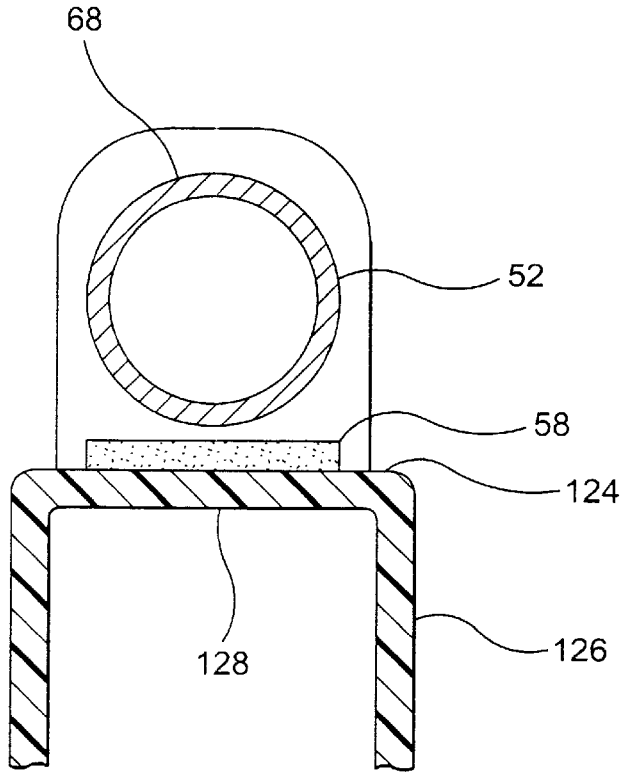
FIG. 8 shows one configuration in which an inductive-resistive structure of the present invention can be mounted on a conventional fluorescent light fixture.
Figure 9:
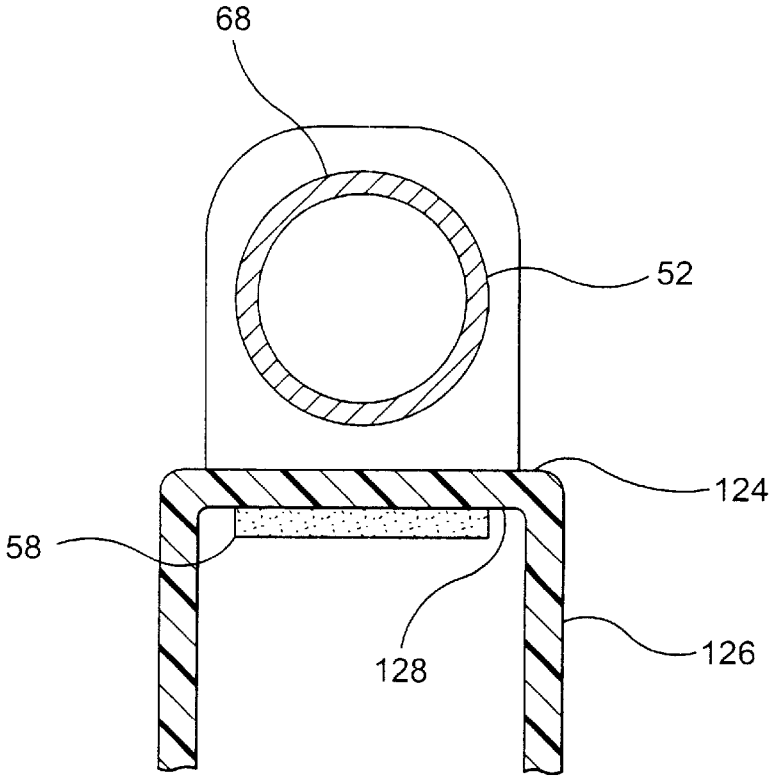
FIG. 9 shows another configuration in which an inductive-resistive structure in of the present invention can be mounted on a conventional fluorescent light fixture.

As discussed below in the examples section (Examples 2, 3 and 12), the present invention has been employed with conventional fluorescent light mounting structures, which are typically made of sheet metal. FIG. 8 shows a typical cross section through such an installation wherein the conductive-resistive medium and substrate assembly 58 is applied to the top 124 of housing assembly 126. In an alternative configuration, conductive-resistive medium and substrate assembly 58 may be applied to the bottom 128 of housing 126, as shown in FIG. 9. It has been found that adhering the conductive-resistive medium and substrate assembly 58 to the metallic housing 126 apparently enhances the electromagnetic interaction between the conductive-resistive medium and substrate assembly 58 and the bulb 68, thus permitting the bulb to start when located flitter away from the conductive-resistive medium and substrate assembly 58. Tis effect may be thought of as a "focusing" of the electromagnetic field.

Figure 10:
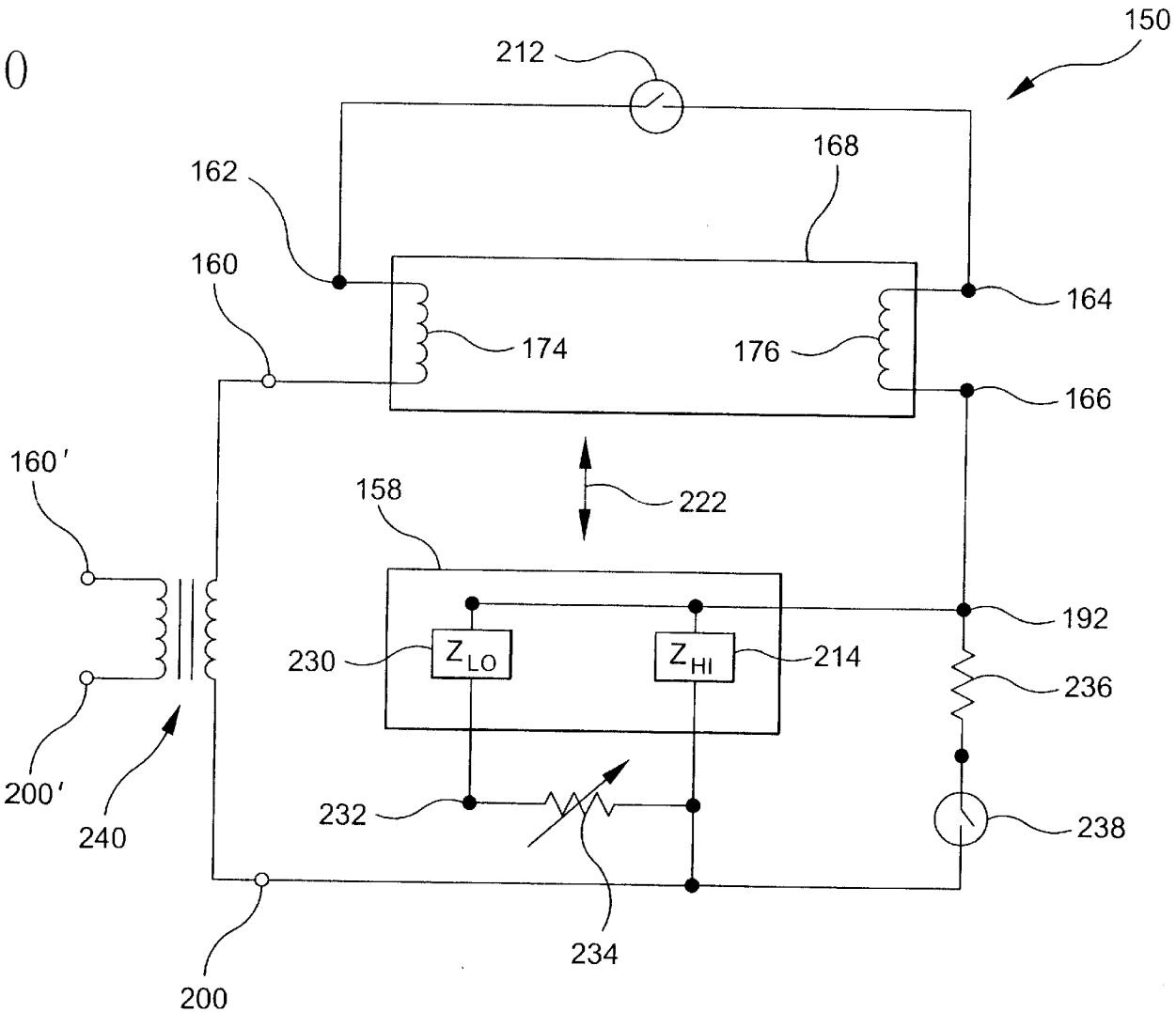
FIG. 10 shows a circuit diagram of an embodiment of the present invention adapted for dimming.

The present invention may also be employed to permit dimming of fluorescent lamps, using only a conventional incandescent lamp type dimmer such as a rheostat. FIG. 10 shows a circuit diagram for an embodiment of the invention which includes such a dimming function. Items similar to those shown in FIG. 5 have received the same reference numeral, incremented by 100. The inductive-resistive structure of the embodiment of FIG. 10 is formed as a conductive-resistive medium and substrate assembly 158. Assembly 158 includes first and second elongate tape structures generally similar to the elongate tape structure shown in FIGS. 4 and 6. One or both of these can be applied to a surface of lightbulb 168, as shown in FIG. 7. The second elongate tape structure includes a second substrate generally similar to substrate 78 of FIGS. 4 and 6, and having top and bottom edges similar to edges 80,82 of substrate 78. The second elongate tape structure also includes a second top conductor strip similar to top conductor strip 88 of assembly 58. The second top conductor strip has a first exposed end which is electrically interconnected with fifth electrical terminal 192. Assembly 158 also includes a second bottom conductor strip similar to bottom conductor strip 96 of assembly 58. The second bottom conductor strip has a first exposed end forming a seventh electrical terminal 232 as shown in FIG. 10.

A second conductive-resistive coating 230 is located on the second substrate and is electrically interconnected between the second top and second bottom conductor strips. The first conductive-resistive coating 214 and the second conductive-resistive coating 230 are both represented in FIG. 10 as generalized impedances, $Z_{HI}$ and $Z_{LO}$ respectively. The first and second conductive-resistive coatings 214,230 are selected for effective dimming of lightbulb 168, as described below. A conventional incandescent light dimmer 234 is electrically interconnected between sixth electrical terminal 200 and seventh electrical terminal 232. As discussed below in the examples section, first conductive-resistive coating 214 may be selected to yield a DC resistance of 1000 ohms, while second conductive-resistive coating 230 may be selected to yield a DC resistance of 200 ohms. Optionally, resistor 236 and a second starter switch such as second starter bulb 238 may be connected in series between fifth terminal 192 and sixth terminal 200, for reasons to be discussed hereinbelow.

Selection of first and second conductive-resistive coatings for effective dimming preferably proceeds as follows. The minimum impedance value Z of the assembly ("assembly Z") formed by: series connection of coating 230 and dimmer 234 in parallel with coating 214 should be roughly equal to the calculated nominal R for the bulb, discussed above. However, a somewhat lower value can be selected to aid in starting.

The maximum impedance value of the assembly should be selected to dim the bulb 168 down to the desired level; a ratio of maximum to minimum impedance as high as 26:1 has been tested in another dimming embodiment of the invention depicted in FIG. 13 and discussed below and in Example 5. It is believed that even higher ratios may be usable. Conversely, any ratio beyond 1:1 should yield some dimming; in practice, dimming has been observed at a ratio as low as 2:1 in the embodiment of FIG. 16 discussed below and in Example 7. The foregoing discussion applies to all dimming embodiments discussed herein; the "assembly Z" is simply the effective impedance of the inductive-resistive structure(s) in series with the bulb.

In operation, an AC voltage is applied between first and sixth terminals 160,200. Where desired, a step up transformer 240 may be employed to raise the voltage. In this case, line voltage is supplied to terminals 160', 200' and stepped up before being applied to first and sixth terminals 160,200. A stepped-up voltage will normally be employed for 48 inch (1.2 m) (and other longer) bulbs. Starter bulb 212 operates conventionally and permits preheating of electrodes 174,176. An electromagnetic field interaction symbolized by arrow 222 is believed to be present between bulb 168 and conductive-resistive medium and substrate assembly 158. Once the bulb has started, and it is desired to dim the bulb, the resistance of dimmer 234 can be progressively increased, thereby increasing the overall impedance between terminals 160,200 and reducing the overall current flow. Accordingly, the lower current draw through the bulb 168 results in less of a voltage drop across bulb 168. The lower current results in dimming of bulb 168.

In order to achieve starting of bulb 168, dimmer 234 must normally be initially in or near a full bright position (i.e., minimum resistance value). Resistor 236 and a second starter switch such as second starter bulb 238 are optionally provided to permit starting with dimmer 234 in a dim position. When dimmer 234 is in dim position, i.e., at a relatively high resistance not near the minimum resistance value, the total to impedance of assembly 158 and dimmer 234 might be too great to permit sufficient current to flow to warm electrodes 174,176. Accordingly, the second starter switch such as second starter bulb 238 in series with a resistor 236 may be connected in parallel with the unit which includes assembly 158 and dimmer 234. For initial starting, bulb 238 closes and provides a parallel current path through resistor 236, in order to insure adequate current flow to permit heating of electrodes 174,176. A suitable resistor value for use with a 48 inch (1.2 m) 40 watt bulb is about 100 ohms. Once electrodes 174,176 are sufficiently hot bulbs 212,238 open and bulb 168 can start at a relatively low light level.

Figure 11:
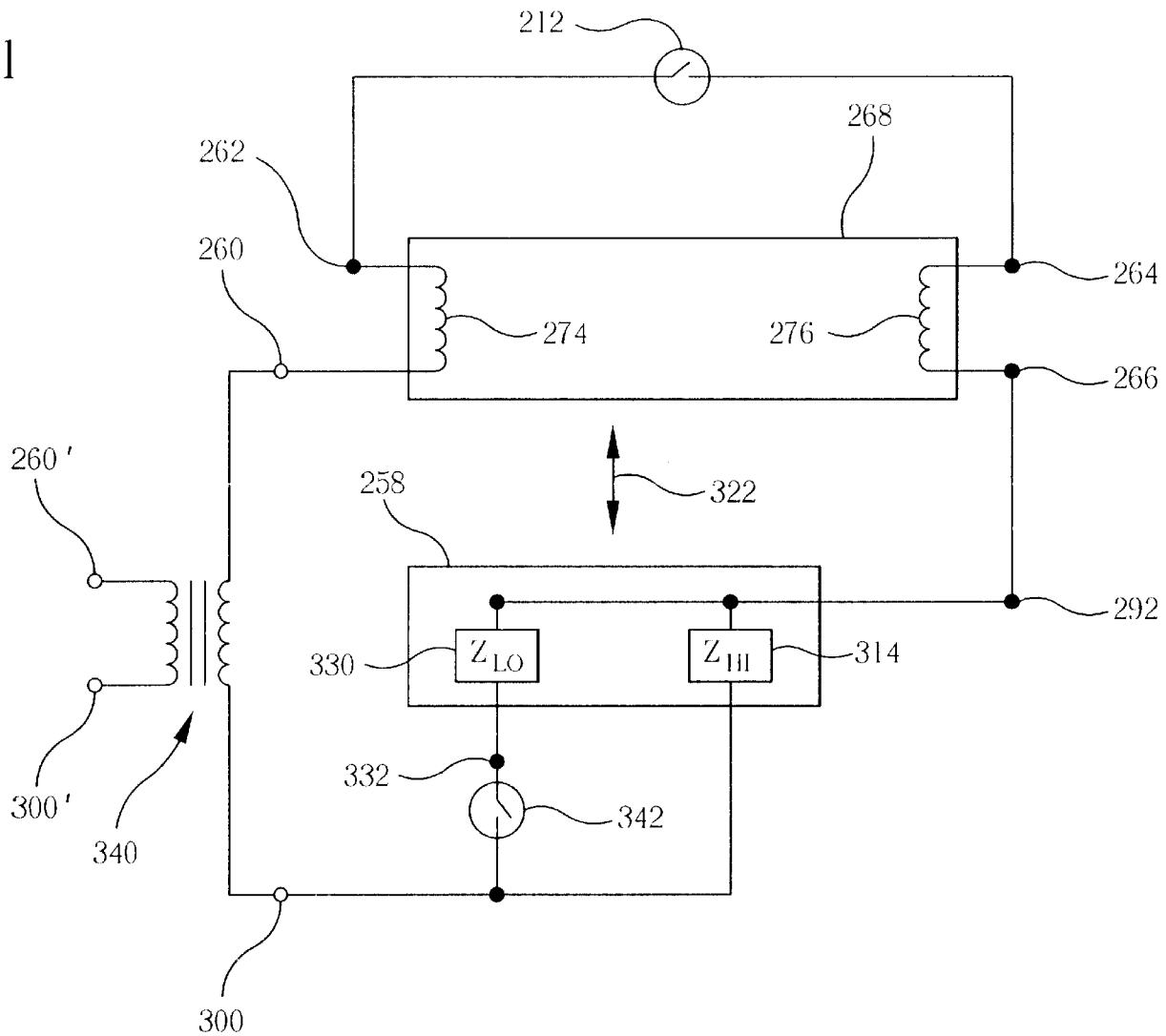
FIG. 11 shows a circuit diagram of an embodiment of the invention including two inductive-resistive structures selected for optimal starting and efficient steady-state operation.

FIG. 11 shows another alternative embodiment of the invention which is also provided with two elongate tape structures. One is selected for ease in starting the lightbulb, while the other is selected for efficient steady-state operation of the lightbulb. As used herein, "steady-state" refers to operation of the fluorescent lightbulb after the initial starting period. Components in FIG. 11 which are similar to those in FIG. 10 have received the same reference numeral, incremented by 100. Once again, the inductive-resistive structure of the embodiment of FIG. 11 includes a conductive-resistive medium and substrate assembly 258 which is formed with a second elongate tape structure including a second conductive-resistive coating 330. The second elongate tape structure includes a second substrate generally similar to substrate 78 of FIG. 4, and having top and bottom edges generally similarly to edges 80,82 of FIG. 4. A second top conductor strip generally similar to top conductor strip 88 as shown in FIG. 4 has a first exposed end, generally similar to first exposed end 90 of FIG. 4, which is electrically interconnected with fifth electrical terminal 292. Similarly, a second bottom conductor strip generally similar to bottom conductor strip 96 shown in FIG. 4 is secured to the second substrate adjacent the bottom edge and has a first exposed end forming a seventh electrical terminal 332.

A second conductive-resistive coating 330 is located on the second substrate and is electrically interconnected with the second top and second bottom conductor strips. The first conductive-resistive coating 314 is selected for efficient steady-state operation of the lightbulb. Resistance values of coatings 314, 330 can be selected in the same manner as set forth above for dimming purposes; the combined impedance of coatings 314, 330 (assembly Z) can be selected to be somewhat less than the calculated nominal R, for ease in starting. A second starter switch such as second starter bulb 342 is electrically interconnected between seventh electrical terminal 332 and sixth electrical terminal 300. (Note that the second starter switch (second starter bulb 342) of FIG. 11 is positioned differently than second starter bulb 238 of FIG. 10, and so has received an alternative reference numeral.)

Second starter switch such as second starter bulb 342 closes upon initial starting of the system to permit both low-impedance conductive-resistive coating 330 and high-impedance conductive-resistive coating 314 to conduct. This yields a relatively low equivalent resistance ($Z_{HI}$ in parallel with $Z_{LO}$) which permits more current to pass through electrodes 274, 276 to allow preheating of the electrodes. Once fluorescent bulb 268 has started, switch 342 opens, removing the low impedance conductive-resistive coating 330 from the circuit, thus permitting coating 314 to control effective impedance of the circuit, therefore resulting in more efficient operation. It is to be understood that bulb 342 could be located at the opposite terminal of item 330. Coating 314 might be selected to yield a DC resistance of, for example, 1000 ohms, while coating 330 might be selected to yield a DC resistance of, for example, 400 ohms.

Figure 12:
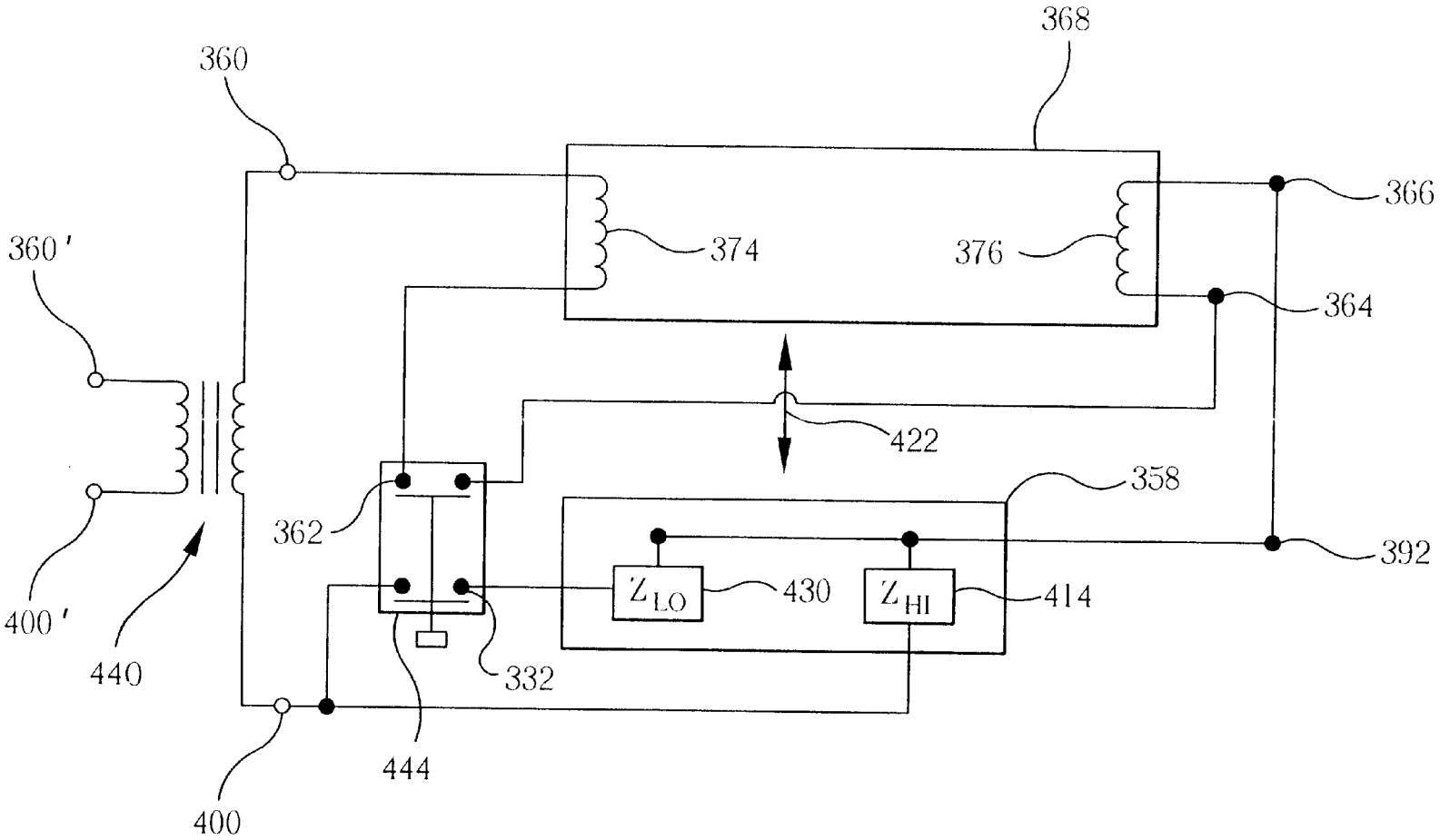
FIG. 12 shows a circuit diagram of an embodiment of the invention which is very similar to that shown in FIG. 11 and which is adapted for push-button operation.

Yet another alternative embodiment of the invention is shown in FIG. 12. This embodiment is quite similar to that of FIG. 11, and once again, similar components have received similar reference numerals incremented by 100. In the embodiment of FIG. 12, starter bulbs 212, 342 are replaced with a single switch if such as push button type single throw double pole ("push-to-hold") switch 444. Switch 444 provides simultaneous, selective electrical interconnection between second electrical terminal 362 and third electrical terminal 364, and between seventh electrical terminal 332 and sixth electrical terminal 400. Second conductive-resistive coating 430 is selected for starting purposes similar to coating 330, and is removed from the circuit once push button switch 444 is opened, thus permitting efficient operation using only first conductive-resistive coating 414.

Figure 13:
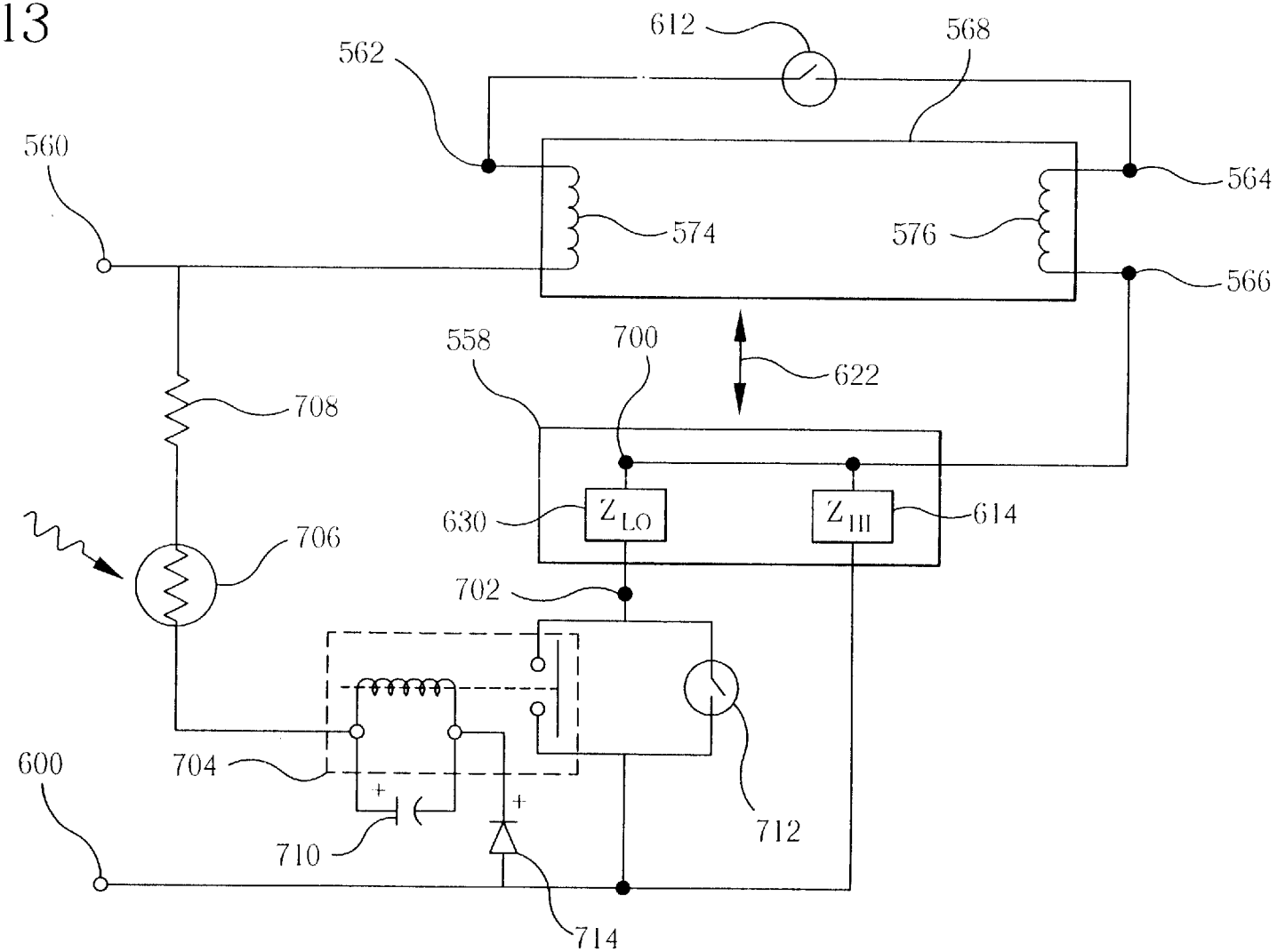
FIG. 13 is a circuit diagram of an embodiment of the invention adapted for automatic dimming.

Still another alternative embodiment of the invention is shown in FIG. 13. This embodiment is quite similar to that shown in FIG. 10. Similar components have received similar reference numerals incremented by 400. The embodiment shown in FIG. 13 is capable of automatic dimming in response to ambient light levels. Note that in FIG. 10, second conductive-resistive coating 230 is connected to sixth electrical terminal 200 through dimmer 234. In the embodiment of FIG. 13, second conductive-resistive coating 630 has seventh and eighth electrical terminals 700, 702. Coating 630 can be selectively connected into the circuit by means of an automatic circuit arrangement which will now be described.

Control relay 704 is capable of selectively connecting second conductive-resistive coating 630 into the circuit. The coil of relay 704 is connected across first and sixth electrical terminals 560, 600 in series with resistor 708, photoresistor 706, and diode 714. When the ambient surroundings are relatively light, photoresistor 706 conducts and energizes control relay 704. As shown in FIG. 13, when control relay 704 is in an energized state, it removes second conductive-resistive coating 630 from the circuit by opening the connection between terminals 702 and 600. This forces all the current in the circuit to pass through the first conductive-resistive coating 614, which is of a higher impedance, thus resulting in dim operation of lamp 568. When ambient surroundings are relatively dark, photoresistor 706 does not conduct, and thus the coil of control relay 704 is not energized. This results in closing the connection between terminals 702 and 600, and thus, second conductive-resistive coating 630 is placed in the circuit, in turn resulting in a relatively low impedance path for current flow, with bright operation of lamp 568. Diode 714 and polarized capacitor 710 insure that relay 704 does not chatter. Second conductive-resistive coating 630 is also placed in circuit for initial starting of bulb 568 by means of a second starter switch such as second starter bulb 712.

It will be appreciated that photoresistor 706 and control relay 704 together comprise a light-responsive switch for connecting the elongate tape structure which includes second conductive-resistive coating 630 in parallel with the first elongate tape structure which includes first conductive-resistive coating 614 by connecting seventh and eighth electrical terminals 700, 702 between fourth and sixth electrical terminals 566, 600. The first and second conductive-resistive coatings 614, 630 are selected for dim operation of bulb 568 when only first conductive-resistive coating 614 is in circuit, and for suitably bright operation of lightbulb 568 when both conductive-resistive coatings 614, 630 are in circuit.

Figure 14:
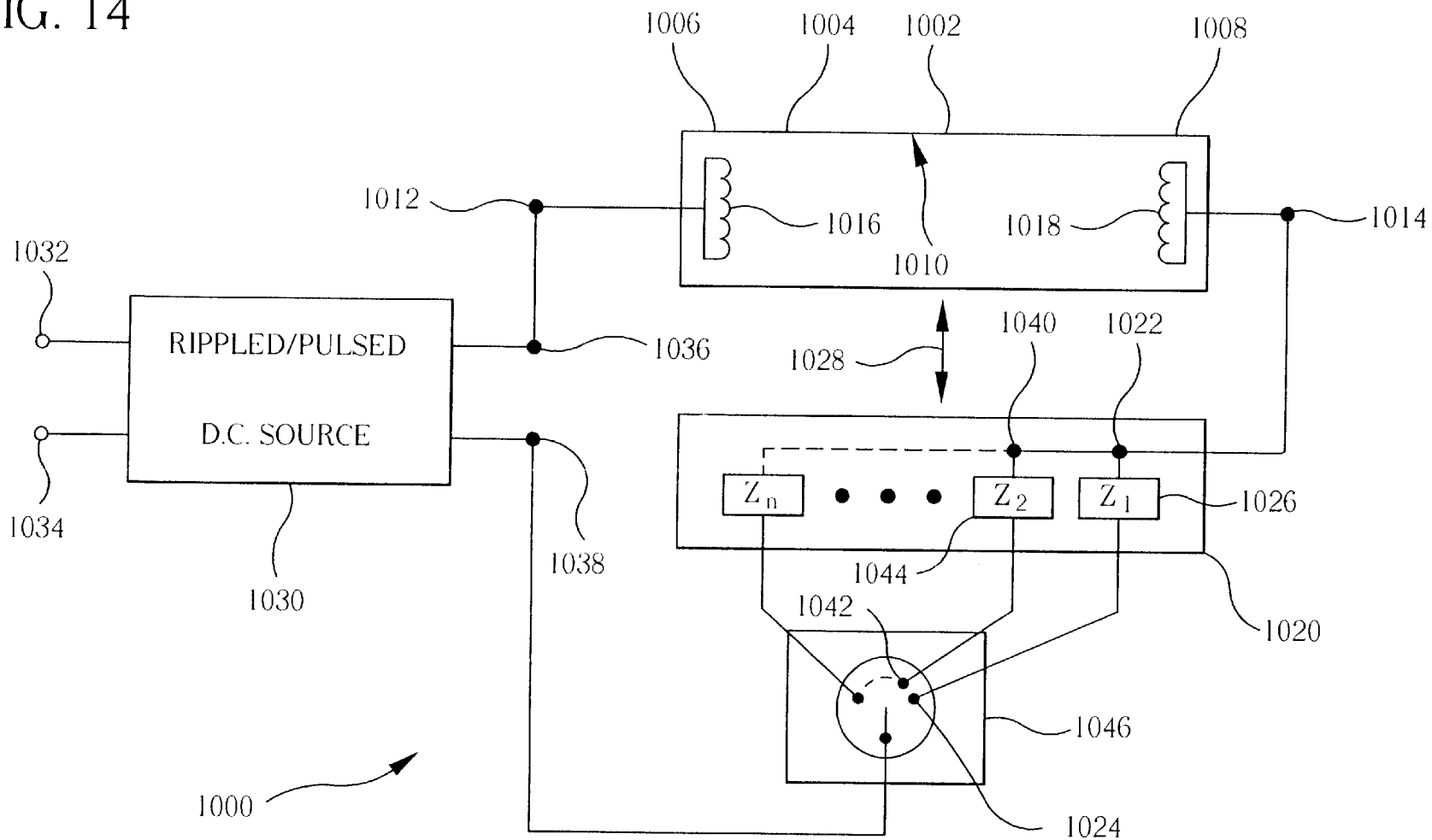
FIG. 14 is a circuit diagram of an embodiment of the invention adapted for "instant-start" operation and having dimming capability.

Referring now to FIG. 14, an "instant-start" embodiment of the invention 1000 is shown. Although referred to for convenience as an "instant-start" embodiment, the embodiment depicted in FIG. 14 and subsequent figures can, in fact, operate using either preheat or instant-start type bulbs, as discussed below. Still referring to FIG. 14, the apparatus of the embodiment 1000 includes a first fluorescent lightbulb 1002 including a translucent housing 1004 having first and second ends 1006, 1008 respectively. Bulb 1002 contains a fluorescent medium 1010 in the same fashion as discussed above with respect to other embodiments of the invention. Electrical connections, including first and second electrical terminals 1012, 1014 respectively, are provided on housing 1004. Bulb 1002 includes first and second electrodes 1016, 1018 located respectively at first and second ends 1006, 1008 of housing 1004.

Bulb 1002 may be of the instant-start type, having only a single contact at each end. Alternatively, bulb 1002 can be of the preheat type, having two contacts at each end, but only a single contact at each end need be connected. Bulb 1002 can even be a burned out preheat type bulb, with the connections at each end made to a remaining portion of the electrode, preferably the largest portion.

Still referring to FIG. 14, apparatus 1000 also includes an inductive-resistive structure 1020. Inductive-resistive structure 1020 includes at least a first elongate tape structure similar to those discussed above, including a first substrate having a top edge and a bottom edge; a first top conductor strip secured to the first substrate adjacent the top edge; and a first bottom conductor strip secured to the first substrate adjacent the bottom edge. The first top conductor strip has a first exposed end forming a third electrical terminal 1022 which is electrically interconnected with second electrical terminal 1014. The first bottom conductor strip has a first exposed end forming a fourth electrical terminal 1024. A first conductive-resistive coating 1026 is located on the first substrate and is electrically interconnected with the first top and first bottom conductor strips.

The construction of the first elongate tape structure is identical to that shown in the figures above for the preheat embodiment of the invention, and so has not been shown in detail in FIG. 14. Rather, third and fourth electrical terminals 1022, 1024 of first conductive-resistive coating 1026 have been shown in schematic form. First conductive-resistive coating 1026 has been labeled $Z_1$ to indicate its nature as a generalized impedance. Double headed arrow 1028 symbolizes the electromagnetic field interaction between inductive-resistive structure 1020 and bulb 1002. Apparatus 1000 also includes a source of rippled/pulsed DC voltage 1030. This source may be a rectifier having first and second alternating current input voltage terminals 1032, 1034. Source 1030 also has a first output terminal 1036 electrically interconnected with first electrical terminal 1012, and a second output terminal 1038 electrically connected with fourth electrical terminal 1024. Source 1030 is electrically configured to produce a direct current exhibiting a rippled/pulsed DC voltage component between output terminals 1036, 1038. Where source 1030 is a rectifier, AC voltage, such as ordinary household line voltage, may be applied to input terminals 1032, 1034 and may be rectified as well as stepped-up in voltage by source 1030. Source 1030 could also be a battery connected to a pulse-generating network electrically configured to step up the battery voltage, in which case AC input voltage terminals 1032, 1034 would not be present.

Frequency values of the AC component or "ripple" on the DC voltage have been measured from 60–120 Hz when a rectifier is used as source 1030 with 60 Hz input. In initial tests with a DC pulsing circuit, the "pulse-frequency" has been measured from 400–1000 Hz. It is not believed that there are any frequency limitations on the present invention, so that operation from, say, 1 Hz up to RF type frequencies should be possible. However, the measured values may be taken as an initial preferred range (60–1000 Hz). Ability to operate at low frequencies (much less than RF) is an advantage of the present invention.

Inductive-resistive structure 1020 may optionally include at least a second elongate tape structure configured as described above. The second elongate tape structure can have a top conductor strip with a first exposed end forming a fifth electrical terminal 1040. Similarly, the bottom conductor strip of the second elongate tape structure can include a first exposed end forming a sixth electrical terminal 1042. The second elongate tape structure can include a second conductive-resistive coating 1044 which is depicted in FIG. 14 as a generalized impedance $Z_2$. Any number of additional elongate tape structures (or equivalent) may be provided, as suggested in FIG. 14 by the depiction of generalized impedance $Z_n$. A switch 1046 can be provided to selectively electrically interconnect fifth and sixth electrical terminals 1040, 1042 between second electrical terminal 1014 and second output terminal 1038 of source 1030. FIG. 14 shows a configuration of switch 1046 wherein a single conductive-resistive coating (any one of $Z_1$–$Z_n$) can be selectively interconnected between second terminal 1014 and second rectifier output terminal 1038.

Figure 15:
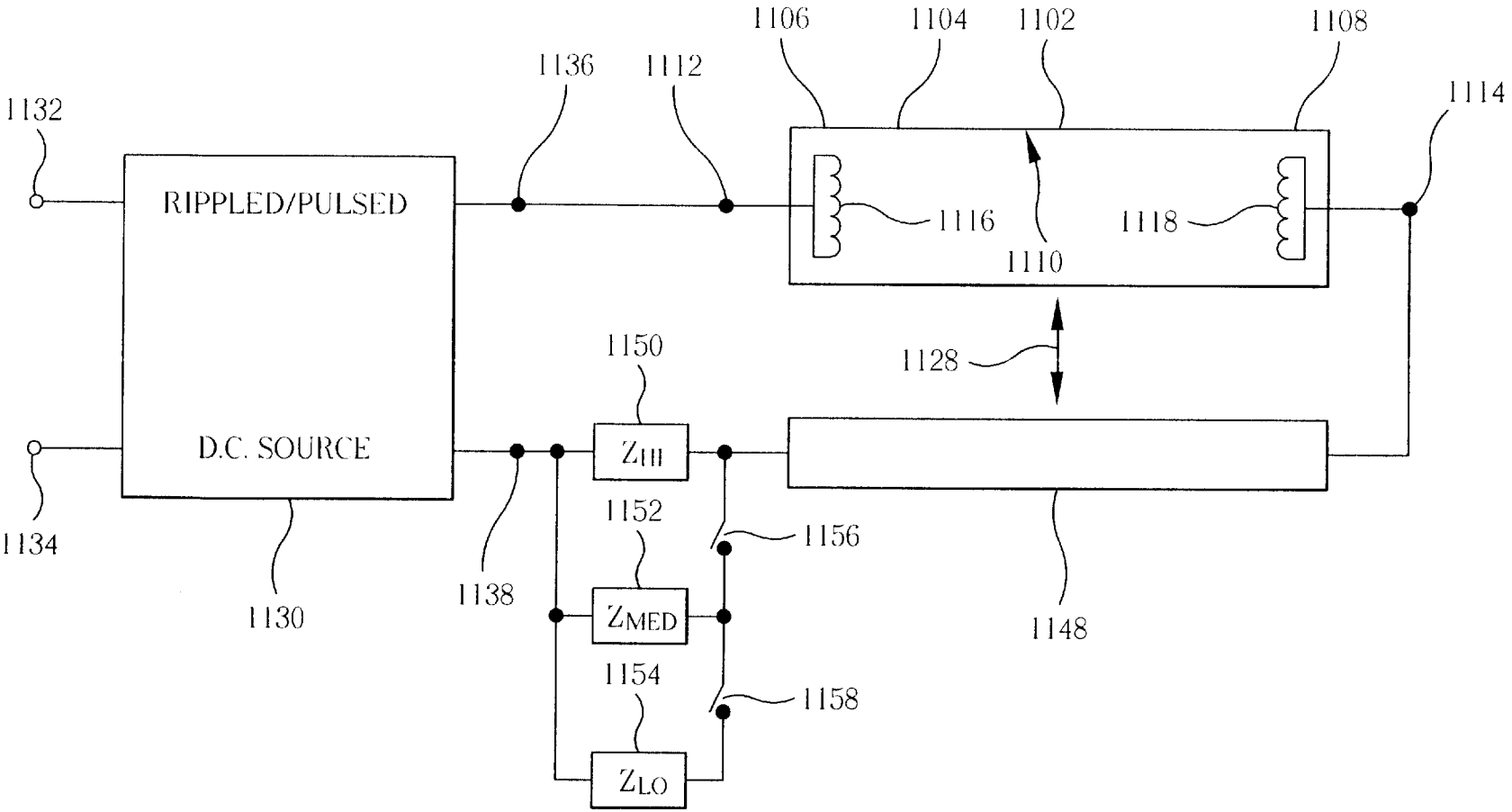
FIG. 15 is a circuit diagram similar to FIG. 14 but with a slightly modified dimming structure.

FIG. 15 shows an embodiment of the invention very similar to that shown in FIG. 14, but having an alternative switching structure for the generalized impedances representing the conductive-resistive coatings. Items in FIG. 15 similar to those in FIG. 14 have received the same reference numeral, incremented by 100. A primary inductive-resistive structure 1148 is provided in proximity to first fluorescent lightbulb 1102 to provide electromagnetic field interaction symbolized by arrow 1128 for purposes of starting bulb 1102. Generalized impedances representing additional conductive-resistive coatings 1150, 1152 and 1154 and designated as $Z_{HI}$, $Z_{MED}$ and $Z_{LO}$ are provided for purposes of dimming. (It is to be understood that the multiple conductive-resistive coatings in FIG. 14 are also provided for dimming purposes).

Conductive-resistive coating 1150 represented by impedance $Z_{HI}$ is connected in series with primary inductive structure 1148, while switch 1156 permits conductive-resistive coating 1152 represented as $Z_{MED}$ to be selectively connected in parallel with $Z_{HI}$ 1150. When coating 1152 is connected in parallel with coating 1150, the combined impedance is less, resulting in greater current flow and higher voltage across bulb 1102. When $Z_{MED}$ is removed from the circuit, the bulb operates in a dimmer range. Similarly, switch 1158 permits coating 1154 represented as $Z_{LO}$ to be selectively connected in parallel with $Z_{HI}$ 1150 and $Z_{MED}$ 1152. $Z_{LO}$ may be selected to provide a relatively bright light when in parallel with $Z_{HI}$ and $Z_{MED}$; $Z_{MED}$ may be selected for a medium-intensity light when in parallel with $Z_{HI}$, and $Z_{HI}$ may be selected to produce a relatively dim light by itself. Two or all three of $Z_{HI}$, $Z_{MED}$ and $Z_{LO}$ could be of equal resistance since the parallel combinations will yield the desired overall resistance values. A two-level ring light (which could easily be expanded to three levels as in FIG. 15) is described below in Example 8.

Figure 16:
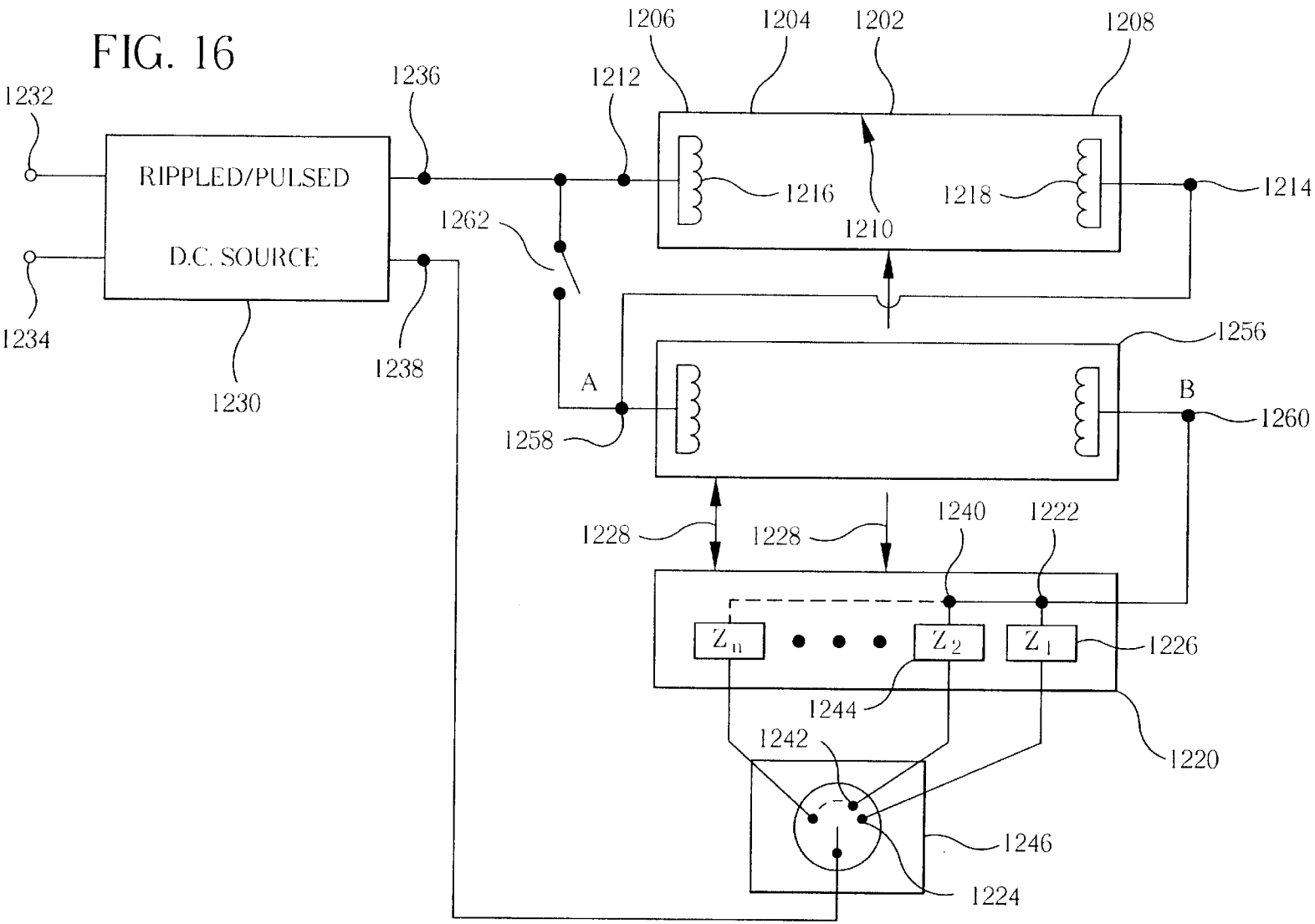
FIG. 16 is a circuit diagram of a two-bulb instant-start apparatus with dimming formed in accordance with the present invention.

FIG. 16 shows yet another embodiment of the invention of the "instant-start" type, employing a second fluorescent lightbulb. Components similar to those in FIG. 14 have received the same reference number, incremented by 200. Second fluorescent lightbulb 1256, which may also be either an instant-start or a preheat type, as discussed above, has an electrical terminal A numbered 1258 and electrical terminal B numbered 1260 at opposite ends. Second and third electrical terminals 1214, 1222 are electrically interconnected through second fluorescent lightbulb 1256 by having terminal A, numbered 1258, electrically interconnected with second electrical terminal 1214 and having terminal B, numbered 1260, electrically connected with third electrical terminal 1222. Switch 1262 provides selective electrical interconnection between first electrical terminal 1212 and terminal A, designated as 1258, in order to electrically remove first bulb 1202 from the circuit when it is not desired to illuminate that bulb, by providing a short circuit across bulb 1202.

Figure 17:
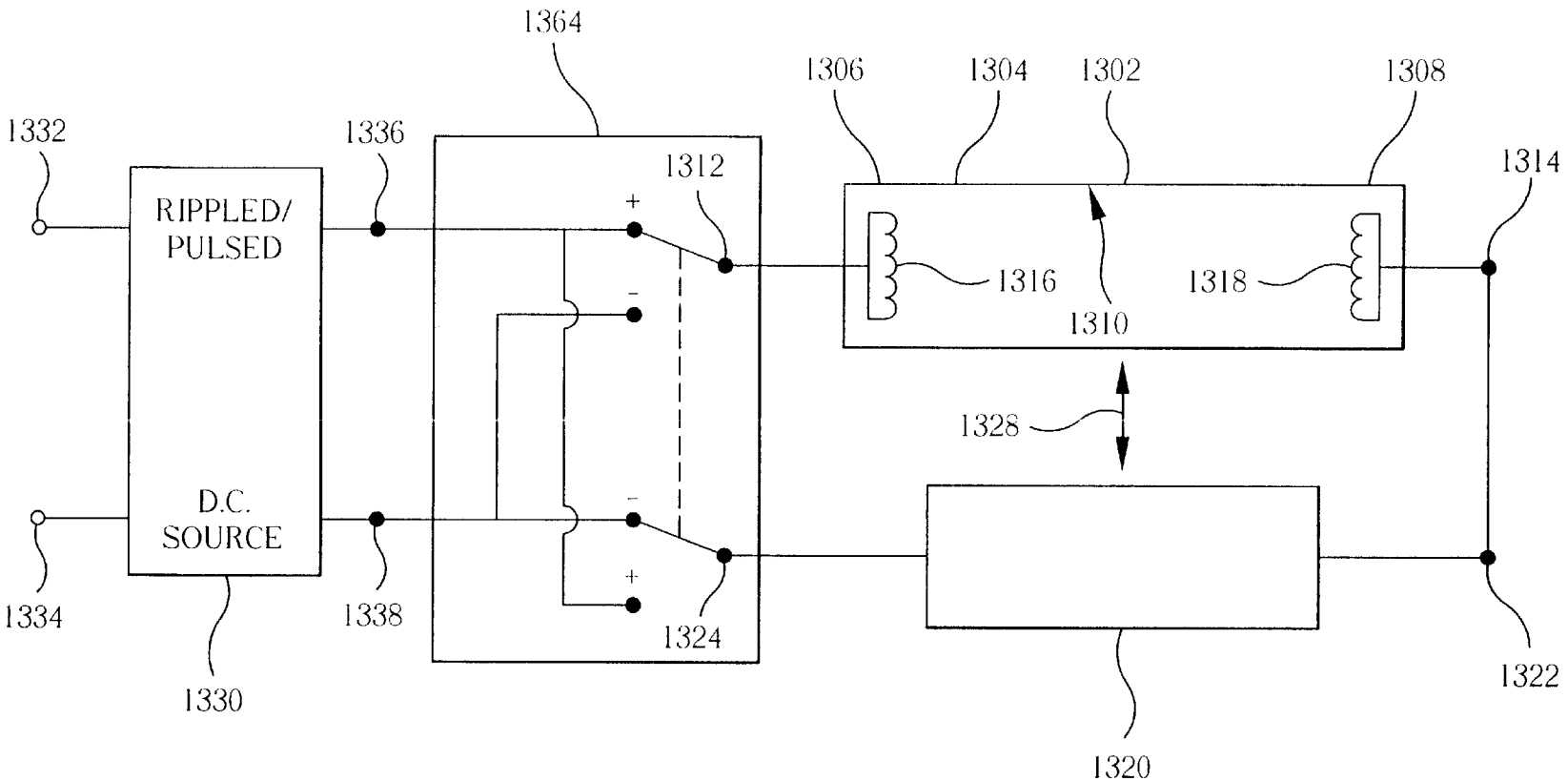
FIG. 17 is a circuit diagram of a special polarity-reversing "instant-start" embodiment formed in accordance with the present invention.

FIG. 17 shows yet another alternative instant-start embodiment, in this case adapted to permit starting of the bulb with the inductive structure located further away from the bulb, by means of a polarity-reversing switch. Items in FIG. 17 which are similar to those in FIG. 14 have received the same reference numeral, incremented by 300. In this configuration, an inductive structure 1320 is provided which may be of the same type of elongate tape structure design discussed above. A double pole single throw polarity reversing switch 1364 is configured to work in conjunction with source 1330 to apply a "voltage spike" to lightbulb 1302 for starting purposes. Switch 1364 has first and second positions. Rectifier 1330 has a positive output terminal 1336 and a negative output terminal 1338. In the first position of switch 1364, switch 1364 electrically connects positive terminal 1336 with first electrical terminal 1312 and negative terminal 1338 with fourth electrical terminal 1324 (as shown in FIG. 17). In the second position of switch 1364, switch 1364 electrically connects negative terminal 1338 with first electrical terminal 1312 and positive terminal 1336 with fourth electrical terminal 1324. It has been found that by applying a "jolt" with the polarity-reversing switch, it is possible to start bulb 1302 further away from inductive structure 1320 than would normally be possible, for example, about 4–6 inches (10–15 cm) away instead of about one inch (2.5 cm). If the switch is not thrown, the inductive structure must normally be maintained within about one inch (2.5 cm) of bulb 1302 for starting purposes.

Figure 18A:
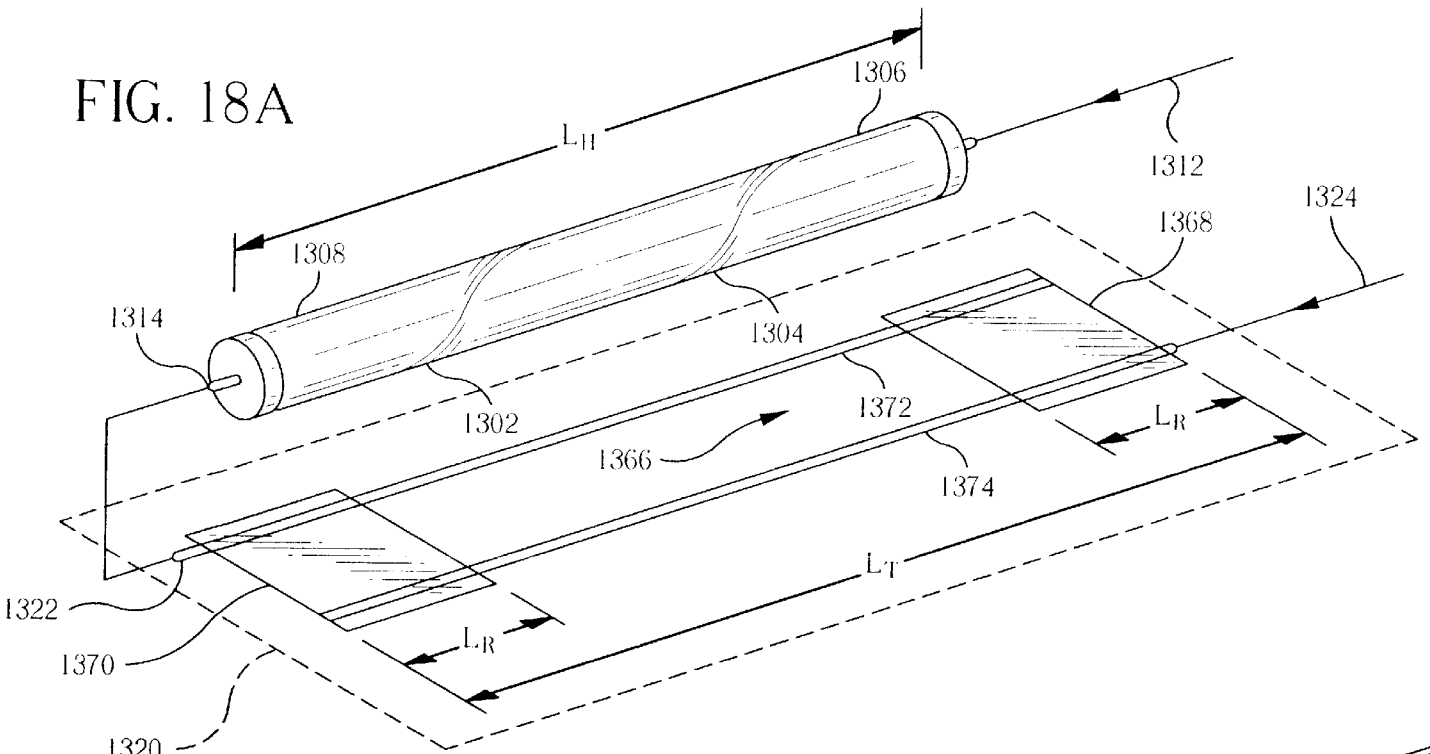
FIG. 18A shows an alternative inductive-resistive structure for use with the present invention.
Figure 18B:
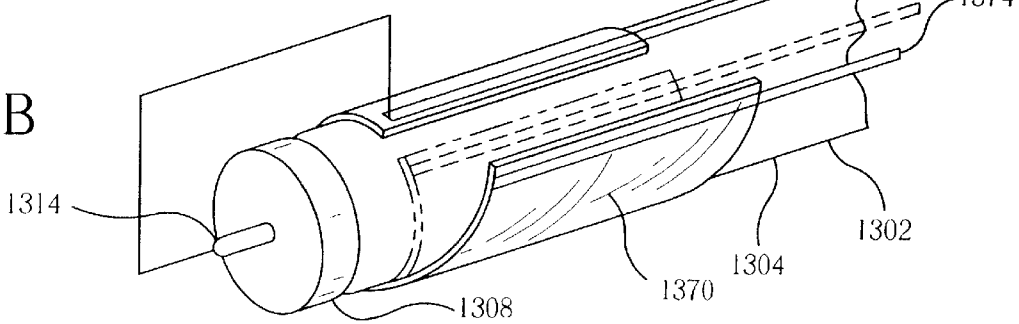
FIG. 18B shows a preferred manner of construction for applying the inductive-resistive structure of FIG. 18A.

Referring now to FIGS. 18A and 18B, there is shown an alternative embodiment of inductive-resistive structure according to the present invention which is suitable for use with the circuit shown in FIG. 17. The inductive-resistive structure of FIGS. 18A and 18B is referred to as a "segmented electron exciter". It is to be understood that, while the configuration of FIGS. 18A and 18B is envisioned for use with the circuit of FIG. 17, the circuit of FIG. 17 can employ inductive-resistive structures of any suitable type, including those disclosed previously in this application. Referring first to FIG. 18A, fluorescent bulb 1302 has first and second electrical terminals 1312 and 1314. Inductive-resistive structure 1320 includes a first substrate configured with a central gap 1366 dividing the first substrate into first and second regions 1368, 1370 respectively. Regions 1368, 1370 are respectively disposed adjacent first and second ends 1306, 1308 of the housing of lightbulb 1302.

Each of regions 1368, 1370 has a length designated as $L_R$. The total length across the ends of the first and second substrate regions is designated as $L_T$, and is essentially co-extensive with a length $L_H$ of housing 1304 of lightbulb 1302. Preferably, the length $L_R$ of each of the first and second substrate regions 1368, 1370 is at least about 12% of the length $L_H$ of housing 1304. The construction of inductive-resistive structure 1320 is otherwise similar to those described above. A first top conductor strip 1372 and a first bottom conductor strip 1374 are provided and are secured to first and second substrate regions 1368, 1370. First top conductor strip 1372 has a first exposed end forming a third electrical terminal 1322 which is electrically interconnected with second electrical terminal 1314. First bottom conductor strip 1374 has a first exposed end forming a fourth electrical terminal 1324.

Referring now to FIG. 18B, in a preferred manner of construction, substrate region such as second substrate region 1370 is secured about second end 1308 of housing 1304 of first fluorescent lightbulb 1302. First substrate region 1368 would, of course, preferably be secured in a similar fashion. It is to be understood that, rather than wrapping the substrate regions about the ends of the bulb, they could also be provided on a flat fixture surface adjacent to the bulb (not shown). Further, the substrate could be continuous and regions 1368, 1370 could be defined by a central gap in the conductive-resistive coating. Yet further, regions 1368, 1370 could be painted onto housing 1304 of bulb 1302.

Figure 19:
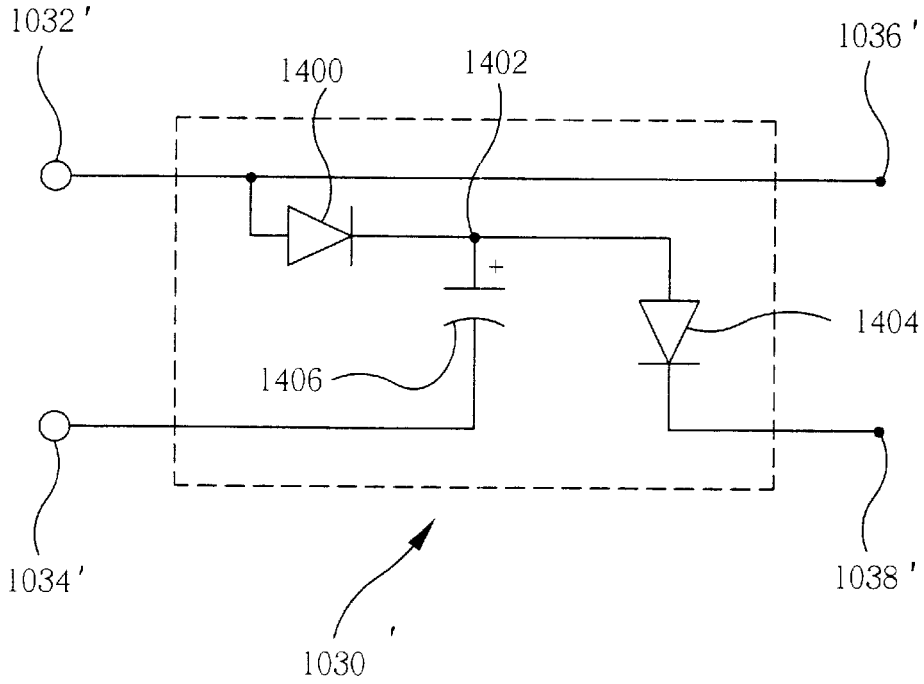
FIG. 19 PRIOR ART
FIG. 19 shows a circuit diagram of a first prior art rectifier design suitable for use with the present invention.
Figure 20:
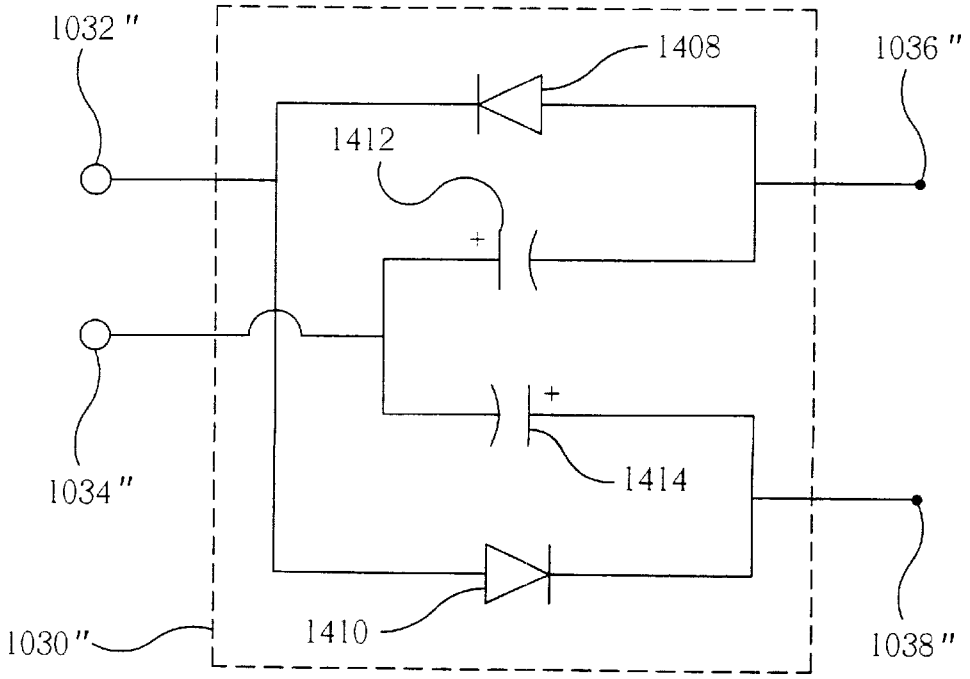
FIG. 20 PRIOR ART
FIG. 20 shows a circuit diagram of a second prior art rectifier design suitable for use with the present invention.
Figure 21:
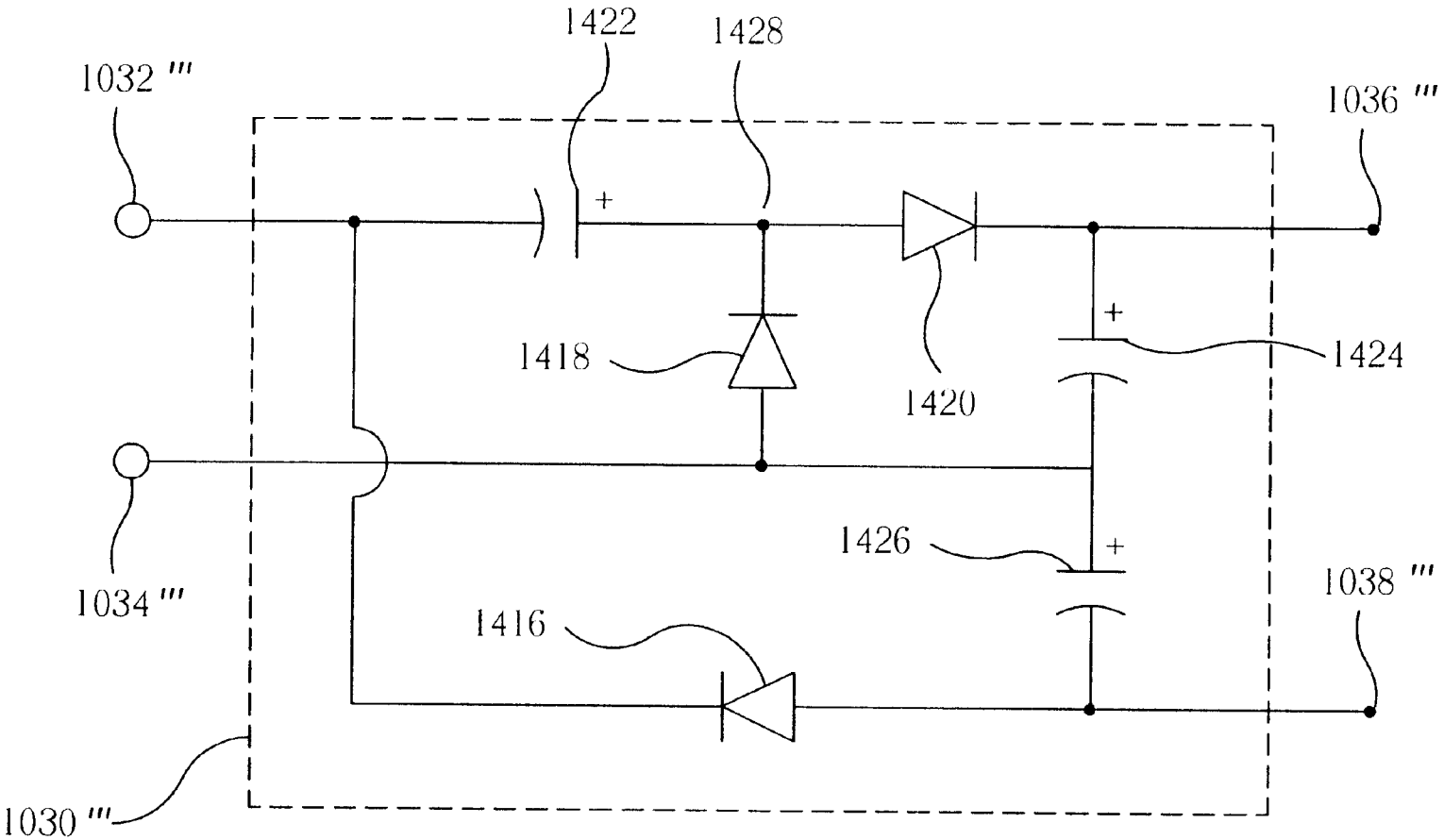
FIG. 21 PRIOR ART
FIG. 21 shows a circuit diagram of a third prior art rectifier design suitable for use with the present invention.

Referring now to FIGS. 19–21, there are illustrated three prior art rectifier configurations suitable for use as sources of rippled DC voltage with the present invention. It is to be understood that these three configurations are only exemplary, and any type of device which produces a rippled/pulsed DC voltage at its output terminals is appropriate for use with the present invention.

Figure 22:
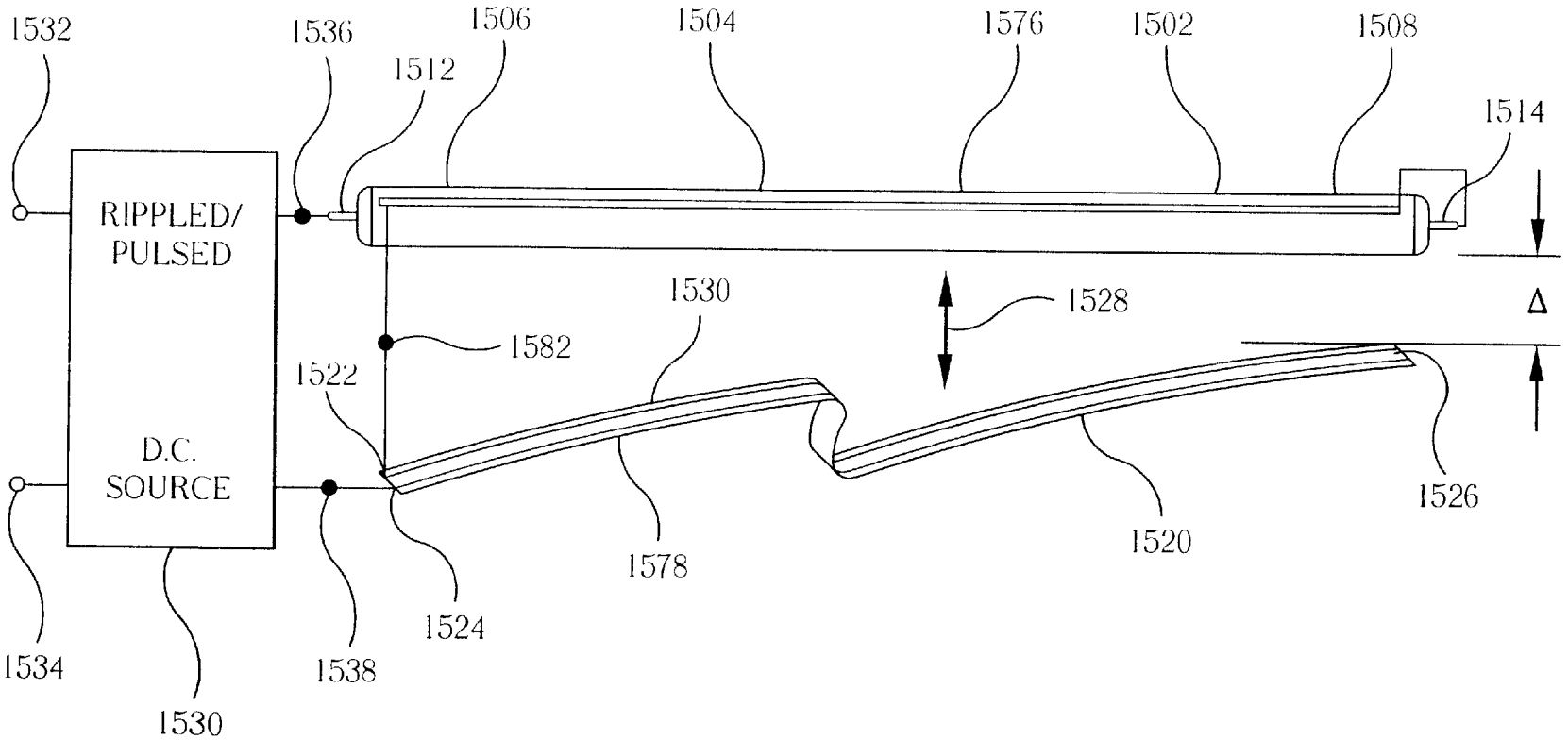
FIG. 22 is a perspective view of an embodiment of the invention wherein a conductive strip is mounted on a fluorescent bulb to enhance electromagnetic interaction.

Referring first to FIG. 19, a rectifier 1030' has first and second AC input voltage terminals 1032', 1034' and has first and second rectifier output terminals 1036', 1038'. First AC input voltage terminal 1032' is electrically interconnected with first rectifier output terminal 1036' to form a common terminal. Rectifier 1030' includes a first diode 1400 electrically interconnected between the common terminal formed by terminals 1032', 1036' and an intermediate node 1402 for conduction from the common terminal to the intermediate node 1402. Rectifier 1030' also includes a second diode 1404 electrically interconnected between intermediate node 1402 and second output terminal 1038' of rectifier 1030' for conduction from intermediate node 1402 to second output terminal 1038'. Rectifier 1030' further includes a polarized capacitor 1406 having its positive terminal electrically connected to intermediate node 1402 and its negative terminal electrically connected to second AC input voltage terminal 1034'. It is to be understood that terminals 1032', 1034', 1036', 1038' may correspond to any of terminals 1032, 1034, 1036, 1038; 1132, 1134, 1136, 1138; 1232, 1234, 1236, 1238; 1332, 1334, 1336, 1338; and 1532, 1534, 1536, 1538 of FIGS. 14–17 and 22, respectively (FIG. 22 is discussed below).

Referring now to FIG. 20, there is shown a capacitor doubler circuit suitable for use as a rectifier with the present invention. Rectifier 1030" includes first and second AC input voltage terminals 1032", 1034" respectively and first and second output terminals 1036", 1038" respectively. Rectifier 1030" includes first diode 1408 electrically connected between first output terminal 1036" and first AC input voltage terminal 1032" for conduction from first output terminal 1036" to first AC input voltage terminal 1032". Rectifier 1030" also includes a second diode 1410 electrically connected between second output terminal 1038" and first AC input voltage terminal 1032" for conduction from first AC input voltage terminal 1032" to second output terminal 1038". Rectifier 1030" further includes a first polarized capacitor 1412 having its positive terminal electrically interconnected with second AC input voltage terminal 1034", and having its negative terminal electrically interconnected with first output terminal 1036". Finally, rectifier 1030" also includes a second polarized capacitor 1414 having its positive terminal electrically interconnected with second output terminal 1038" and its negative terminal electrically interconnected with second AC input voltage terminal 1034". Again, it is to be understood that terminals 1032", 1034", 1036" and 1038" may correspond to any of the related source terminals depicted in FIGS. 14–17 above and FIG. 22 below.

Referring now to FIG. 21, yet another rectifier configuration suitable for use with the present invention is shown. The configuration of FIG. 21 is a capacitor tripler. Rectifier 1030'" of FIG. 21 includes a first diode 1416 electrically connected between second output terminal 1038'" and first AC input voltage terminal 1032'" for conduction from second output terminal 1038''' to first AC input voltage terminal 1032'''. Also included in rectifier 1030''' is a second diode 1418 electrically connected between second AC input voltage terminal 1034''' and a first intermediate node 1428 for conduction between second AC input voltage terminal 1034''' and first intermediate node 1428. A third diode 1420 is electrically interconnected between first intermediate node 1428 and first output terminal 1036''' for conduction from first intermediate node 1428 to first output terminal 1036'''.

A first polarized capacitor 1422 has its positive terminal electrically connected to first intermediate node 1428 and its negative terminal electrically connected to first AC input voltage terminal 1032'''. A second polarized capacitor 1424 has its positive terminal electrically connected to first output terminal 1036''' and its negative terminal electrically connected to second AC input voltage terminal 1034'''. Finally, third polarized capacitor 1426 has its positive terminal electrically connected to second AC input voltage terminal 1034''' and its negative terminal electrically connected to second output terminal 1038'''. Again, it is to be understood that terminals 1032''', 1034''', 1036''' and 1038''' can correspond to any of the appropriate source terminals shown in FIGS. 14–17 and 22.

FIG. 22 shows yet another embodiment of the invention, in which a conductive strip 1576 is mounted on a translucent housing 1504 of a fluorescent lightbulb 1502. Items in FIG. 22 which are similar to those in FIG. 14 have received the same reference character incremented by 500. Construction is quite similar to the embodiment of FIG. 14. For clarity, inductive-resistive structure 1520 is shown with only a single conductive-resistive coating 1526. It will be appreciated that inductive-resistive structure 1520 can be an elongate tape structure having top and bottom conductor strips 1580, 1578. In the embodiment of FIG. 22, third and fourth electrical terminals 1522, 1524 can be formed at the same end of structure 1520 for convenience, and third terminal 1522 can be electrically interconnected with strip 1576 through any convenient means, such as lead 1582. Thus, strip 1576 carries the same current which is passed through structure 1520.

It has been found that locating strip 1576 on bulb 1502 permits bulb 1502 to start at a distance A which is much farther away from structure 1520 than would otherwise be possible (e.g., 12 inches (30.5 cm) instead of 1 inch (2.5 cm); see Example 11 below). It is believed that this is due to electromagnetic (e.g., magnetic and/or electrostatic) field interaction between strip 1576 and bulb 1502, as discussed above with respect to the interaction between inductive structures and bulbs. Due to proximity of strip 1576 to bulb 1502, interaction 1528 between structure 1520 and bulb 1502 apparently becomes less important. Thus, this embodiment of the invention is preferred when inductive structure 1520 cannot be located close to lightbulb 1502. Note that distance Δ between structure 1520 and bulb 1502 is an approximate average value to be measured between structure 1520 and bulb 1502 when structure 1520 is substantially parallel to bulb 1502. Δ is shown in FIG. 22 as being measured from a corner of structure 1520 for convenience only, so that the potential flexibility of structure 1520 could be shown. Note also that, while the embodiment of FIG. 22 is shown with an "instant start" configuration, the principle of applying a conductive strip to a fluorescent lightbulb will also work with preheat embodiments of the invention, such as those shown in FIGS. 4, 5 and 10–13.

Figure 25:
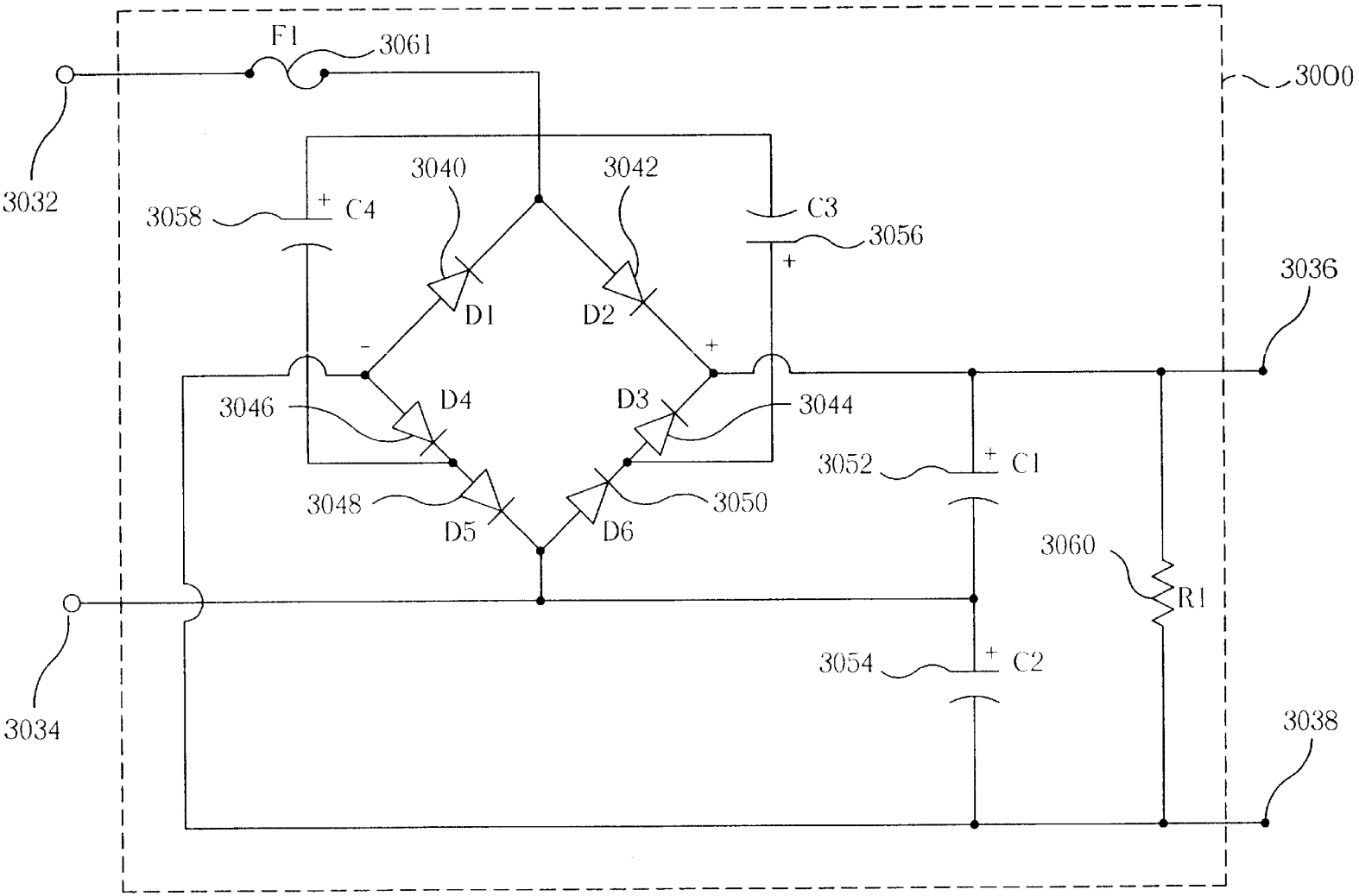
FIG. 25 depicts a source of rippled/pulsed direct current in the form of a tapped bridge voltage multiplier circuit.

Reference should now be had to FIG. 25, which depicts a source of rippled/pulsed DC voltage in the form of a tapped bridge voltage multiplier circuit 3000. Tapped bridge voltage multiplier circuit 3000 can be used in place of rectifier 1030', 1030'', or 1030'''. Tapped bridge voltage multiplier circuit 3000 includes first AC input voltage terminal 3032 (which can be, e.g., the positive terminal), second AC input voltage terminal 3034 (which can be, e.g., the ground terminal), first output terminal 3036 (which can be, e.g., positive), and second output terminal 3038 (which can be, e.g., negative). It should be understood that terminals 3032, 3034, 3036 and 3038 may correspond to any of terminals 1032, 1034, 1036, 1038; 1132, 1134, 1136, 1138; 1232, 1234, 1236, 1238; 1332, 1334, 1336, 1338; and 1532, 1534, 1536, 1538 of FIGS. 14–17 and 22, respectively.

With continued reference to FIG. 25, it will be appreciated that tapped bridge voltage multiplier circuit 3000 includes a first diode 3040 having its anode electrically interconnected with second output terminal 3038 and its cathode electrically interconnected with first AC input voltage terminal 3032. Tapped bridge voltage multiplier circuit 3000 further includes a second diode 3042 having its anode electrically interconnected with first AC input voltage terminal 3032 and its cathode electrically interconnected with first output terminal 3036. A third diode 3044 has its cathode electrically interconnected with first output terminal 3036 and has its anode electrically interconnected with second AC input voltage terminal 3034. A fourth diode 3046 has its anode electrically interconnected with second output terminal 3038 and its cathode electrically interconnected with second AC input voltage terminal 3034.

Still with reference to FIG. 25, tapped bridge voltage multiplier circuit 3000 also includes a first capacitor 3052 electrically interconnected between first output terminal 3036 and second AC input voltage terminal 3034; and a second capacitor 3054 electrically interconnected between second output terminal 3038 and second AC by input voltage terminal 3034. In a preferred form of tapped bridge voltage multiplier circuit 3000, fifth and sixth diodes 3048, 3050 and third and fourth capacitors 3056, 3058 are also included. Fifth diode 3048 has its anode electrically interconnected with the cathode of fourth diode 3046, and has its cathode electrically interconnected with second AC input voltage terminal 3034. Sixth diode 3050 has its anode electrically interconnected with second AC input voltage terminal 3034, and has its cathode electrically interconnected with the anode of third diode 3044. Third capacitor 3056 is electrically interconnected between first AC input voltage terminal 3032 and the anode of third diode 3044, while fourth capacitor 3058 is electrically interconnected between first AC input voltage terminal 3032 and the anode of fifth diode 3048. A bleed resistor 3060 is preferably electrically interconnected between first and second output terminals 3036, 3038 to bleed the charge from the capacitors when the rectifier 3000 is inactive. A suitable fuse such as fuse 3061 should be located at the first AC input voltage terminal for reasons of safety.

Figure 26:
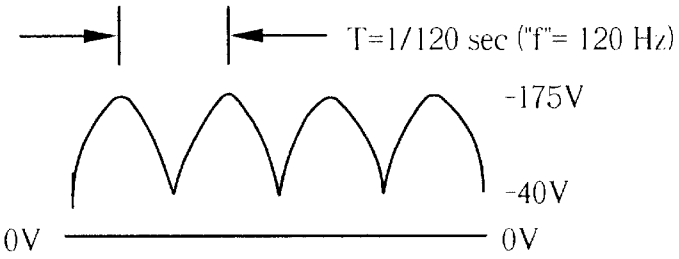
FIG. 26 depicts an output voltage waveform of the circuit of FIG. 25.

A 24 inch (61 cm) T12 fluorescent lamp has been successfully operated using values of first and second capacitors 3052, 3054 of 2.2 μF with third and fourth capacitors 3056,3058 having a value of 1 μF. A 36 inch (91 cm) T12 lamp has been operated with similar capacitors, and has also been successfully operated with first and second capacitors 3052, 3054 having a value of 3.3 μF and third and fourth capacitors 3056, 3058 having a value of 2.2 μF. A 48 inch (120 cm) T12 lamp has been successfully operated using a value of 4.7 μF for first and second capacitors 3052, 3054 and 2.2 μF for third and fourth capacitors 3056, 3058. Finally, a 96 inch (2.4 m)T12 lamp has been operated using the same capacitor values as the 48 inch (120 cm) T12 lamp. In each case, AC input voltage terminals 3032, 3034 were connected to ordinary United States household outlets, specifically, nominal 117 VAC, 60 Hz. Inductive-resistive structures having a nominal DC resistance ranging from 80 to 160 ohms were employed. As shown in FIG. 26, when loaded by the lamp and inductive-resistive structure combinations discussed above, the output measured between terminals 3036, 3038 is a fall wave ripple or pulsed DC exhibiting approximately 175 volt peaks and 40 volt valleys with a "frequency" of 120 Hz, i.e., 1/120 of a second between adjacent peaks.

The capacitors should be large enough to start and operate the associated lamp over a specified ambient temperature and line voltage operating range, yet should be small enough to yield a modest power factor (PF). With a T12 lamp, in a 24 inch (61 cm) lamp, capacitors C1 and C2 can have a value of, for example, 1.0 $\mu$F while capacitors C3 and C4 can have a value of about 0.56 $\mu$F. For a T12 lamp in a 36 inch (0.91 m) length, capacitors C1 and C2 can have a value of about 2.2 $\mu$F, while capacitors C3 and C4 can have a value of about 1.0 $\mu$F. Furthermore, for a T12 lamp in a 48 inch (1.2 m) length, capacitors C1 and C2 can have a value of, for example, 4.7 $\mu$F and capacitors C3 and C4 can have a value of, for example, 2.2 $\mu$F. The preceding values are preferred, and have been developed for non-polarized polyester capacitors. However, they are for exemplary purposes, and any operable capacitor values can be utilized.

The operation of tapped bridge voltage multiplier circuit 3000 will now be discussed. Assuming a sinusoidal input between first and second AC input voltage terminals 3032, 3034, with all nodes initially at ground potential, during the positive portion of a first cycle, i.e., terminal 3032 positive with respect to terminal 3034, current flows from terminal 3032 through capacitor 3058 and forward-conducting diode 3048 to terminal 3034. A parallel path exists through forward-biased diode 3042 and capacitor 3052. Note that any path through resistor 3060 is neglected, since this resistor will normally have a very large value and is effectively an open circuit; it is present primarily to bleed voltage off of the capacitors when the circuit is turned off. If the AC input source impedance is negligible, assuming a sufficiently small time constant, which is reasonable since no resistance (other than parasitic resistance) is present in series with either capacitor 3052 or 3058, at the end of the positive portion of the first cycle, capacitors 3052 and 3058 will each be charged to the peak voltage present during the positive half of the cycle. For example, for a 117 volt AC (rms) supply, the peak voltage would be approximately 165 volts. The polarities on the capacitors are as indicated in the figure.

Considering now the negative portion of the first cycle, i.e., when second AC in input voltage terminal 3034 is positive with respect to first AC input voltage terminal 3032, current flows from second AC input voltage terminal 3034 through forward-conducting diode 3050 and capacitor 3056 to first AC input voltage terminal 3032. A parallel path for current flow exists through capacitor 3054 and forward-conducting diode 3040. At the end of the negative half of the first cycle, again, assuming sufficiently small time constants, capacitors 3054 and 3056 are charged to the peak voltage of the input waveform, again, with the indicated polarities.

Now consider subsequent positive half-cycles, i.e., first AC input voltage terminal 3032 positive with respect to second AC input voltage terminal 3034. Assuming all capacitors remain charged to the peak voltage (i.e., unloaded), diode 3042 will no longer be forward biased, since capacitor 3052 is already charged to the peak voltage. However, since the voltage across capacitor 3056 series-adds to the voltage at terminal 3032, capacitor 3052 now becomes charged to twice the peak voltage through forward-biased diode 3044. Similarly, during subsequent negative half-cycles, i.e., when second AC input voltage terminal 3034 is positive with respect to first AC input voltage terminal 3032, the voltage across capacitor 3058 series-adds to the voltage at terminal 3034, thereby charging capacitor 3054 to twice the peak voltage through forward biased diode 3046. It will be appreciated that, when no load is applied between first and second output terminals 3036, 3038, tapped bridge voltage multiplier circuit 3000 produces an output voltage between terminals 3036, 3038 of approximately four times the peak input voltage, i.e., for a 117 volt AC rms input, an output voltage of approximately 660 volts (DC) is obtained. Capacitors 3056, 3058 are optional, and if they are not used, under no-load conditions, the output voltage will be approximately 330 volts DC. Where capacitors 3056, 3058 are not employed, diodes 3046, 3048 can be replaced by a single diode and diodes 3044, 3050 can also be replaced by a single diode as set forth above.

When a load is applied between terminals 3036, 3038, capacitors 3052, 3054 discharge through the load and supply a continuous direct load current. During each succeeding half of the AC cycle, however, the capacitors are recharged to their peak voltages, as described previously, replenishing the charge lost in the form of load current The actual DC load voltage approaches four times the peak input voltage (assuming capacitors 3056, 3058 are used) for small load current demands, but drops sharply when the load current increases significantly. As the load current increases, the dc load voltage begins to exhibit a more pronounced ripple component which is twice the line frequency.

As discussed above, when the tapped bridge voltage multiplier circuit 3000 is loaded with a fluorescent lightbulb and an inductive-resistive structure in accordance with the present invention, a typical output voltage waveform is experienced as shown in FIG. 26. The lowering in output voltage and the appearance of ripple are characteristic of voltage doubler and related type circuits. Significant discharge of capacitors 3052, 3054 is possible when they are substantially loaded but, of course, only occurs for a given capacitor during the time when it is not being charged. The discharge rate of a given capacitor determines the location of the minima or valleys in the waveform shown in FIG. 26 (for example, 40 volts).

Figure 29:
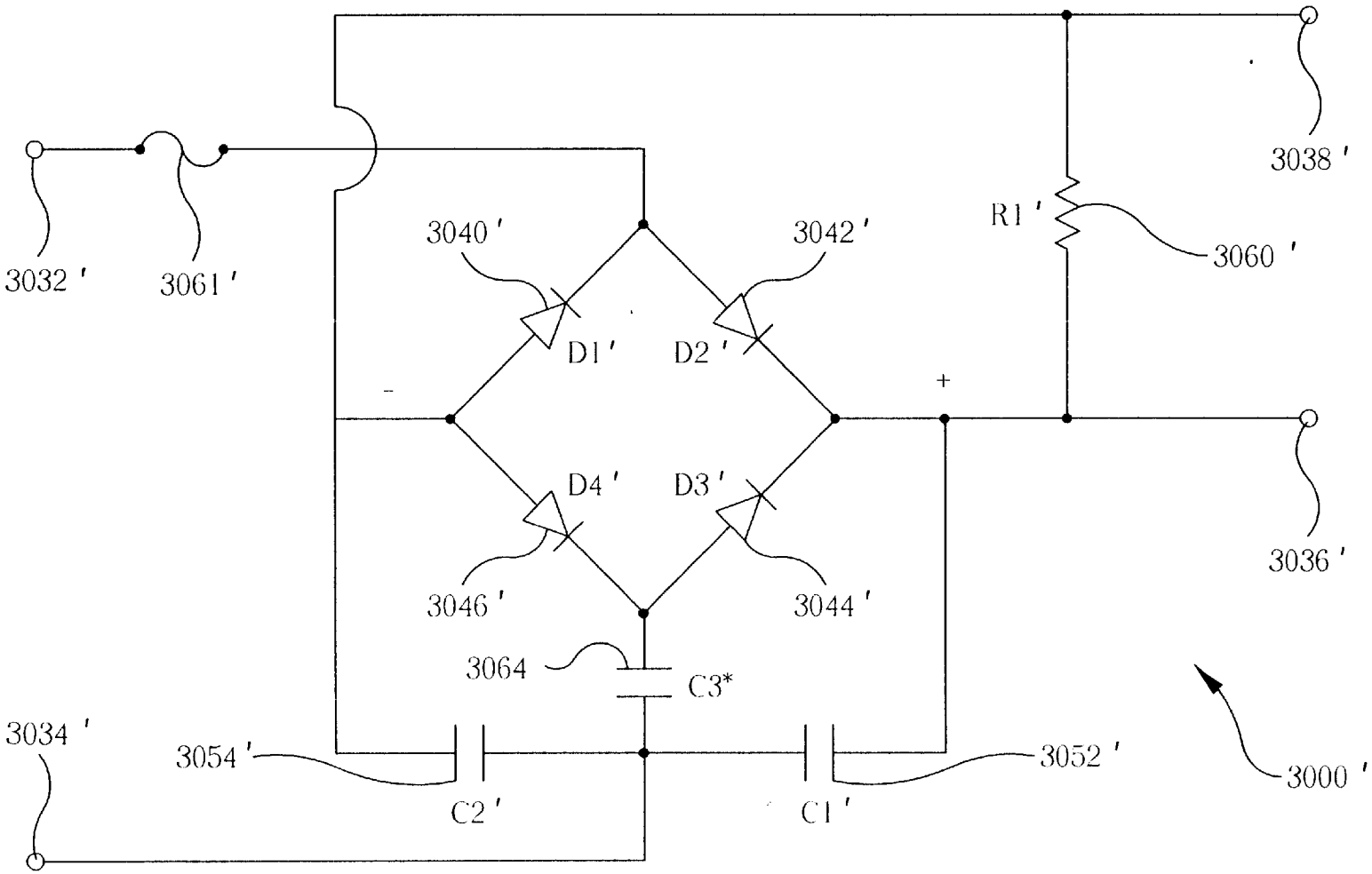
FIG. 29 depicts a circuit similar to that depicted in FIG. 25 especially adapted for use in the U.S., Europe and other countries where higher line voltages (e.g., 220 VAC to 277 VAC) are used.

Reference should now be had to FIG. 29, which depicts an adaptation of the embodiment of FIG. 25 which has been adapted to function with higher line voltages common in some U.S. industrial installations, for example, 277 VAC (RMS) @ 60 Hz and in some foreign countries, for example, 240 VAC @ 50 Hz. Items in FIG. 29 which are similar to those in FIG. 25 have received the same reference character with a "prime". Alternative tapped bridge voltage multiplier circuit 3000' can be used in the same manner as tapped bridge voltage multiplier circuit 3000 to discussed above, and, as noted, is particularly adapted for high voltage applications. First, second, third and fourth diodes 3040', 3042', 3044', 3046' and first and second capacitors 3052', 3054' function as discussed above for the previous embodiment. A suitable fuse 3061' and bleed resistor 3060' can also be included for purposes as discussed above. Circuit 3000' includes a third capacitor, designated C3* (in order to avoid confusion with capacitor C3 in FIG. 25), designated as reference character 3064, which is electrically interconnected between second AC input voltage terminal 3034' and the node formed by the cathode of fourth diode 3046' together with the anode of third capacitor 3044'. Third capacitor 3064 functions to control the operating voltage across a fluorescent lamp used in conjunction with circuit 3000'.

The configuration of FIG. 29 has been tested with German-specification fluorescent lights designed to operate from line voltages of 240 VAC @ 50 Hz. A nominal 650 V starting voltage has been achieved, with steady state voltage across terminals 3036', 3038' of between 100 and 117 volts, depending on the values of the capacitors and the nominal dc resistance of the inductive-resistive structure employed. For example, a 24 inch (61 cm) T8 bulb (German application) was operated from 240 VAC @ 50 Hz using a 120 Ω inductive-resistive structure located physically parallel to the bulb. Capacitors C1 and C2 were rated at 250 volts and had a value of 1 μF. Capacitor C3 had a value of 4.8 μF. The light started instantly at a bulb-applied voltage of 650 volts and remained on at 97 volts, producing a 31 footcandle (330 lux) illuminance. Again, all values are exemplary.

Figure 27:
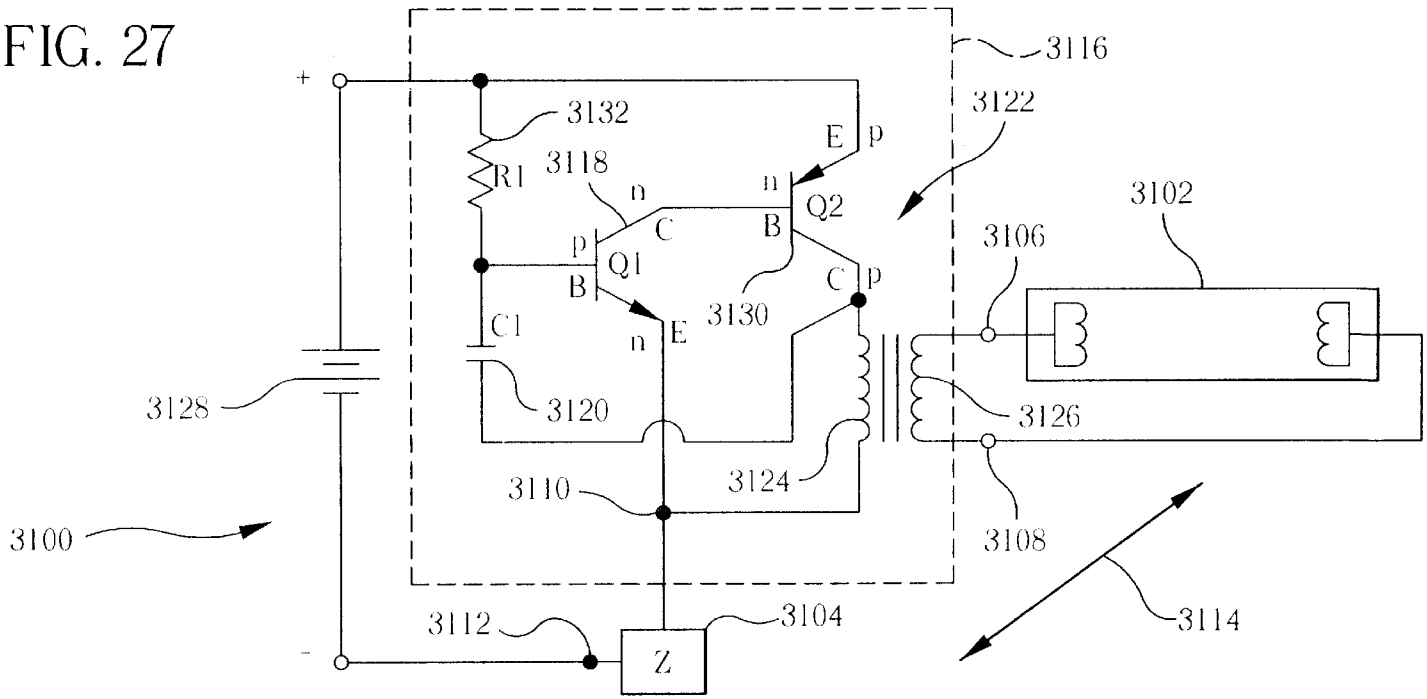
FIG. 27 depicts an embodiment of the present invention suitable for use with DC battery power.
Figure 28:
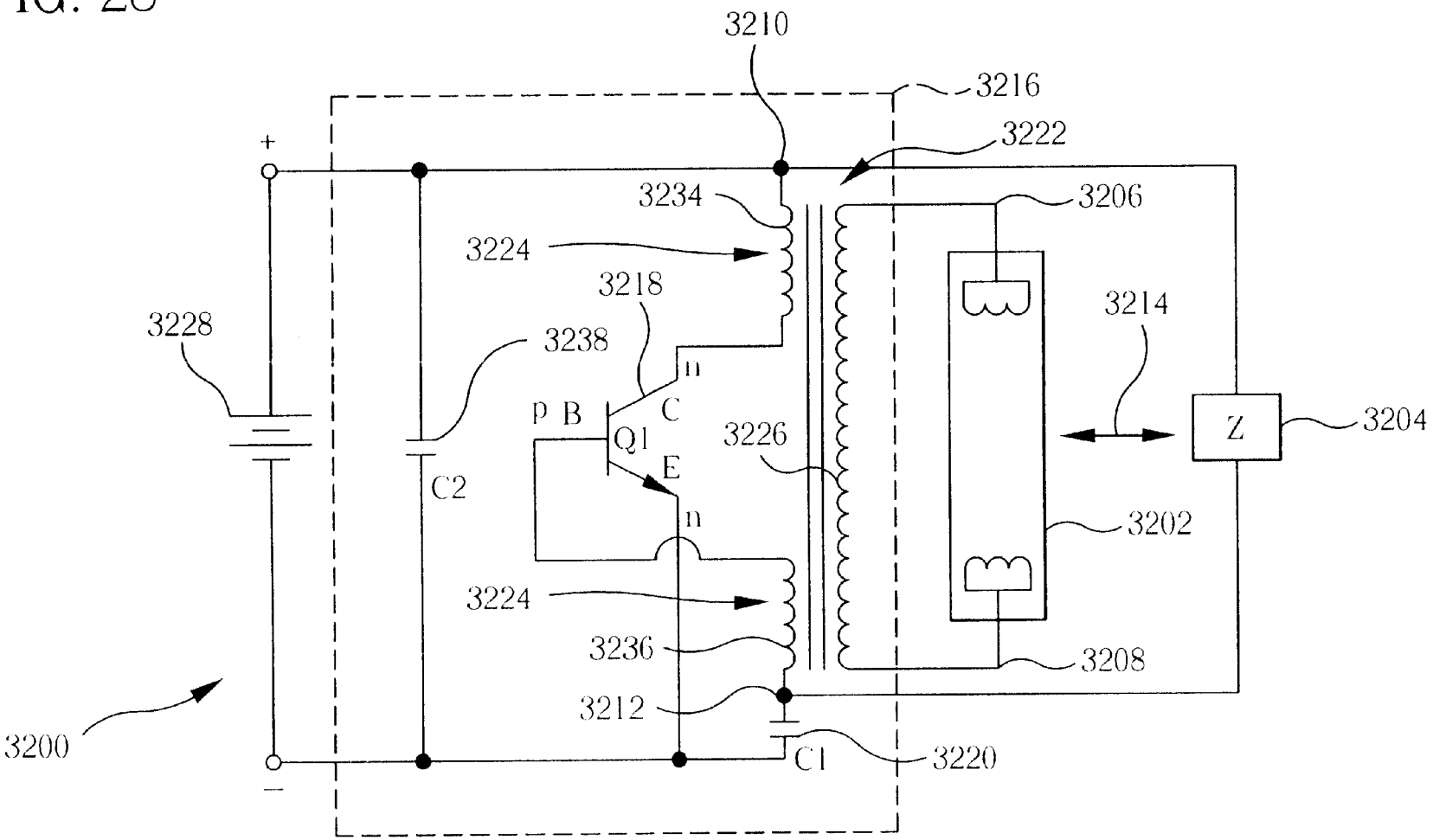
FIG. 28 depicts another embodiment of the present invention suitable for use with DC battery power.

Reference should now be had to FIGS. 27 and 28, which illustrate exemplary embodiments of another form of the present invention. This form of the present invention can be used with any source of substantially steady DC voltage, and is particularly adapted for use with storage batteries. Similar items in FIGS. 27 and 28 have been given the same reference character, incremented by 100. Referring first to FIG. 27, a fluorescent illuminating apparatus 3100 includes a fluorescent lightbulb 3102 of the type described above. Lightbulb 3102 can be an instant start type, or can be a preheat type with only a single connection made to each electrode. Apparatus 3100 also includes an inductive-resistive structure 3104 of the type described above. Bulb 3102 has first and second electrical terminals 3106, 3108, while inductive-resistive structure 3104 has third and fourth electrical terminals 3110 and 3112. Electromagnetic interaction between lightbulb 3102 and inductive-resistive structure 3104 is symbolized by double headed arrow 3114. Apparatus 3100 also includes a source of rippled/pulsed DC voltage 3116. Source 3116 includes first transistor 3118 and first capacitor 3120. Source 3116 further includes a step up transformer 3122 having a primary winding 3124 and a secondary winding 3126 which is electrically interconnected with first and second electrical terminals 3106, 3108 of fluorescent lightbulb 3102. Primary winding 3124 is electrically interconnected with first transistor 3118, first capacitor 3120 and inductive-resistive structure 3104 to form an oscillator.

Primary winding 3124, first transistor 3118, first capacitor 3120 and inductive resistive structure 3104 are electrically interconnected such that when a source of substantially steady DC voltage such as storage battery 3128 is electrically interconnected with the components forming the oscillator, first capacitor 3120 charges during a first repeating time period when first transistor 3118 is off, and first capacitor 3120 discharges during a second repeating time period when first transistor 3118 is active. Thus, the oscillator formed by the aforementioned components produces a time-varying voltage waveform across primary winding 3124 in accordance with the charging and discharging of first capacitor 3120 during the first and second repeating time periods. Thus, a stepped-up rippled/pulsed DC voltage is produced across secondary winding 3126 and can be used to be operate lightbulb 3102. Any suitable source of substantially steady direct current can be electrically interconnected with the oscillator formed by the above-mentioned components, however, it is envisioned that the embodiments shown in FIGS. 27 and 28 will find their primary utility in operating fluorescent lightbulbs off of direct current from storage batteries.

It will be appreciated that the foregoing discussion is equally applicable to FIG. 28, with the indicated components being numbered similarly and being incremented by 100 as previously noted.

Specific reference should now be had to FIG. 27, which depicts a first preferred form of the present invention employing an oscillator. As shown in FIG. 27, first transistor 3118 is an npn bipolar junction transistor (BJT) having a base, an emitter and a collector. The emitter of first transistor 3118 is electrically interconnected with third electrical terminal 3110 and first electrical connection of primary winding 3124. First capacitor 3120 is electrically interconnected between the base of first transistor 3118 and a second electrical connection of primary winding 3124. Apparatus 3100 also includes a second transistor 3130 (as part of source 3116) which is a pnp BJT having a base, an emitter and a collector. The base of second transistor 3130 is electrically interconnected with the collector of first transistor 3118, and the collector of second transistor 3130 is electrically interconnected with the second electrical connection of primary winding 3124. A resistor 3132 is electrically interconnected between the emitter of second transistor 3130 and the base of first transistor 3118. In the preferred form shown in FIG. 27, the source of substantially steady direct current (DC voltage), such as the storage battery 3128 can be electrically interconnected between the emitter of second transistor 3130 and the fourth electrical terminal 3112, such that the emitter of second transistor 3130 is at a positive (higher) electrical potential with respect to fourth electrical terminal 3112.

Reference should now be had to FIG. 28 which depicts another preferred form of the source of rippled/pulsed DC voltage 3216 of the present invention. In the configuration shown in FIG. 28, first transistor 3218 is an npn BJT having a base, an emitter and a collector. First capacitor 3220 is electrically interconnected between the emitter of first transistor 3218 and fourth electrical terminal 3212. Primary winding 3224 of step up transformer 3222 is split into a first portion 3234 which is electrically interconnected between third electrical terminal 3210 and the collector of first transistor 3218, and a second portion 3236 which is electrically interconnected between the base of first transistor 3218 and fourth electrical terminal 3212. Apparatus 3200 further includes a second capacitor 3238 (as part of source 3216) which is electrically interconnected between third electrical terminal 3210 and the emitter of first transistor 3218. The source of substantially steady DC voltage, such as the storage battery 3228, in the embodiment of FIG. 28, can be electrically interconnected between the emitter of first transistor 3218 and third electrical terminal 3210, such that third electrical terminal 3210 is more positive (higher electrical potential) with respect to the emitter of first transistor 3218.

With reference to FIG. 27, an exemplary embodiment of the invention was constructed for use with fluorescent bulbs 3102, type T5 and T8 in lengths ranging from 8 to 18 inches (20 to 46 cm) utilizing a power source 3128 providing 6 VDC to 12 VDC. Q1 transistor 3118 was a TIP47 npn, while Q2 transistor 3130 was a TIP42 pnp type. Resistor R1 had a value of 50 KΩ, while capacitor C1 had a value of 0.1 μF. Inductive-resistive structure 3104 was selected with a nominal dc resistance of 300–500 Ω. Primary coil 3124 and secondary coil 3126 of transformer 3122 were selected to step up the output at terminals 3106, 3108 to 180 volts at a "frequency" 400 kHz. See discussion of "frequency" for pulsed DC below and elsewhere herein. Typical illuminance for the lamps, with a 12 VDC input, was 5 footcandles (55 lux). Higher values of nominal DC resistance for the inductive-resistive structure 3104 permitted a higher voltage input than 12 VDC without any undesirable overheating of transistors Q1, Q2. The turns ratio of secondary coil 3126 to primary coil 3124 was about 10:1.

With reference to FIG. 28, an operating example employing the configuration depicted therein will now be discussed. Again, T5 and T8 bulbs, having lengths ranging from 8 to 18 inches (20 to 46 cm), with a DC power source 3228 from 12 VDC to 24 VDC, were employed and a TIP32C npn transistor was utilized as Q1 transistor 3218. A value for capacitor C1 of 0.1 $\mu$F was utilized, while a value of 2.2 $\mu$F was utilized for capacitor C2. Inductive-resistive structure 3204 had a nominal DC resistance of 350 Ω. An output voltage of approximately 200 volts pulsed DC at a "frequency" of 400–1000 Hz successfully illuminated the aforementioned bulbs. As discussed elsewhere herein, the "frequency" values for the pulsed DC reflect the adjacent peaks and were measured with a frequency meter. Portions 3234, 3236 of primary winding 3224 has about 16–24 turns each, while secondary winding 3226 had about 133 turns.

In the above-described embodiments, as well as FIGS. 27 and 28, it should be understood that, while BJT transistors are preferred, FET transistors are also considered to be within the scope of the present application and claims. Those of skill in the art will appreciate the appropriate interconnections of gate, drain and source for FET transistors as compared with the appropriate connections for base, emitter and collector for the BJT transistors depicted in FIGS. 27 and 28. Furthermore, the term "active", as used herein, can be construed to include the appropriate triode and saturation regions when applied to FET transistors.

Figure 30:
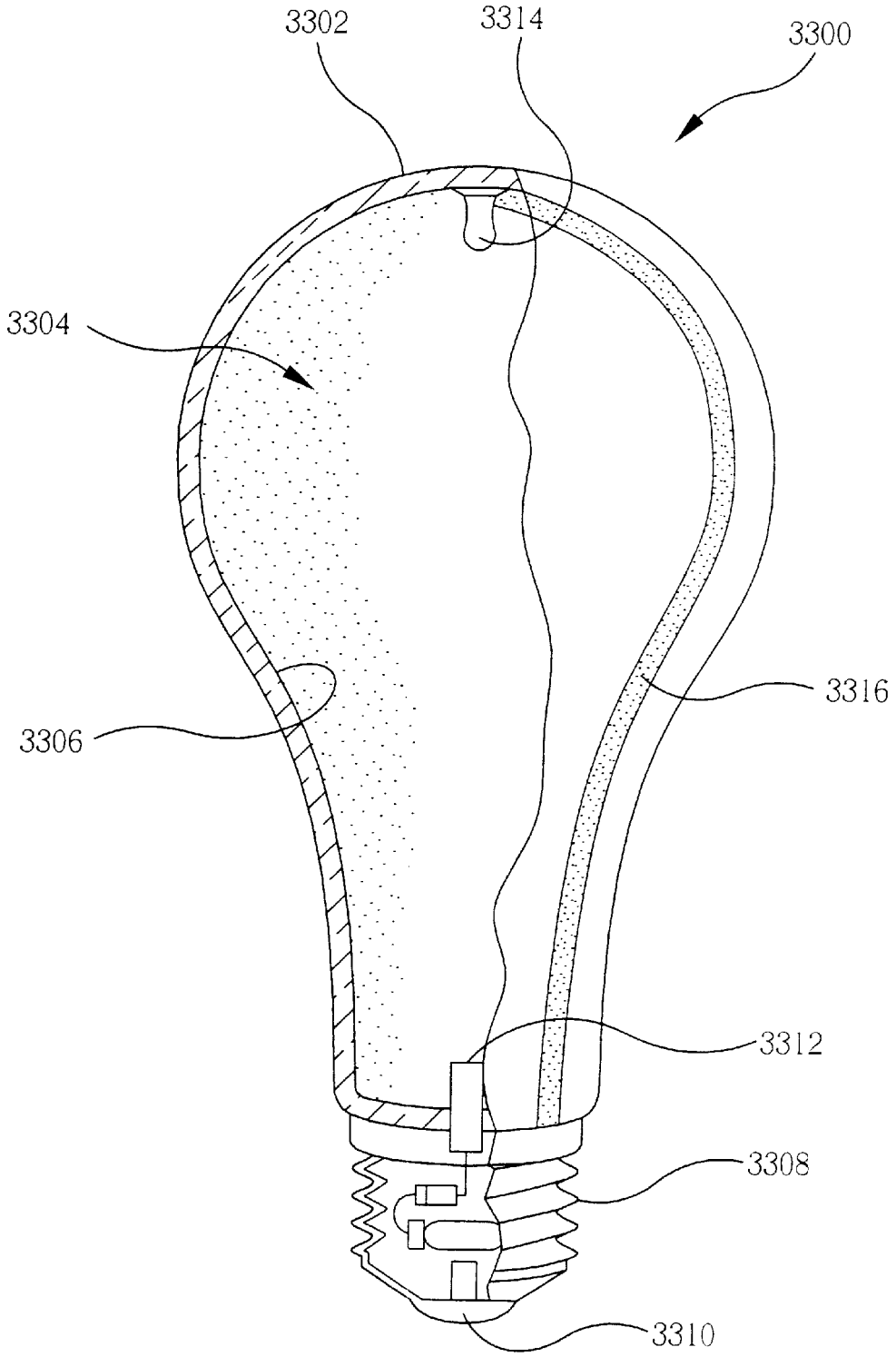
FIG. 30 depicts an incandescent-lightbulb-sized embodiment of the invention.
Figure 31:
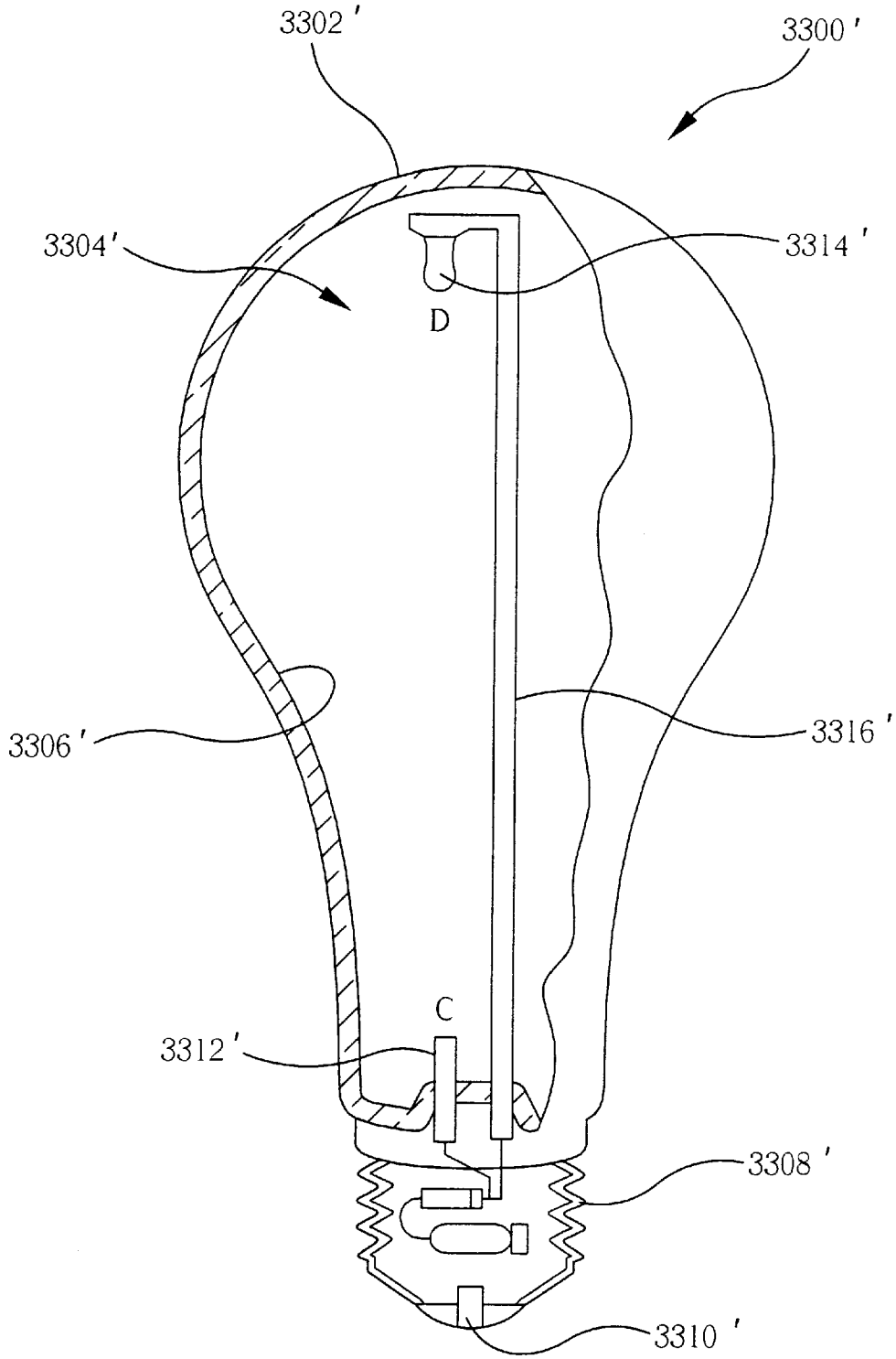
FIG. 31 depicts another incandescent-lightbulb-sized embodiment of the invention.
Figure 32:
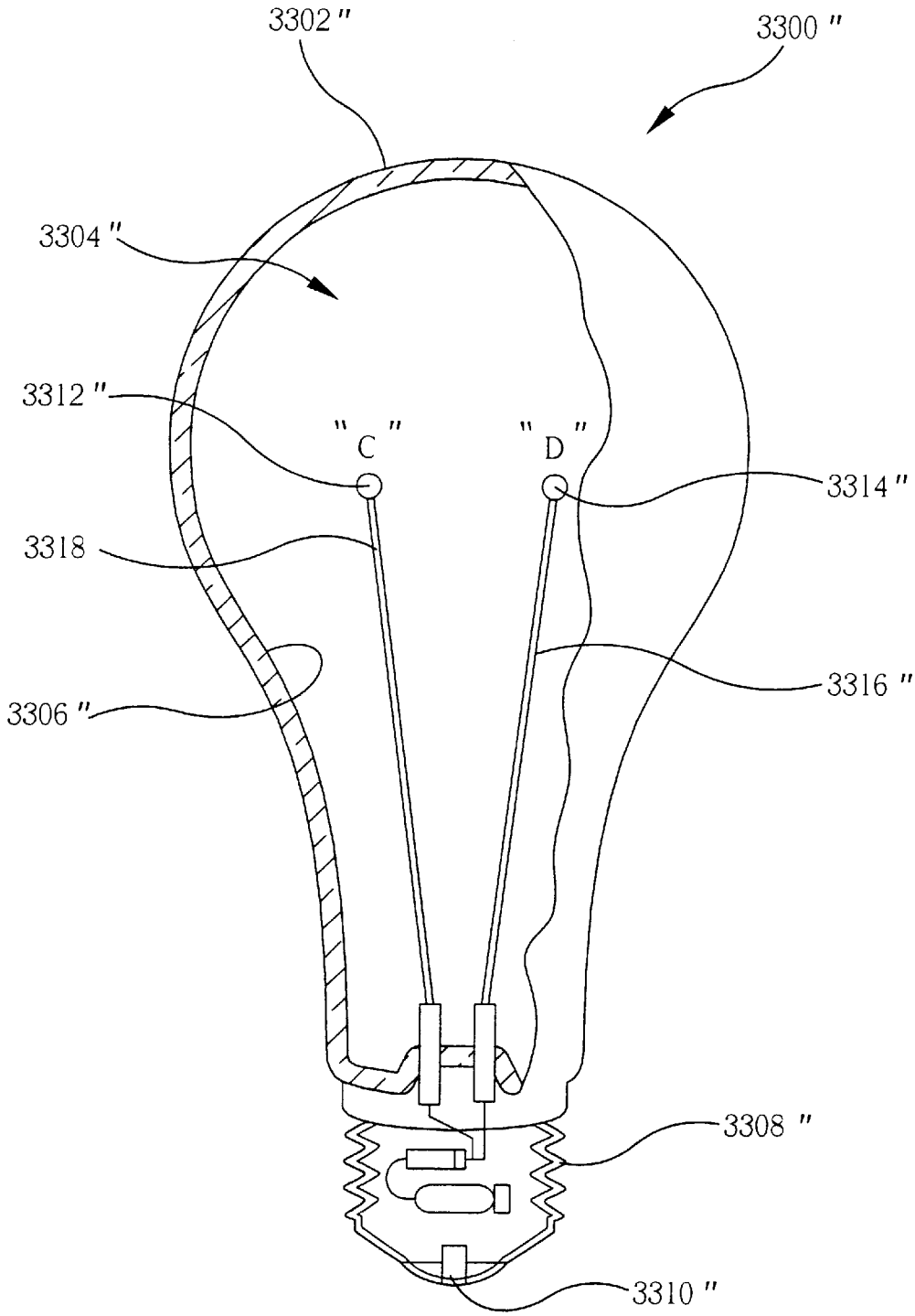
FIG. 32 depicts yet another incandescent-lightbulb-sized embodiment of the invention.

Reference should now be had to FIGS. 30–32 which depict additional embodiments of the present invention. The embodiments of FIGS. 30–32 are specially adapted for use in standard incandescent lightbulb sockets, and can be used as a direct substitution for ordinary incandescent lightbulbs. In FIGS. 30, 31 and 32 similar items have received the same reference character, except that reference characters of similar items are given a single "prime" in FIG. 31 and a double "prime" in FIG. 32.

Still referring to FIGS. 30–32, a fluorescent illuminating apparatus 3300 (understood to also refer to 3300' and 3300") includes a translucent housing 3302 which has a chamber 3304 which supports a fluorescent medium. The fluorescent medium can include, for example, a phosphorous coating 3306 which works in conjunction with a suitable gas, such as mercury, contained within chamber 3304. Fluorescent medium in the form of phosphorous coating 3306 can be supported in chamber 3304 by any coating technique well-known in the art of fluorescent lightbulb manufacture.

Housing 3302 also includes electrical connections, such as contacts 3308, 3310, to provide an electrical potential across chamber 3304. Contacts 3308, 3310 can be, for example, in the form of a screw portion and end portion of an ordinary incandescent lightbulb base. Housing 3302 generally has the size and shape of an ordinary incandescent lightbulb, such as, for example, an ordinary 100 watt incandescent lightbulb with a length of approximately 4.5–5.5 inches (11.4–14 cm) and a diameter of approximately 2.5–3 inches (6.4–7.6 cm). As noted, electrical connections are provided, for example, in the form of contacts 3308, 3310 which effectively form first and second electrical terminals adapted to mount into an ordinary light socket. Apparatus 3300 further includes first and second spaced electrodes 3312, 3314 located within chamber 3304.

Apparatus 3300 also includes a first inductive-resistive structure 3316 located within chamber 3304. Yet further, apparatus 3300 includes a source of rippled/pulsed DC voltage having first and second AC input voltage terminals electrically interconnected with first and second electrical terminals (such as contacts 3308, 3310). The source of rippled/pulsed DC voltage also has first and second output terminals, with the first electrode 3312 being electrically interconnected with the second output terminal and the second electrode 3314 being electrically interconnected with the first output terminal through the first inductive-resistive structure 3316. The source of rippled/pulsed DC voltage is preferably miniaturized in the base of the bulb and can include, but is not limited to, any of the previously-described sources including rectifier 1030' of FIG. 19, rectifier 1030" of FIG. 20 and rectifier 1030'" of FIG. 21, as well as circuits 3000 and 3000' of FIGS. 25 and 29, also as previously discussed. The rectifier circuit 1030" of FIG. 20 is preferred for use with the embodiments of FIGS. 30, 31 and 32.

Suitable values for capacitors 1412, 1414 of rectifier 1030", when used with the embodiments of FIGS. 30,31 and 32 can include 2 $\mu$F capacitors rated at 250 volts. In the embodiment of FIG. 30, first inductive-resistive structure 3316 is in the form of a coating of conductive-resistive paint formed on an inner surface of the housing 3302, between the first output terminal and second electrode 3314. The coating which forms first inductive-resistive structure 3316 is provided with a width and thickness selected to produce a desired nominal dc resistance value for inductive-resistive structure 3316, with minimal occlusion of light emitted from apparatus 3300. The coating can be any of the previously-described coatings, which include a solid emulsion comprising an electrically conductive discrete phase disbursed within a substantially non-conductive continuous phase. A preferred form of coating is that described in Example 1 herein, but again, it is to be emphasized that any of the compositions described herein can be used. In one exemplary embodiment, the coating which forms inductive-resistive structure 3316 can have a width of approximately 0.125 inches (3.2 m m) and a thickness of about 1/32 inch (0.8 mm). The nominal DC resistance can range from 400–1200 Ω. The nominal DC resistance value is selected to control the current in the lamp for the desired power and resultant light output. Too much power will shorten the life of the lamp, whereas too little will result in low light levels. The inductive structure 3316 could be internally coated on the interior of the translucent housing of the bulb before any conductive leads were inserted and before the end of the bulb was sealed by melting. A miniaturized drive circuit could be incorporated in the metal screw base of the bulb.

When sizing a thickness of coating for use with the embodiment of FIG. 30, the nominal dc resistance in Ω can be determined from the formula $R=\rho L_c(W_c t)$ where:

R = desired dc resistance, Ω
ρ = resistivity of coating material being used, Ω-inches (Ω-m)
$L_c$ = length of coating, inches (m)
t = required thickness of coating, inches (m)
$W_c$ = width of coating, inches (m).

In view of the foregoing, it will be appreciated, for exemplary purposes, that when the capacitor doubler circuit of FIG. 20 is utilized as the source of rippled/pulsed DC voltage with apparatus 3300, contact 3310 can be electrically interconnected with second AC voltage input terminal 1034", while contact 3308 can be electrically interconnected with first AC voltage input terminal 1032". First output terminal 1036" can be electrically interconnected with second electrode 3314 through inductive-resistive structure 3316, while second output terminal 1038" can be electrically interconnected with first electrode 3312.

Referring now to FIG. 31, in an alternative embodiment of fluorescent illuminating apparatus 3300', first inductive-resistive structure 3316' includes a rod-like substrate formed of an electrically insulating material, such as a plastic, fiberglass or ceramic, which is coated with a solid emulsion comprising an electrically conductive discrete phase dispersed within a substantially non-conductive continuous phase, with the emulsion being applied to the rod-like substrate. Again, any of the conductive-resistive coatings or materials described herein can be used, with the specific type of coating set forth in Example 1 being preferred. The rod-like substrate can have a diameter of, for example, 1/16 inch (1.6 mm) and have a nominal DC resistance value of 400–1200 Ω. Connections in FIG. 31 are the same as in FIG. 30, except that structure 3316' is rod-like instead of the coating type 3316 of FIG. 30. Note that when using the rod-like structure depicted in FIG. 31, the required coating thickness to achieve a desired nominal dc resistance can be calculated from the formula $R=\rho L_R/(\pi Dt)$ where:

R = desired DC resistance, Ω
ρ = resistivity of coating material being used, Ω-inches (Ω-m)
$L_R$ = length of rod, inches (m)
D = diameter of rod, inches (m)
t = required thickness of coating, inches (m).

Note that the formula assumes that the thickness t is small compared with the A diameter D.

Where heat build-up is a concern, the substrate for the rod-like structure can be formed of aluminum nitride, which is well-known for its superior heat conducting capabilities among ceramic materials.

Referring now to FIG. 32, another alternative embodiment of fluorescent illuminating apparatus 3300", according to the present invention, is depicted. In apparatus 3300", a second inductive-resistive structure 3318 is included within chamber 3304'. First electrode 3312' is electrically interconnected with the second output terminal of the source of rippled/pulsed direct current through second inductive-resistive structure 3318. Both first and second inductive-resistive structures 3316", 3318 include a rod-like substrate formed of an electrically insulating material, and a solid emulsion applied to the rod-like substrate, the solid emulsion comprising an electrically conductive discrete phase disbursed within a substantially non-conductive continuous phase. Thus, the first and second inductive-resistive structures 3316", 3318 of FIG. 32 are essentially similar to the first inductive-resistive structure 3316' of FIG. 31. Once again, the rod-like structures can have the same diameters and nominal resistance values as set forth above. Typical lengths, in either application, can be about 3 inches (7.6 cm). Alternatively, one of the structures 3316", 3318 can be an insulated conductor (copper, e.g.) rod with, for example, an exposed end; in this latter case, the insulated conductor can be thought of (if convenient) as merely a "structure" and not necessarily an inductive-resistive structure.

As discussed above, individual discrete resistors, or assemblies thereof, are contemplated by both the present and the parent applications. This includes the incandescent-sized embodiments depicted in FIGS. 30–32 herein. For example, in FIG. 31, inductive-resistive structure 3316' could comprise a plurality of discrete resistors connected in series and maintained within an insulated tube. Suitable an starting aids, as disclosed herein and discussed above, could be employed in this case, if desired.

Figure 33:
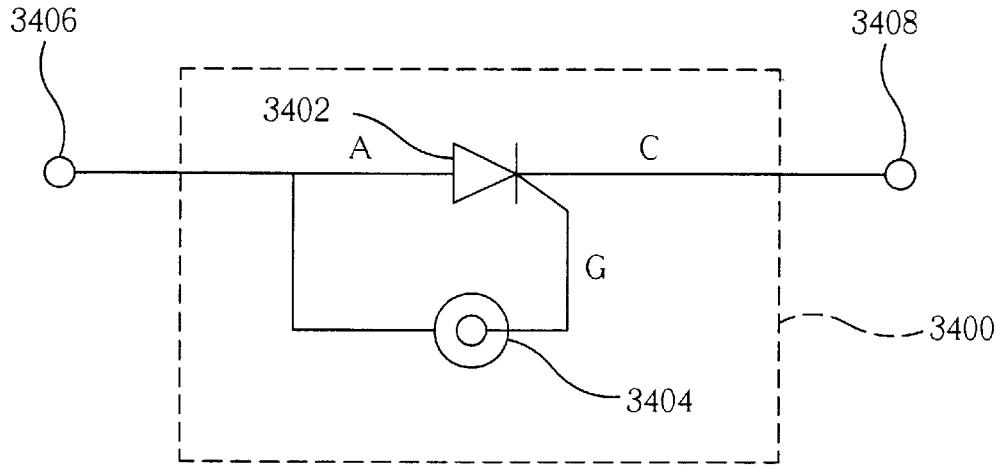
FIG. 33(*a*1) depicts a first form of spike delay trigger suitable for use with the present invention.
Figure 33:
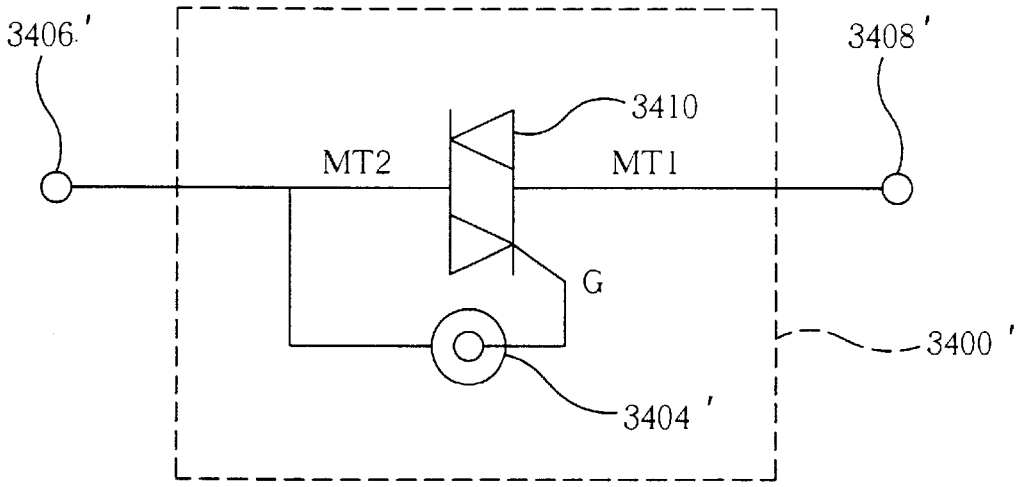
Figure 33B:
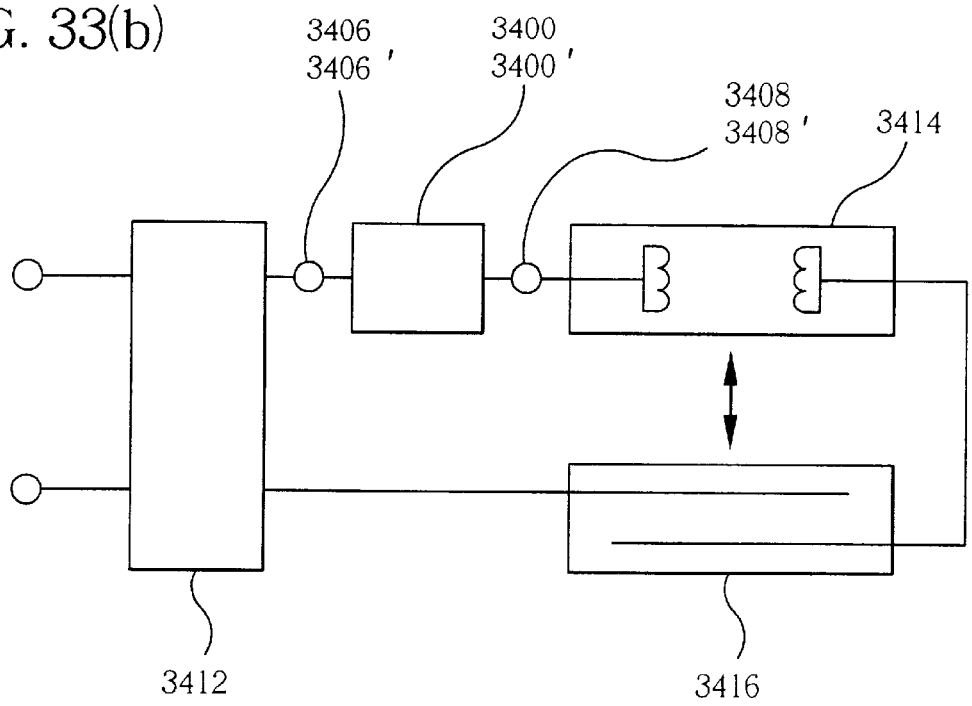

Reference should now be had to FIGS. 33(*a*1), 33(*a*) and 33(*b*), which depict a spike delay trigger 3400, 3400' in accordance with the present invention. Referring first to FIG. 33(*a*1), a first form of spike delay trigger 3400 includes a silicon controlled rectifier (SCR) 3402 having an anode A, cathode C, and gate G, as is well-known in the electronic art. Trigger 3400 further includes a piezoelectric disk 3404 (of the type typically used to produce a sound) electrically interconnected between the gate and anode of the silicon controlled rectifier 3402. In the present application, flexing of disk 3404 produces an arc to energize gate G of SCR 3402. Spike trigger 3400 has first and second electrical terminals 3406, 3408.

Referring now to FIG. 33(*a*2), a second form of spike delay trigger 3400' includes a triac 3410 having a first main terminal MT1, a second main terminal MT2, and a gate G, as is well-known in the art. A detailed discussion of a triac device can be found at pages 405–408 of the book *Solid-State Devices: Analysis and Application* by William D. Cooper, published by Reston Publishing Co., Inc. of Reston, Va. (1974). Spike trigger 3400' further includes a piezoelectric disk 3404' electrically interconnected between the gate and MT2 of the triac 3410. Further, spike trigger 3400' includes first and second terminals 3406', 3408'.

Reference should now be had to FIG. 33(*b*), which shows a typical installation of spike trigger 3400, 3400' with a fluorescent illuminating apparatus of the present invention. Spike trigger 3400, 3400' can have its first electrical terminal 3406, 3406' connected to an output terminal, for example, a nominally negative output terminal, of a source of rippled/pulsed DC voltage 3412. Source 3412 can include any of the configurations discussed herein, including those shown in FIGS. 19–21, 25 and 29. Second output terminal 3408, 3408' can be connected to an electrode of a fluorescent lightbulb 3414 or similar structures as disclosed herein. A suitable inductive-resistive structure 3416 can then be electrically interconnected between a second electrode of lightbulb 3414 and another output terminal, for example, a nominally positive output terminal, of source of rippled/pulsed DC voltage 3412. The interconnection of the silicon controlled rectifier 3402 or triac 3410, as depicted in FIGS. 33(*a*1) and 33(*a*2), creates a spike voltage and permits the drive capacitors of the source of rippled/pulsed DC voltage 3412 to fully charge before current can pass through the fluorescent lamp. This permits easy instant starts at a relatively low voltage and low temperature. The piezoelectric disk does not permit any current to flow until the capacitors are at a peak voltage; it then "clicks" allowing a spike voltage to start the bulb. The spike trigger can be thought of as a delay circuit. It is believed desirable that the delay be a spike or step function, and not a progressive analog delay. Thus, the piezoelectric disk is believed to be an appropriate way of achieving this goal. It has been found that a delay of approximately ½ second is workable, although any suitable delay can be used. Note that, as used herein, "spike delay trigger" includes any appropriate circuitry which advises a suitable hard delay; circuits 3400, 3400' are exemplary.

Figure 36:
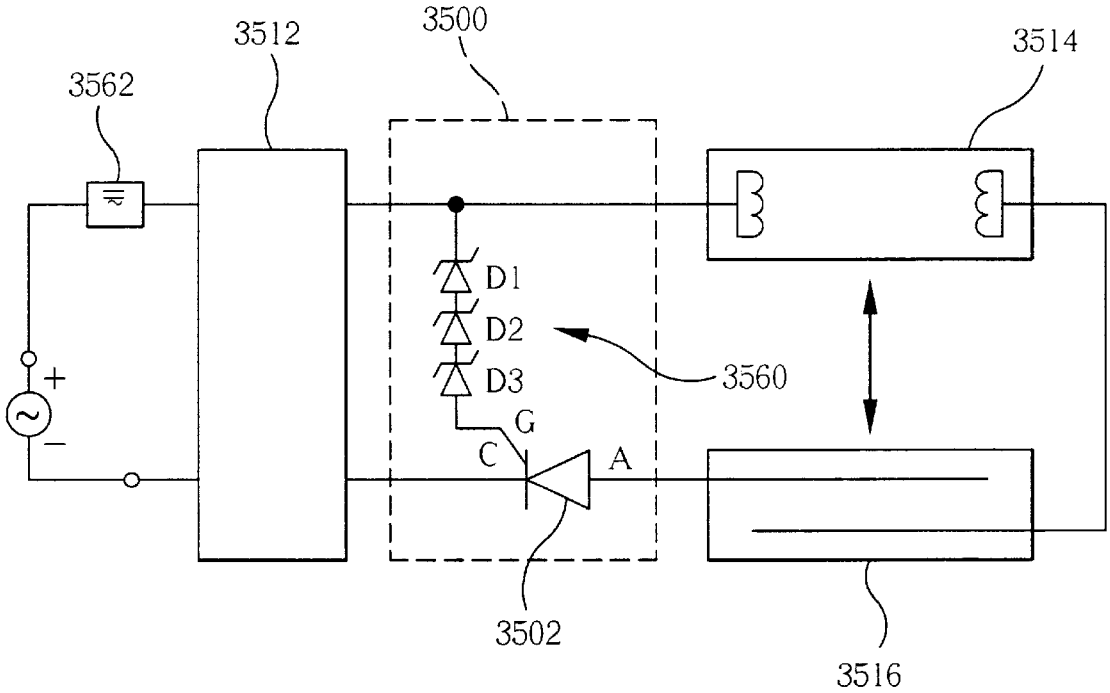
FIG. 36 depicts a voltage sensing trigger of the present invention.

Reference should now be had to FIG. 36, which depicts a voltage sensing trigger which may be used instead of the spike delay triggers 3400, 3400' of the present invention. Comparing FIG. 36 to FIG. 33(*b*), it will be seen that voltage sensing trigger 3500 is interconnected between source of rippled/pulsed DC voltage 3512, fluorescent lightbulb 3514 and inductive-resistive structure 3516. Voltage sensing trigger 3500 includes a silicon controlled rectifier 3502 having an anode, cathode and gate. Trigger 3500 further includes at least one, and preferably a plurality of, Zener diodes, for example, D1, D2 and D3. The silicon controlled rectifier 3502 is electrically interconnected between the inductive-resistive structure 3516 and the source of rippled/pulsed DC voltage 3512, for example, with the anode A of SCR 3502 electrically interconnected with the inductive-resistive structure 3516, and the cathode C of SCR 3502 electrically interconnected with an output terminal, for example, a nominally negative output terminal, of source of rippled/pulsed DC voltage 3512. The at least one Zener diode has its anode electrically interconnected with the gate of SCR 3502, and has its cathode electrically interconnected with an electrical terminal of fluorescent lightbulb 3514 and with an output terminal of source of rippled/pulsed DC voltage 3512, for example, a nominally positive output terminal. It will be appreciated that when more than one Zener diode is employed, the Zener diodes are stacked anode-to-cathode. In a preferred embodiment, three 200 volt Zener diodes are employed. When the terminal voltage at the output of the driver circuit exceeds a predetermined amount, for example, 600 VDC (for the case of three 200 volt Zener diodes), the Zener diodes begin to conduct and trigger the SCR 3502. It is preferred that the SCR 3502 have a sensitive gate, on the order of 1 ma or less. In the indicated configuration, a current limit resistor is not required in series with the Zener diodes 3560, in cases where the driver circuit (i.e., source of rippled/pulsed DC 3512) is not capable of delivering a current high enough to exceed the ratings of the components.

Figure 34:
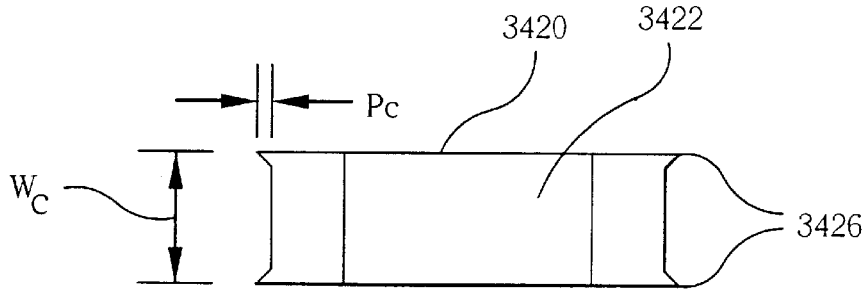
FIG. 34(*a*1) depicts a top plan view of a first type of securing clip suitable for securing inductive-resistive structures of the present invention to a fluorescent lighting apparatus.
Figure 34:
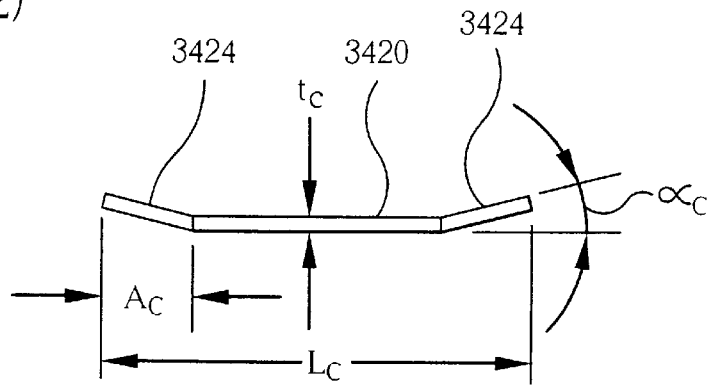
Figure 34B:
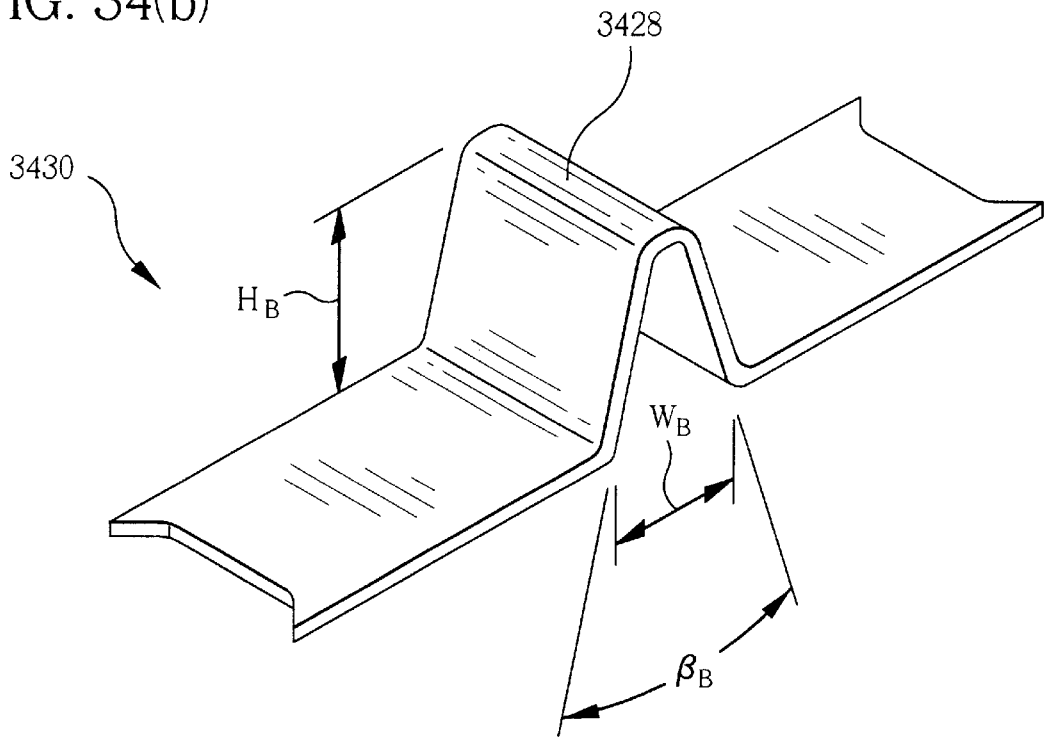
Figure 34C:
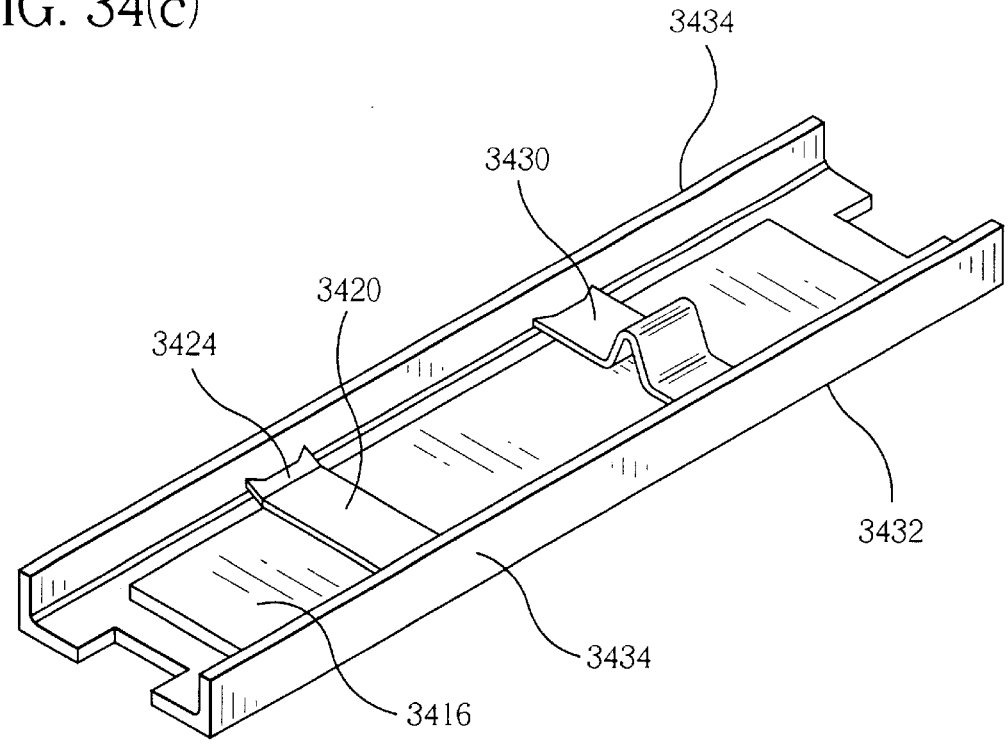

Reference should now be had to FIGS. 34(*a*1), 34(*a*2), 34(*b*) and 34(*c*), which depict securing or retaining clips in accordance with the present invention, which may be used to retain inductive-resistive structures to fluorescent illuminating apparatus housings. FIG. 34(*a*1) shows a first type of retaining clip 3420 which is generally planar and has a thickness $t_c$. Thickness $t_c$ can be, for example, approximately 0.008 inches (0.20 mm) and clip 3420 can be made of, for example, spring steel. As shown in plan view in FIG. 34(*a*1), clip 3420 has a central flat portion 3422. Further, as seen in both FIGS. 34(*a*1) and 34(*a*2), at the opposed ends of clip 3420, there are provided upturned portions 3424. As seen in elevation in FIG. 34(*a*2), these portions can form an angle $\alpha_c$ for example about 10°, with the flat portion 3422. The distance $A_c$ can be about 0.25 inches (6.4 mm), while the overall length $L_c$ should be about 1/16 of an inch (1.6 mm) wider than the fixture with which the clip is to be utilized, as discussed below. Projections 3426 can be provided on the upturned portions 3424, and can protrude, for example, a distance $P_c$ of, for example, about 3/32 of an inch (2.4 mm) beyond the end of the upturned portions. A typical width $W_c$ can be, for example, about 1 inch (about 2.5 cm).

An alternative embodiment of clip is shown in FIG. 34(*b*). It is essentially identical to that depicted in FIGS. 34(*a*1) and 34(*a*2), except that the upturned portions 3424 need not be provided, and instead, a central bulge or bump 3428 is provided. The bulge can have a height $H_b$ of about 0.5 inch (1.3 cm) and a width $W_b$ of about 0.5 inch (1.3 cm), and can be formed at an angle $\beta_B$ of about 200. The width $W_c$ of the clip of FIG. 34(*b*), can be, for example, about 0.75 inches (19 mm). For convenience, the clip of FIG. 34(*b*) is designated generally by reference character 3430. With reference now to FIG. 34(*c*), a typical fluorescent lighting fixture 3432 is generally planar and has opposed upturned walls 3434. The clips are given a length $L_c$ which, as noted, is slightly larger than the distance between the upturned walls 3434. Clips 3420, 3430 are employed to secure an inductive-resistive structure 3416 to the fixture 3432 as shown. Upturned portions 3424 of clip 3420 can be used to deflect and permit compliance of the clip between the opposed walls 3434. Similarly, with clip 3430, central bulge 3428 can be squeezed by the opposed finger and thumb of a human hand, causing it to assume a first overall length which permits easy insertion between the upturned walls, and can then be released so that the points 3426 engage the upturned walls.

It will be appreciated that both of the preceding clip designs are sized and shaped to fit between the generally opposed vertical edge portions or walls 3434, and to retain the inductive-resistive structure thereto via elastic deformation.

Figure 35:
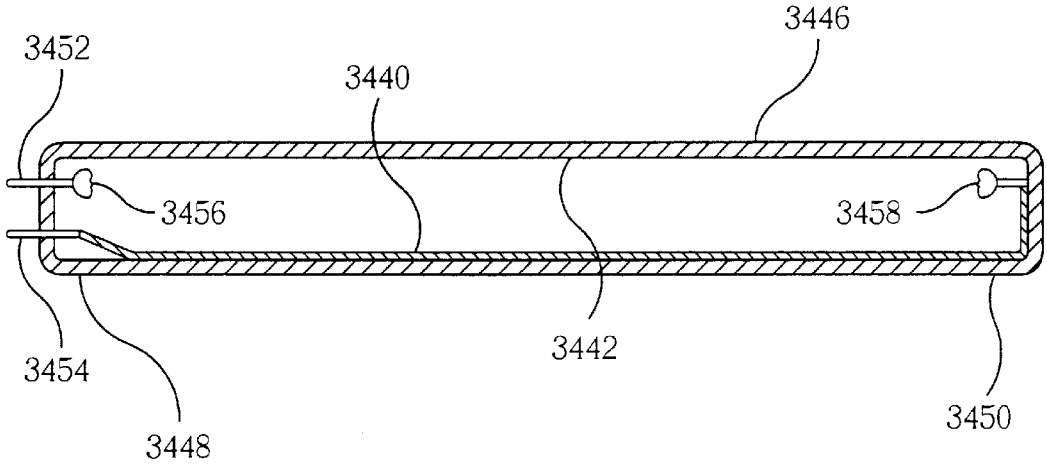
FIG. 35 depicts a form of the present invention utilizing an inductive-resistive structure in the form of a strip located on an inside surface of the translucent housing of a fluorescent lightbulb.

Reference should now be had to FIG. 35 which depicts a manner of locating an inductive-resistive structure in accordance with the present invention. In particular, as shown in FIG. 35, an inductive-resistive structure 3440 is formed as a conductive-resistive medium deposited on an interior surface 3442 of a housing 3446 of a fluorescent lightbulb. As shown in FIG. 35, structure 3440 extends generally from a first end 3448 of housing 3446 to a second end 3450 of housing 3446. First and second electrical terminals 3452, 3454 are provided, as are first and second electrodes 3456, 3458. Second electrode 3458 can be electrically interconnected with second electrical terminal 3454 through inductive-resistive structure 3440. When the configuration of FIG. 35 is utilized with the drive circuits of FIG. 25 or 29, together with any of the instant-start embodiments set forth above, a third electrical terminal of the structure 3440 interfaces electrically with the second electrode 3458, while a fourth electrical terminal associated with the structure 3440 coincides with the second electrical terminal 3454. The type of positioning of inductive-resistive structure 3440 shown in FIG. 35 can generally be used with any of the embodiments of the invention set forth herein.

Figure 37:
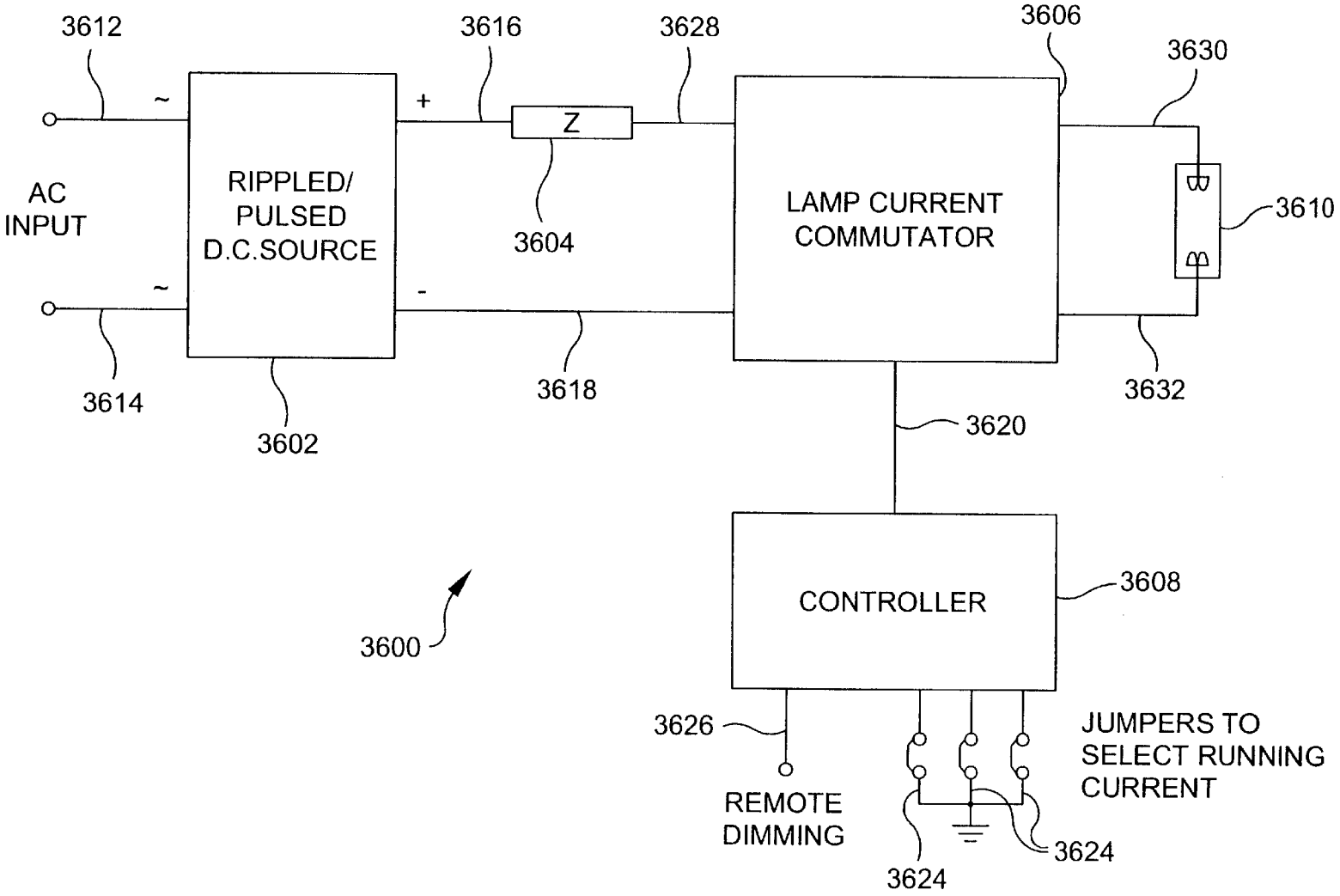
FIG. 37 is a block diagram of an embodiment of the present invention depicting a polarity-reversing fluorescent lamp drive circuit.

In a preferred embodiment of the present invention, illustrated in FIG. 37, a fluorescent lamp drive circuit 3600 includes a polarity-reversing or commutation circuit 3606, preferably implemented as an H-bridge, for presenting a true alternating current (AC) voltage to a fluorescent lamp 3610. The preferred drive circuit 3600 depicted in FIG. 37 is suitable for use with the inductive-resistive structure and fluorescent lamp configurations of the present invention, as described previously above. By periodically reversing the polarity of the voltage across the lamp 3610, mercury migration is essentially eliminated, thereby extending the useful life of the lamp.

With reference now to FIG. 37, a block diagram of a true AC fluorescent lamp drive circuit 3600 is shown. The drive circuit 3600 preferably includes a source of rippled/pulsed DC voltage 3602 having first and second alternating current (AC) input terminals 3612 and 3614, a positive (+) output terminal 3616 and a negative (−) output terminal 3618. Sources of rippled/pulsed DC voltage which are suitable for use with the present invention have been previously described herein and illustrated in FIGS. 19–29. It is to be understood that these configurations are only exemplary, and that any type of device which produces a rippled/pulsed DC voltage, of an appropriate voltage level to sustain fluorescence in the lamp, is suitable for use with the present invention.

The output voltage from rippled/pulsed DC source 3602 is preferably fed to a commutation or polarity-reversing circuit 3606 through a series-connected inductive-resistive structure 3604 (labeled "Z" in FIG. 37). Suitable inductive-resistive structures are described in detail herein above and in the parent applications. Although FIG. 37 illustrates inductive-resistive structure 3604 as being connected in series with the positive output terminal 3616 of rippled/pulsed DC source 3602, it is to be understood that inductive-resistive structure 3604 may alternatively be connected in series with the negative output terminal 3618 as well.

With continued reference to FIG. 37, commutation circuit 3606 preferably includes first and second input terminals 3628 and 3618, first and second output terminals 3630 and 3632 and at least one control input terminal 3620. Preferably, the commutation circuit 3606 produces a true AC voltage for operating the fluorescent lamp 3610 which is electrically connected across output terminals 3630, 3632 of the commutation circuit 3606. Commutation circuit 3606 operates functionally as a double pole double throw (DPDT) switch, similar to the switch shown in FIG. 17 as reference number 1364, which is responsive to a control signal at control input terminal 3620. Depending on the value of the control signal, the voltage at the output of the commutation circuit 3630, 3632 may either essentially have the same polarity as the input voltage, or may be essentially reversed in polarity compared to the input voltage.

For certain applications, it is desirable to have control over the duty cycle of the output voltage appearing at commutation output terminals 3630, 3632. In order to control the duty cycle of the output voltage, and thereby vary the brightness of the lamp, commutation circuit 3606 preferably includes an "off" state, where the current flowing through output terminals 3630, 3632 of commutation circuit 3606, and thus through the lamp 3610, is substantially zero. This is the functional equivalent of replacing the DPDT switch 1364 of FIG. 17 with a double pole double throw, center-off switch (not shown).

With the addition of an "off" state, it is to be appreciated that if commutation circuit 3606 is only responsive to a control signal employing binary logic (i.e., having only two possible values), a minimum of two control inputs will be required for commutation circuit 3606 to decode the three possible output states. Alternatively, a single control input 3620 may be used where the control signal is not confined to a binary value, such as when using a multi-valued logic signal. FIG. 39 depicts typical waveforms of the lamp current for three different duty cycles, namely, ten percent (10)), fifty percent (50%) and ninety percent (90%) duty cycle.

Still referring to FIG. 37, the control signal which governs the state of the commutation or polarity-reversing circuit 3606 is preferably generated by a controller 3608, which is operatively connected to commutation circuit 3606 via control input terminal 3620. The controller 3608 is preferably responsive to user-defined inputs 3624, 3626 for selecting, for example, running current and lamp brightness. Furthermore, it is preferred that controller 3608 include circuitry capable of measuring the current passing through the lamp and being responsive to a difference between the measured lamp current and a reference current value selected by the user, such that the user-defined lamp current is monitored and maintained through the lamp. Such circuitry may preferably be realized as a constant current feedback loop or similar arrangement. Using feedback control of the lamp current, controller 3608 can preferably compensate for aging components or changes in the AC input line voltage, and therefore a much higher degree of line and load regulation is possible.

Figure 38:
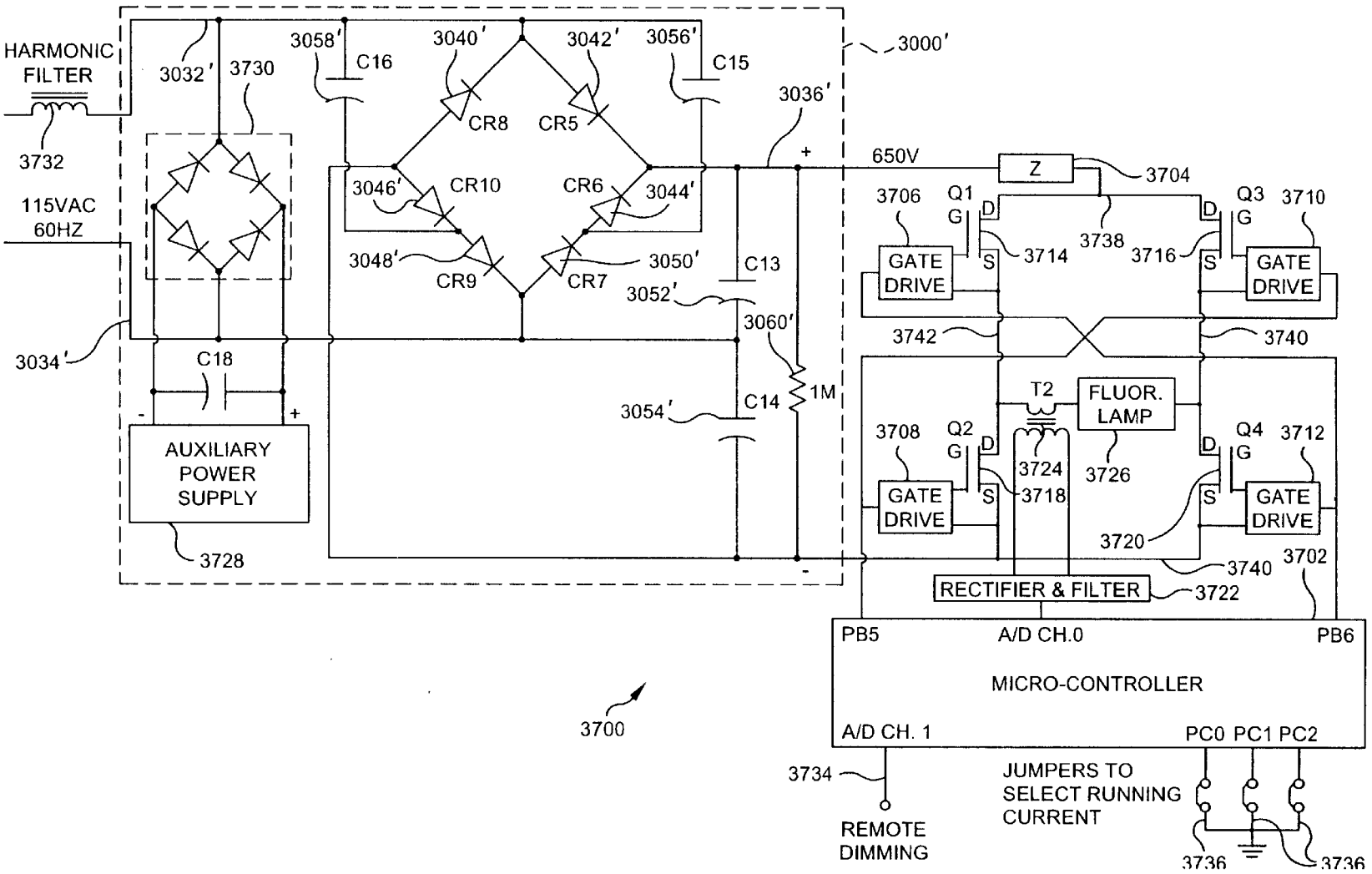
FIG. 38 is a partial electrical schematic diagram of an embodiment of the fluorescent lamp drive circuit of FIG. 37 employing an H-bridge circuit for the polarity-reversing function.
Figure 40A:
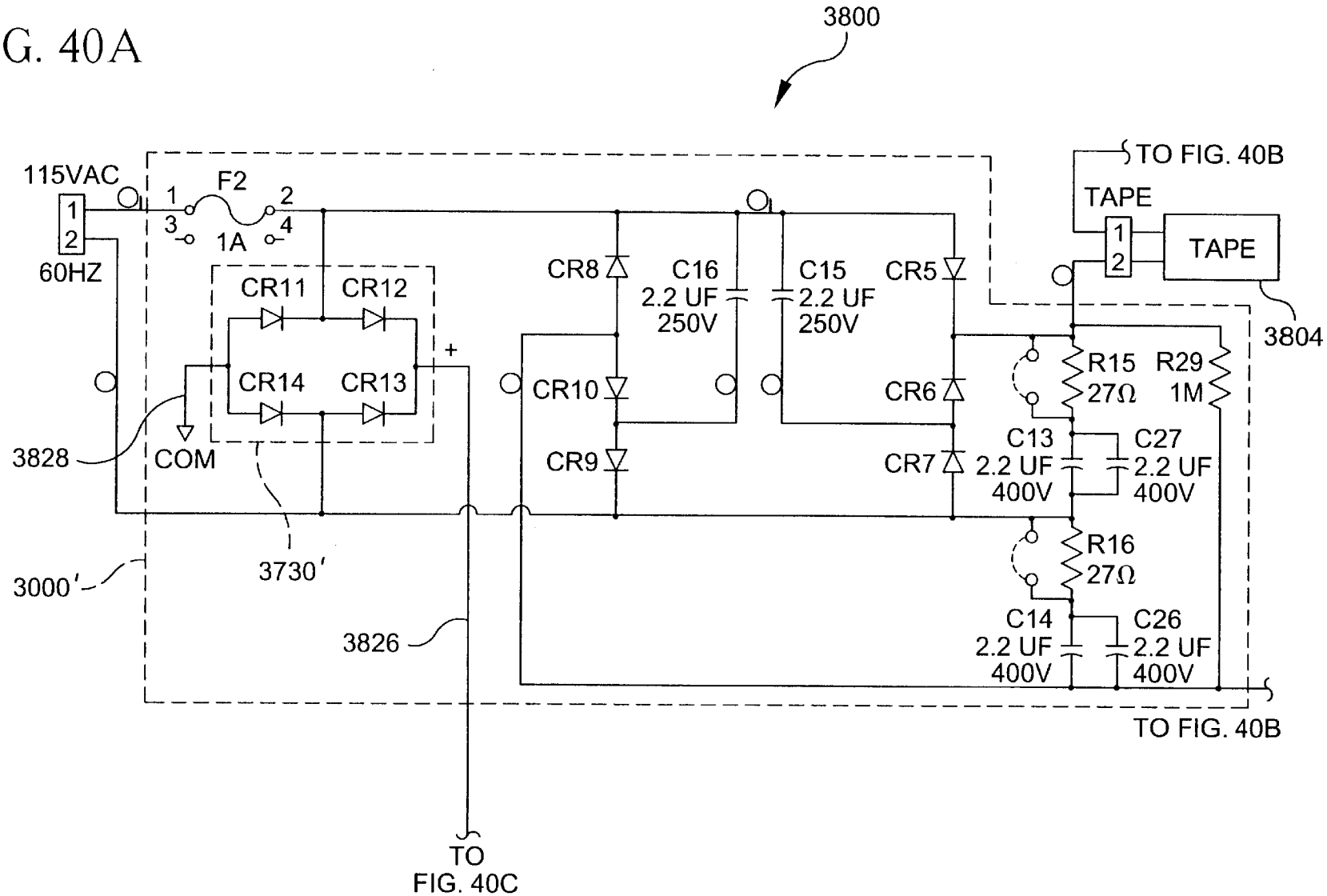
FIGS. 40A, 40B, 40C and 40D are an electrical schematic diagram of an exemplary H-bridge fluorescent lamp drive circuit, formed in accordance with the present invention and depicted by the partial block diagram of FIG. 38.
Figure 40B:
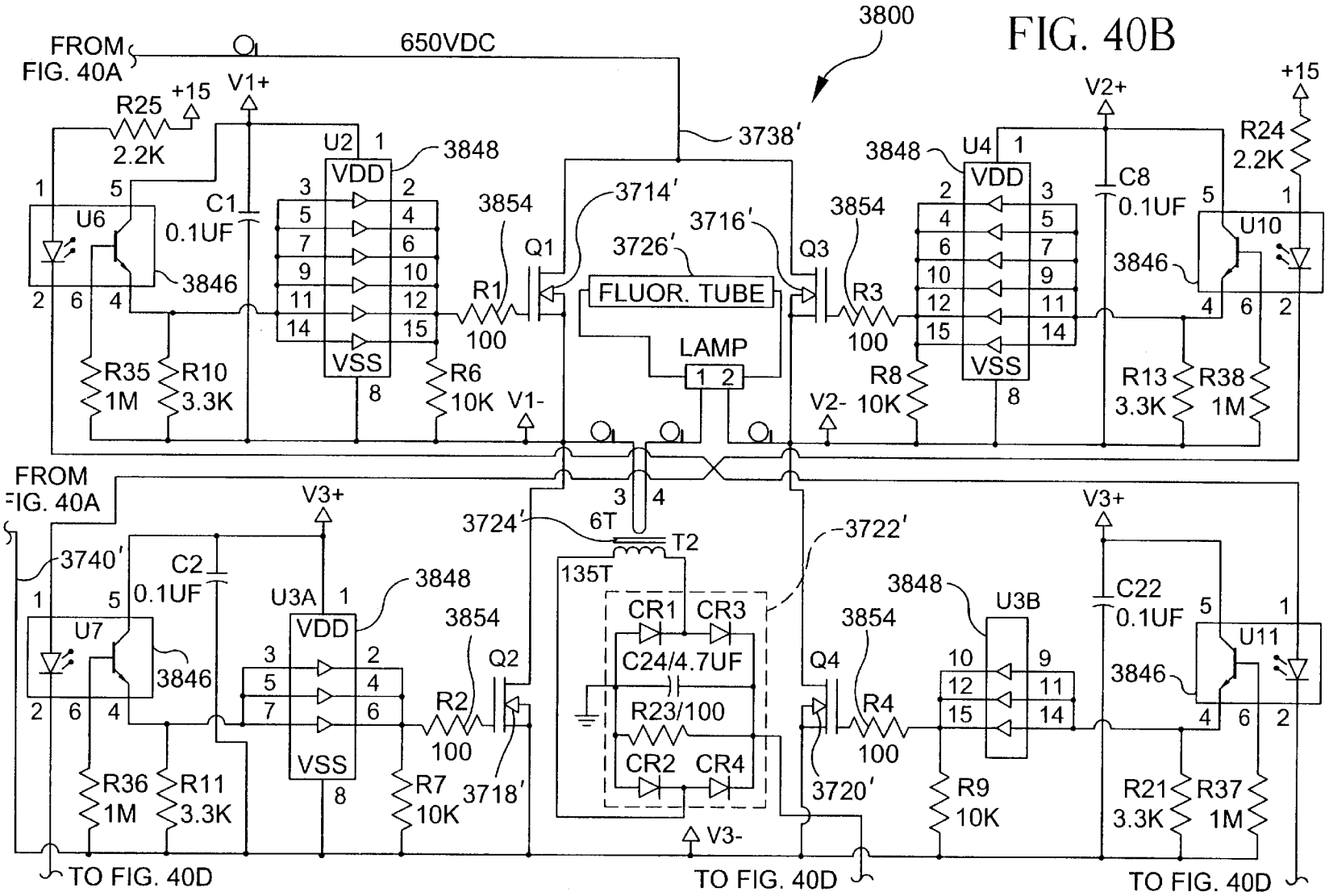
Figure 40C:
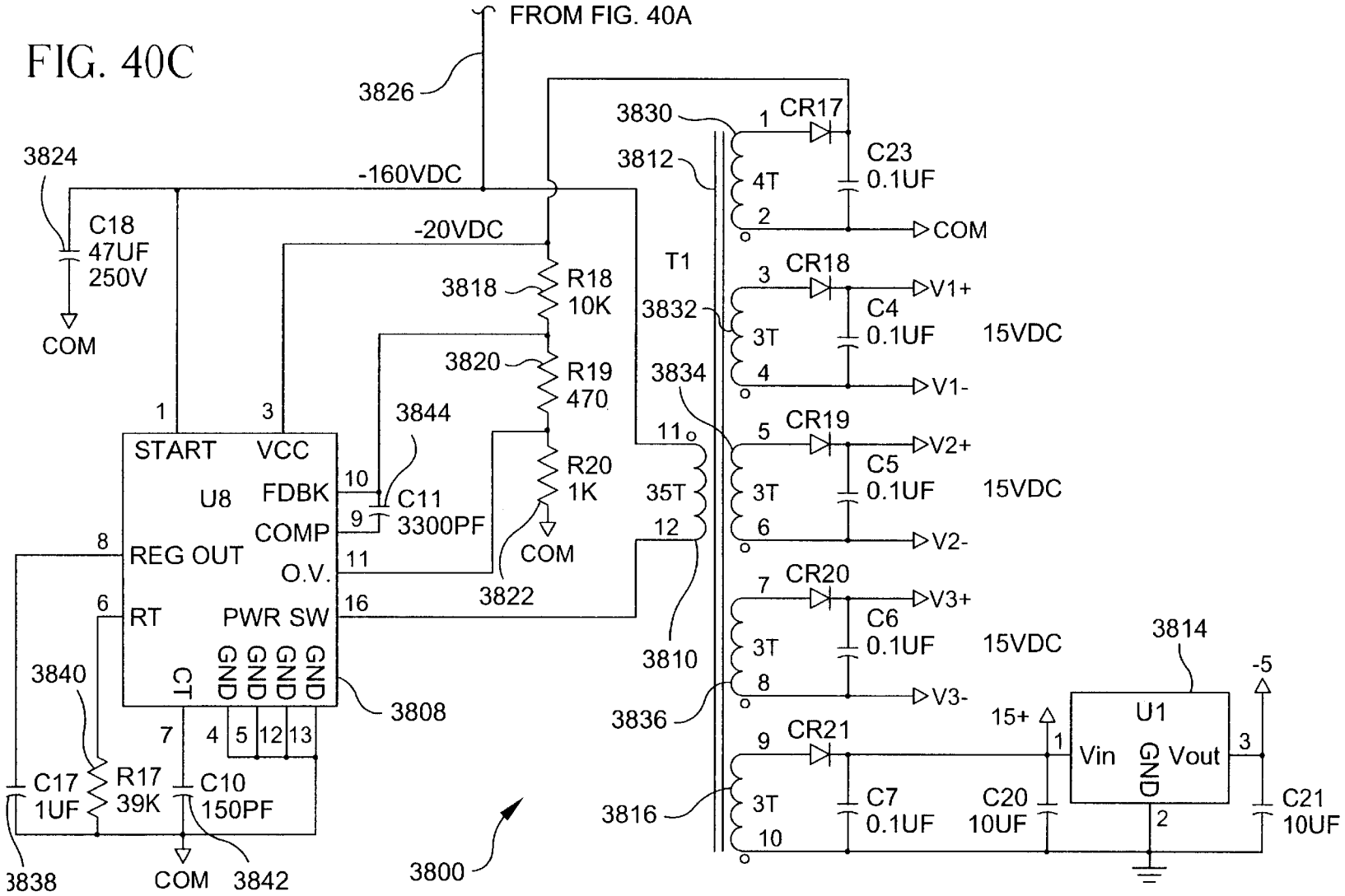
Figure 40D:
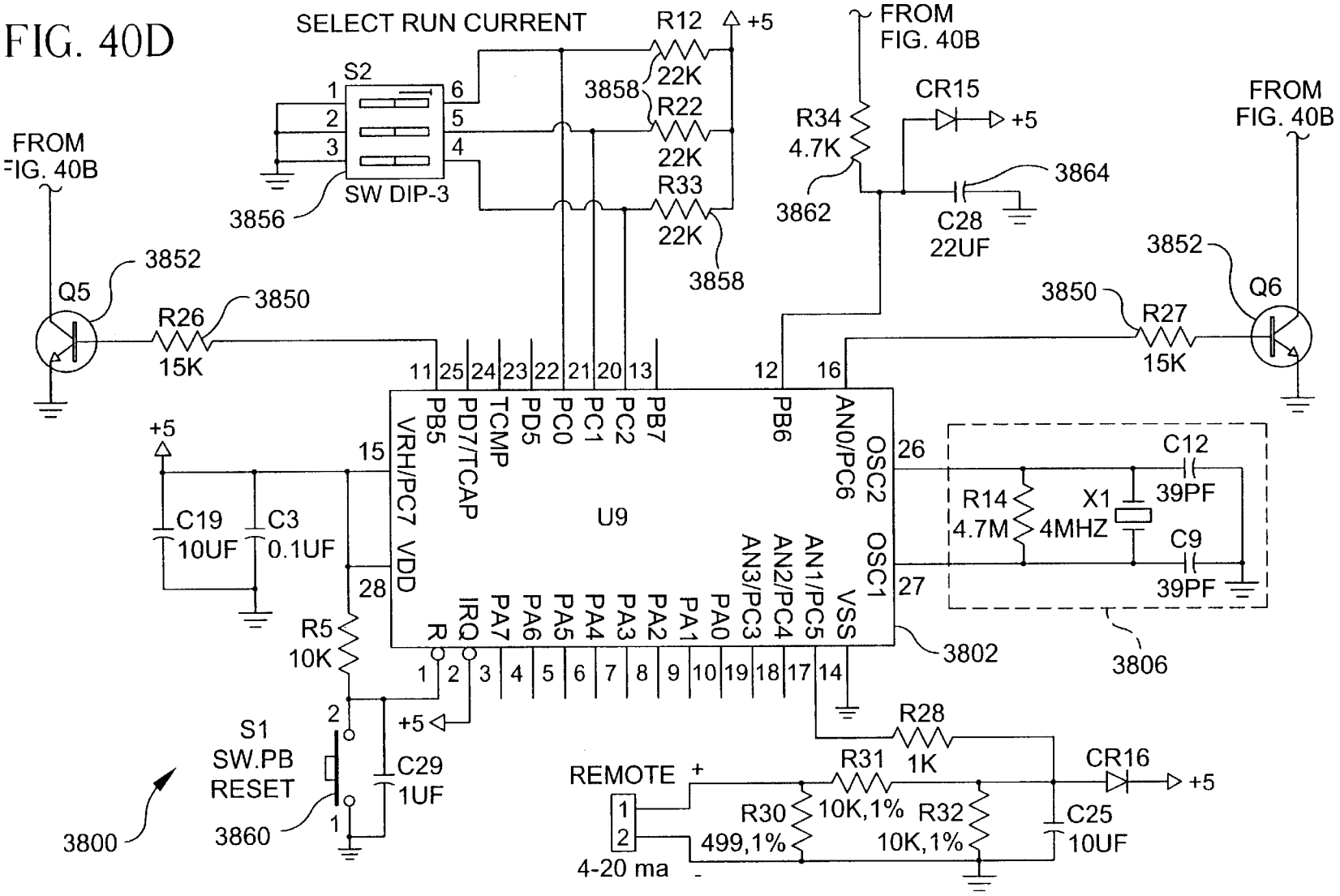
Figure 41A:
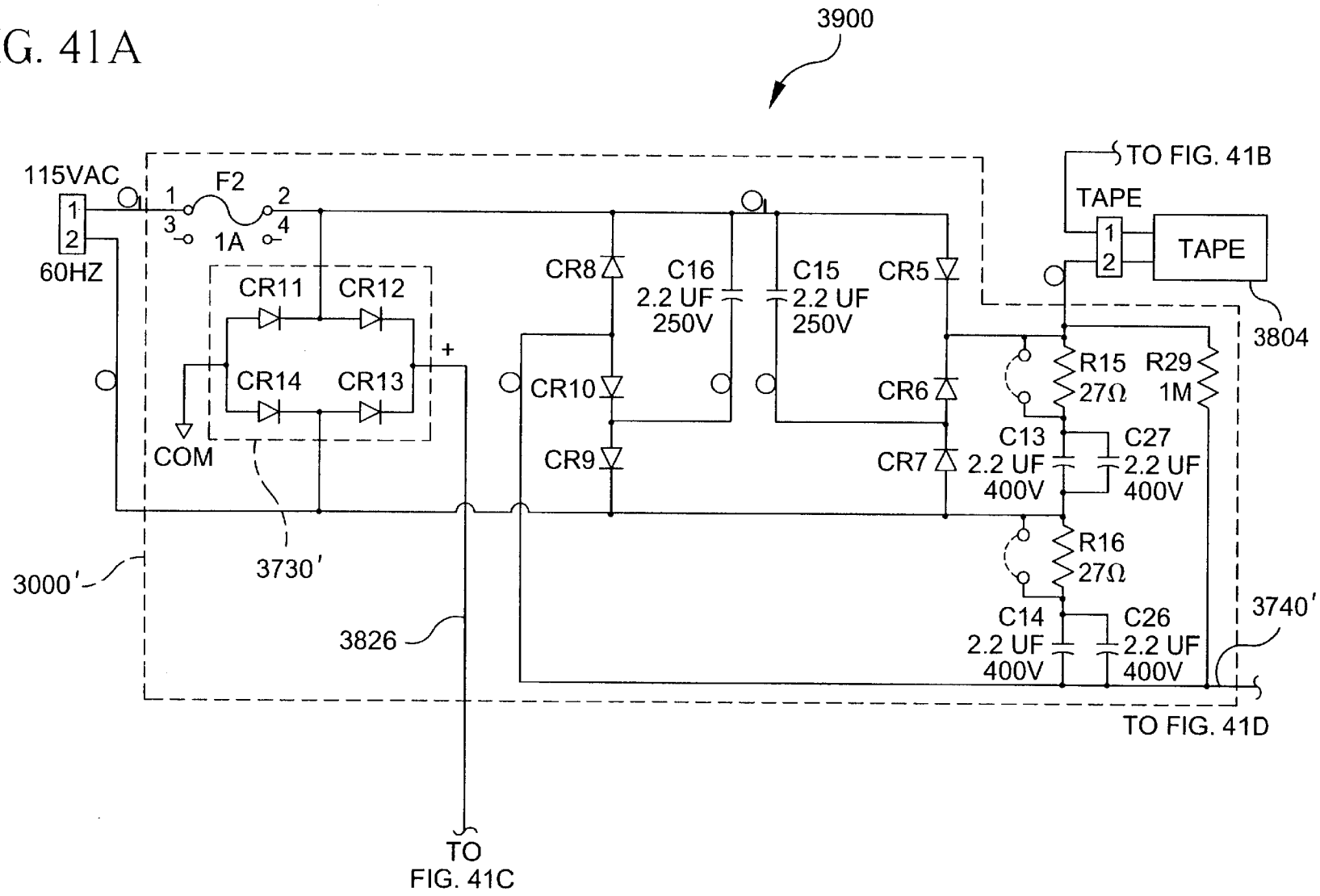
FIGS. 41A, 41B, 41C, 41D and 41E are an electrical schematic diagram of an alternate exemplary H-bridge fluorescent lamp drive circuit, wherein the current sense transformer of FIG. 40 is omitted.
Figures 41A, 41B:
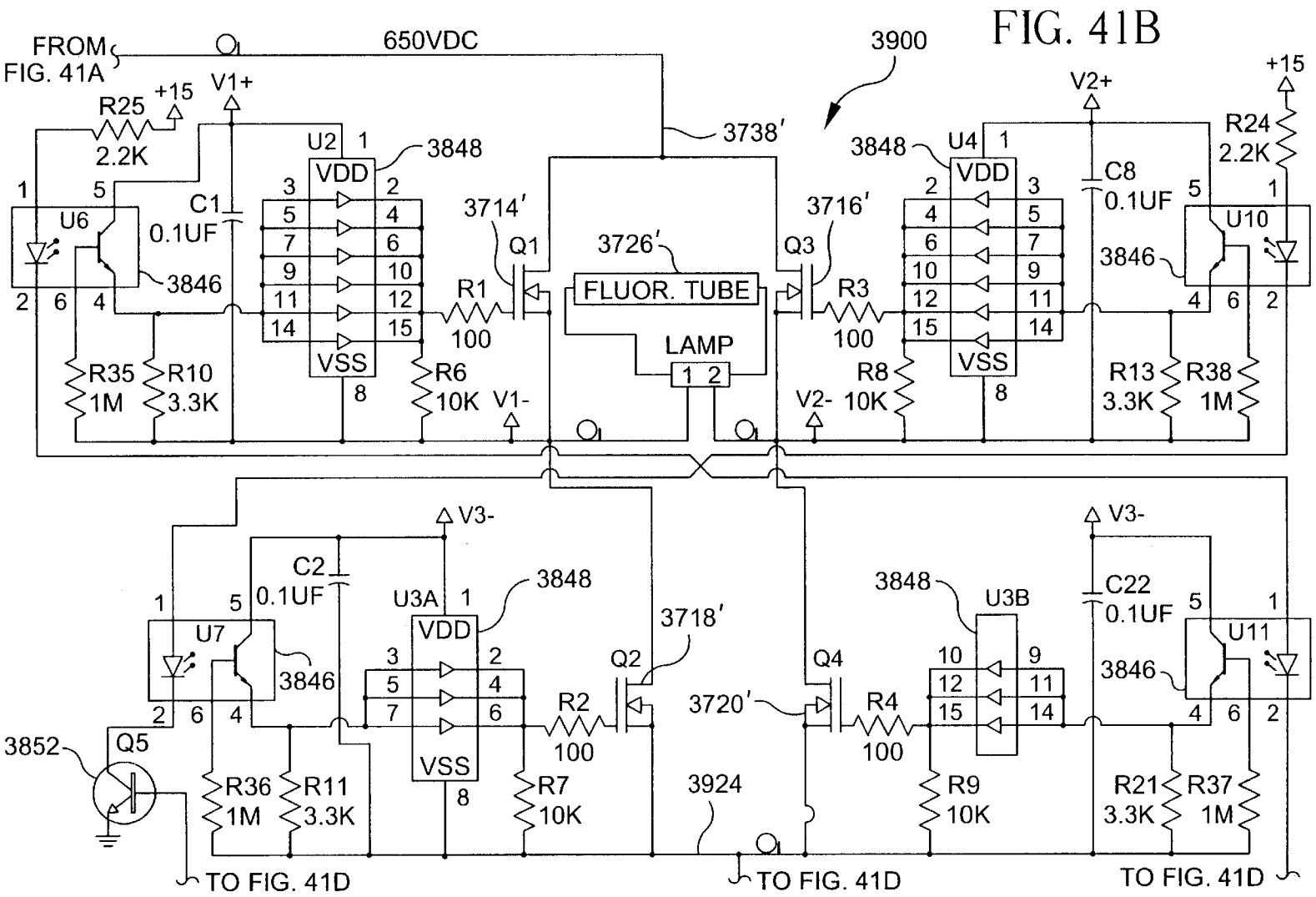
Figure 41C:
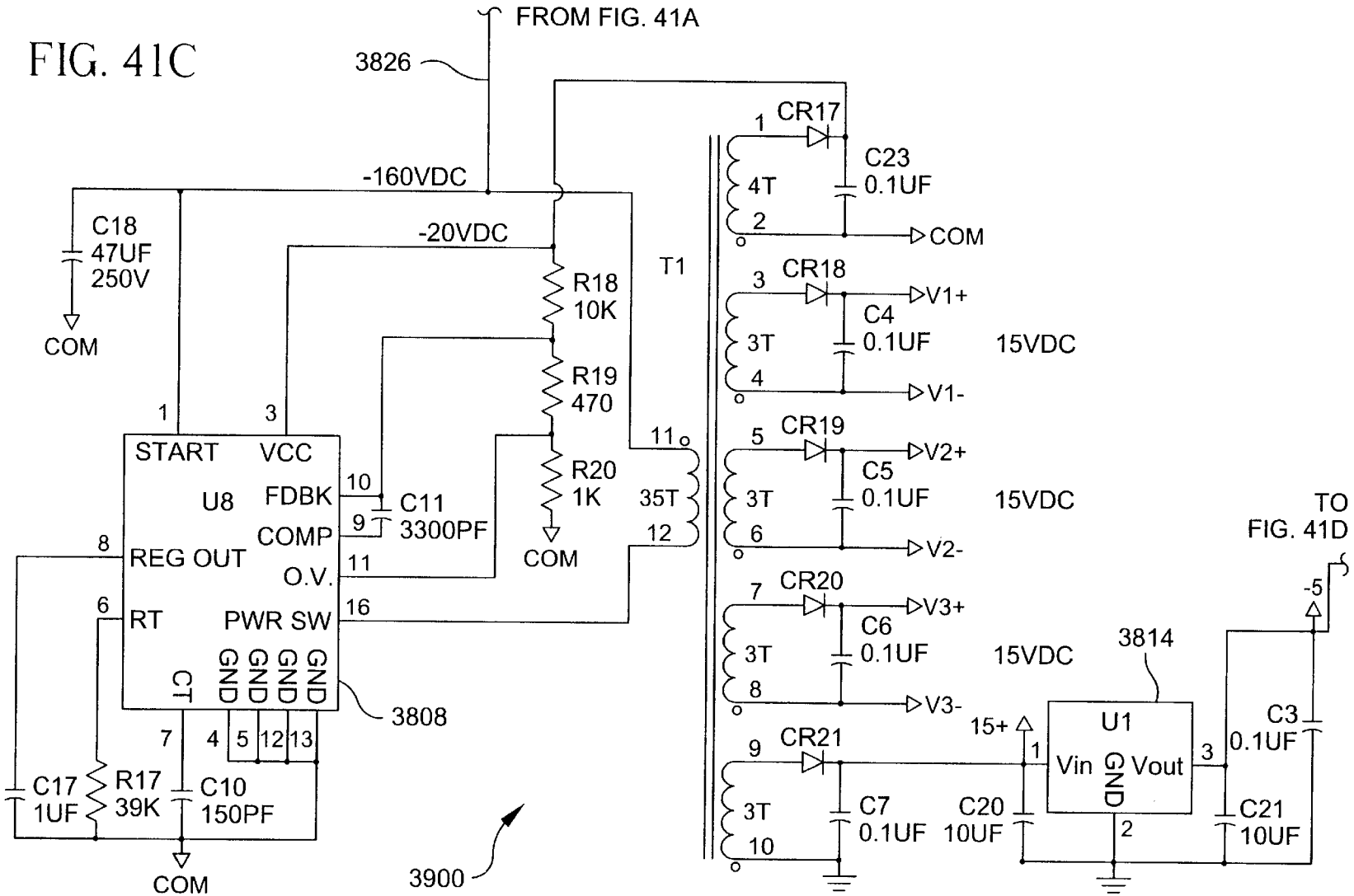
Figure 41D:
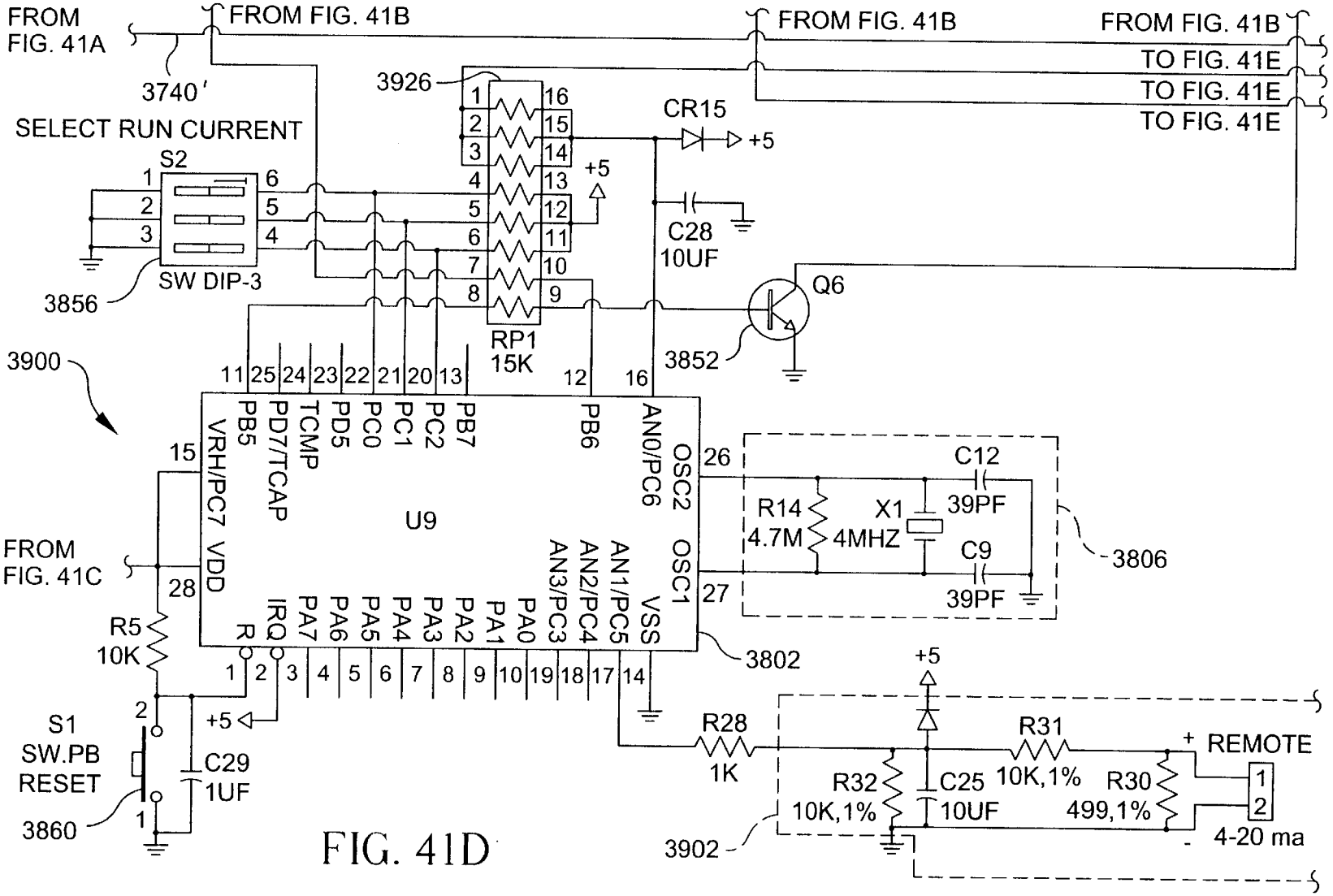
Figure 41E:
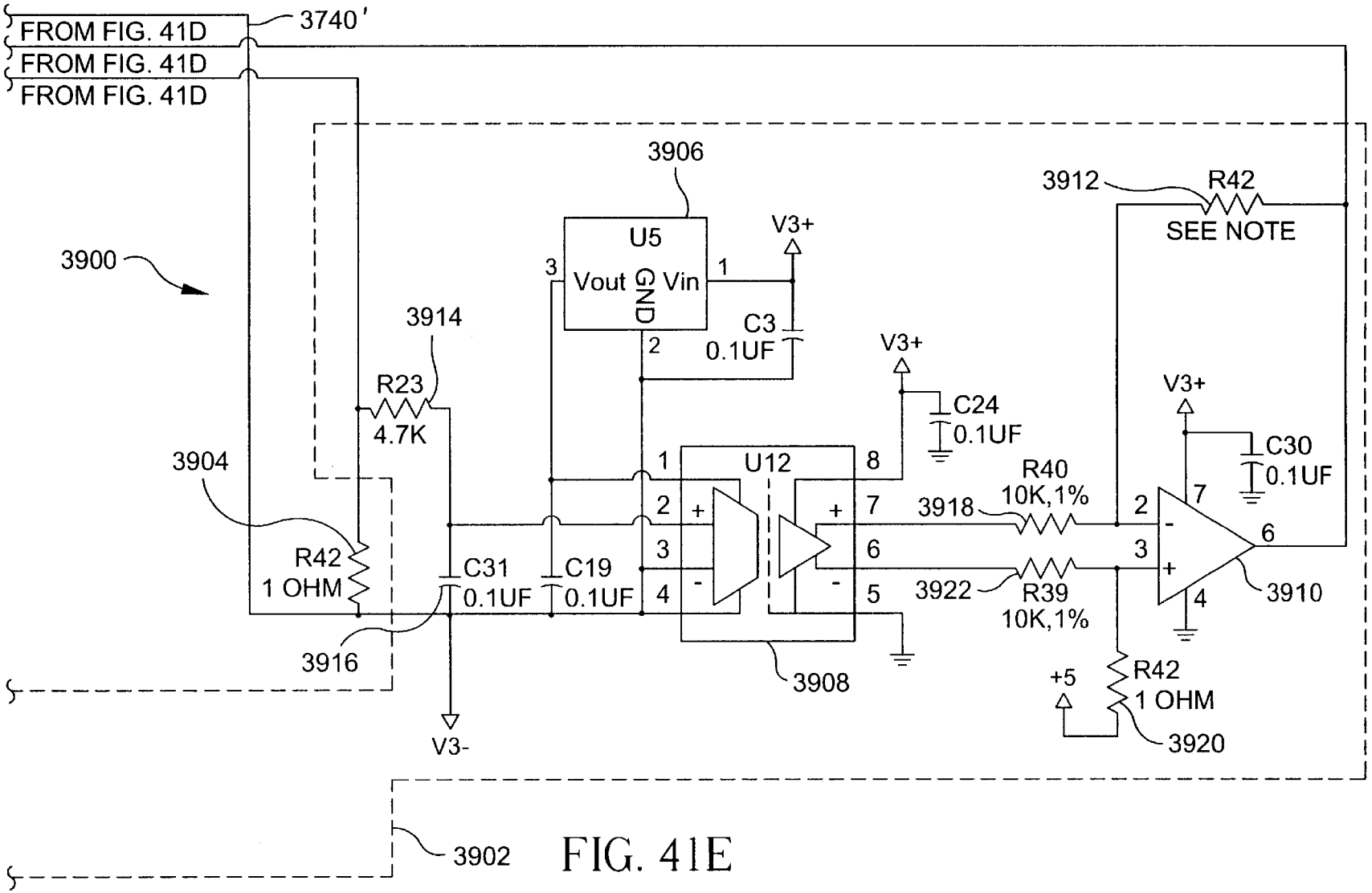

In FIG. 38, there is shown a partial block diagram of a preferred implementation of the polarity-reversing commutation circuit and the controller described above and illustrated in FIG. 37. With reference now to FIG. 38, the commutation circuit is preferably implemented as an H-bridge comprising four field effect transistors (FET) 3714, 3716, 3718 and 3720, each FET having a drain (E), a source (S) and a gate (G) terminal, and corresponding gate drive circuitry 3706, 3708, 3710 and 3712 respectively. It is to be appreciated that although the use of FET devices is preferred, other equivalent devices, for example, bipolar junction transistors (BJT), may similarly be used. Additionally, other suitable configurations for implementing the polarity-reversing commutation circuit are contemplated by the present invention utilizing, for example, silicon controlled rectifiers (SCR), triacs and the like.

With continued reference to FIG. 38, a source of rippled/pulsed DC voltage in the form of a tapped bridge voltage multiplier circuit 3000' is preferably operatively connected to input terminals 3738 and 3740 of the H-bridge. The rippled/pulsed DC voltage source 3000' is essentially the same as the circuit described above and shown in FIG. 25, with similar components receiving similar reference numerals designated with a prime (').  Preferably, inductive-resistive structure 3704, of a type described in detail herein above, is connected in series with one of the output terminals, for example 3036' (which can be, e.g., positive), of the rippled/pulsed DC source 3000'.

In order to provide power for the drive circuit components, an auxiliary rectifier 3730, for example a bridge rectifier, and an auxiliary power supply 3728 may be connected to the AC input line 3032', 3034' in a conventional fashion. The auxiliary power supply 3728 preferably provides separate isolated DC power supply lines for each of the FET gate drive circuits 3706, 3708, 3710, 3712, as well as for controller 3702, such that no short circuit hazard exists, particularly when connecting controller 3702 to a remote dimming device through remote dimming control line 3734.

As illustrated in FIG. 38, the H-bridge circuit is preferably connected such that a first input terminal 3738 is formed at the electrical interconnection of the drains of field effect transistors (FET) 3714 and 3716. Similarly, a second H-bridge input terminal 3740 is preferably formed at the electrical interconnection of the sources of FET devices 3718 and 3720. A first H-bridge output terminal 3742 is preferably formed at the electrical interconnection of the source of FET 3714 and the drain of FET 3718, and, similarly, a second H-bridge output terminal 3740 is preferably formed at the electrical interconnection of the source of FET 3716 and the drain of FET 3720. The fluorescent lamp 3726 is operatively connected between the output terminals 3740, 3742 of the H-bridge circuit.

With continued reference to FIG. 38, the operation of the polarity-reversing H-bridge circuit will now be discussed. Each field effect transistor (FET) 3706, 3708, 3710, 3712 preferably functions as a switch or transmission gate, individually controlled by a voltage applied between the gate and source terminals of the FET. In order for a FET to turn on, the gate-to-source potential ($V_{GS}$) must exceed a predefined threshold voltage ($V_T$), which varies depending on the particular FET device. As appreciated by those skilled in the art, in a FET switch arrangement, the resistance between the drain and source terminals of the FET will ideally approach zero ohms (i.e., a short circuit) when the FET is in an "on," state, and will ideally exhibit infinite resistance (i.e., an open circuit) when the FET is in an "off" state. A detailed discussion of a FET switch can be found, for example, at pages 198–211 of the text *CMOS Analog Circuit Design*, by Phillip E. Allen and Douglas R. Holberg, published by Holt, Rinehart and Winston, Inc., 1987, which is incorporated herein by reference.

Gate driver circuits 3706, 3708, 3710, 3712 are preferably operatively connected between the gate and source terminals of FET devices 3714, 3718, 3716 and 3720 respectively, and provide an appropriate drive voltage (e.g., about 15 volts) such that the FET devices are in the on state. Preferably, a first pair of FET devices 3714, 3720 are turned on essentially simultaneously by their associated gate drivers 3706, 3712 respectively. Similarly, a second pair of FET devices 3716, 3718 are preferably turned on, essentially simultaneously, by their associated gate drivers 3710, 3708. The polarity-reversing operation of the H-bridge is preferably accomplished by alternately enabling either the first pair of gate drivers 3706, 3712 or the second pair of gate drivers 3710, 3708, thereby turning on either the first FET device pair 3714, 3720 or the second FET device pair 3716, 3718 respectively. Furthermore, the duty cycle of the lamp current may be controlled by selectively disabling the gate drive to all FET devices 3714, 3716, 3718, 3720 for a predetermined period of time. As discussed above, the control signals for selectively enabling or disabling the FET gate drivers 3706, 3708, 3710, 3712, thus producing the output current waveforms shown in FIG. 39, are generated by controller 3702.

Controller 3702 may be realized as a microcontroller, such as Motorola MC6805 or equivalent. The microcontroller 3702 preferably includes memory and is able to run user-programmed application software routines for selectively controlling, among other things, the frequency and duty cycle of the output voltage from the H-bridge. It is to be appreciated that other means for controlling the H-bridge gate drivers, and thus the FET devices, are contemplated by the present invention (e.g., a flip-flop toggle arrangement or the like, known by those skilled in the art). Furthermore, in addition to controlling the "on" period of the H-bridge FET devices, the present invention alternatively contemplates a controller which alters the duty cycle of the H-bridge output voltage by fixing the on (or off) time and instead varying the frequency (thereby indirectly controlling the duty cycle).

Because of the inherent flexibility of microcontroller 3702 (e.g., by changing the microcontroller program code which is resident in the microcontroller memory), the fluorescent apparatus drive circuit 3700 of the present invention preferably provides enhanced features which are commercially desirable, such as remote dimming of the lamp in response to external sensors (e.g., motion sensor, light sensor, etc.) or computer control of the fluorescent apparatus via an RS-232 bus. For example, the drive circuit 3700 may be used in conjunction with a light sensor to preferably vary the brightness of the lamp in response to ambient light levels. In this manner, a constant predefined light level may be maintained in a particular area, thereby producing a substantial reduction in utility costs.

Unlike conventional fluorescent lighting control circuits (e.g., using silicon controlled rectifiers, triacs, or the like) operating at high voltages (e.g., 120 volts AC or more), the apparatus of the present invention is able to use low voltage DC control signals (e.g., 5 volts) to remotely control selective fluorescent lamps. These low voltage control signals are substantially safer to work with and may be easily carried over thin copper wires, even over long distances. This is one important feature of the fluorescent drive circuit of the present invention.

As an added desirable feature of the present invention, microcontroller 3702 may preferably be configured to select and maintain a predetermined lamp current by measuring the current flowing through lamp 3726 and comparing the measured lamp current with a predefined reference current, which may be selected by the user. In order to monitor the current flowing through the fluorescent lamp 3726, a current-sensing transformer 3724 may preferably be connected in series with lamp 3726. Current passing through the primary winding of transformer 3724 induces an isolated sense current in the secondary winding which is proportional to the lamp current. This sense current is preferably rectified and filtered by a rectifier and filter circuit 3722, thereby producing a corresponding DC (or rippled/pulsed DC) sense voltage that is directly related to the lamp current.

As shown in FIG. 38, the DC sense voltage may preferably be fed to an analog-to-digital converter (ADC) which is embedded in the microcontroller 3702. Alternatively, an external ADC may be employed where controller 3702 does not include an embedded ADC. Suitable ADCs for use in the present invention are commercially available, for example, from Analog Devices, Inc. (e.g., AD-571, or equivalent). The function of an ADC is to convert an analog quantity such as a voltage or current into a digital word. A detailed discussion of analog-to-digital converters may be found at pages 825–878 of the text *Bipolar and MOS Analog Integrated Circuit Design*, by Alan B. Grebene, published by John Wiley & Sons, 1984, which is incorporated herein by reference, and will, therefore, not be presented herein.

Once the sense voltage is converted to a digital word by the analog-to-digital converter, microcontroller 3702 preferably responds to the digital word by generating an appropriate control signal(s), according to the user application program, to adjust the duty cycle of the drive voltage produced at the output 3740, 3742 of the H-bridge. For example, if the measured lamp current is above the predefined reference current value, controller 3702 will preferably generate the appropriate control signal(s) to lower the duty cycle of the H-bridge output voltage, thereby reducing the lamp current. Similarly, if the measured lamp current is below the predefined reference current value, controller 3702 will preferably generate the appropriate control signal (s) to increase the duty cycle of the H-bridge output drive voltage, thereby increasing the lamp current. In this fashion, microcontroller 3702 may continuously compensate for changes in the load or AC input line voltage.

To insure reliable starting of the fluorescent lamp, microcontroller 3702 may preferably be programmed to delay the application of the output drive voltage to the lamp to allow output drive capacitors 3052', 3054', 3056' and 3058' in the rippled/pulsed DC voltage multiplier circuit 3000' to charge to an appropriate voltage level to start the lamp. A delay of approximately one half (½) second after AC power is first applied to the rippled/pulsed DC circuit 3000' is generally ample time for capacitors 3052', 3054', 3056', 3058' to fully charge. The delay may preferably be accomplished by holding each of the FET devices 3714, 3716, 3718, 3720 in the H-bridge off for the desired period of delay time (e.g., ½ second). Using this delay approach, a spike trigger circuit, as described herein above, may be omitted.

An exemplary H-bridge fluorescent lamp drive circuit 3800, formed in accordance with the present invention, is illustrated in the electrical schematic diagram of FIGS. 40A–40D. The exemplary H-bridge drive circuit 3800 is essentially the same as the circuit shown in FIG. 38, with similar components receiving similar reference numerals designated with a prime (').

With reference to FIGS. 40A–40D, the drive circuit 3800 preferably includes a rippled/pulsed DC voltage source in the form of a tapped-bridge voltage multiplier 3000', as described above and shown in FIGS. 25 and 38.

Preferably, the H-bridge drive circuit 3800 includes an auxiliary power supply for supplying power to the drive circuit components. The auxiliary power supply preferably includes a bridge rectifier 3730' having a first (e.g., positive) output terminal 3826, a second (e.g., negative) output terminal 3828 forming a common or ground connection, and having two AC input terminals connected across the AC line input in a conventional fashion. Bridge rectifier 3730' generates a full-wave rectified, pulsating DC voltage, preferably about 160 volts, across output terminals 3826, 3828, which is filtered by a capacitor 3824 electrically connected across the bridge rectifier output terminals 3826, 3828 to substantially remove the ripple component of the pulsating DC voltage.

At least a portion of the output voltage from the bridge rectifier 3730' is electrically connected to a first terminal of primary winding 3810 of a transformer 3812. Transformer 3812 is preferably a step-down transformer having multiple independent secondary windings on a toroidal core, for example, Thomson T-2210A-A9 or equivalent. Each of the individual secondary windings 3816, 3830, 3832, 3834, 3836, in conjunction with an off line power supply controller, such as Motorola MC33362 or equivalent, are preferably used to generate multiple isolated, quasi-regulated DC power supplies, preferably providing a voltage output of approximately 15 volts each. The auxiliary power supply, therefore, provides isolated DC voltage for each of the FET gate drivers, as well as the microcontroller 3802. It is essential that microcontroller 3802 be isolated from the AC input line to ensure that no short circuit hazard exists by connection, for example, to a remote dimming device.

With continued reference to FIGS. 40A–40D, the polarity-reversing circuit is preferably implemented as an H-bridge comprising four power field effect transistor (FET) devices 3714', 3716', 3718', 3720', such as MTP4N80E or equivalent, electrically connected to each other in the same manner as described above and shown in FIG. 38. Each power FET device preferably includes a corresponding FET gate driver circuit comprising an optocoupler 3846, such as a 4N28 or equivalent. Optocoupler 3846 essentially isolates the control signal generated by microcontroller 3802 from the FET gate driver circuit. The output voltage from optocoupler 3846 is preferably further fed through a buffer 3848, such as Motorola MC14050B or equivalent.

Generally, power FET devices inherently have a substantial internal capacitance associated with the gate terminal of the device. In order to quickly turn on the FET device, therefore, a buffer 3848 is preferably employed to increase the gain of the optocoupler output voltage. In this manner, a voltage having a faster slew rate is presented to the gate terminal of the FET device. Where even more gain is required, several buffers may be connected together in parallel. For example, for FET devices 3714' and 3716', each gate driver preferably includes six buffers 3848 (preferably contained in a single integrated circuit package, for example, Motorola MC14050B or equivalent) connected in parallel between the output of an optocoupler 3846 and the gate terminal of a corresponding FET device. Similarly, for FET devices 3718' and 3720', each gate driver preferably includes three buffers 3848 connected in parallel in the same manner. In the circuit of FIGS. 40A–40D, multiple buffers are shown connected in parallel between the output of an optocoupler and the gate terminal of a corresponding FET in order to avoid wasting unused logic gates in an individually packaged device containing multiple buffers. It is to be appreciated, however, that a single buffer which provides the appropriate gain may alternatively be used.

The control signals generated by microcontroller 3802 for controlling the H-bridge FET devices are each preferably electrically connected to the base terminal of an npn bipolar junction transistor (BJT) 3852, such as 2N4401 or equivalent, through a current limiting base resistor 3850. Transistors 3852 provide additional current capability for driving optocoupler devices 3846. Alternatively, the present invention contemplates the use of pnp bipolar transistors, or other equivalent devices (e.g., field effect transistors), and associated biasing components to provide the necessary current for driving the optocoupler devices 3846.

The H-bridge drive circuit is preferably controlled by microcontroller 3802, for example, Motorola MC68HC05P6A or equivalent. Microcontroller 3802 preferably includes an embedded analog-to-digital converter (ADC) and user-programmable memory, which reduces component count by eliminating the need for an external ADC, memory, and associated control and interface logic. Microcontroller 3802 preferably executes instructions according to its embedded user-programmable read-only memory (ROM). An exemplary microcontroller program is illustrated by the main loop flowchart of FIG. 42. As appreciated by those skilled in the art, the present invention contemplates various software program routines that may be developed to perform the functions depicted in the flowchart.

Figure 42:
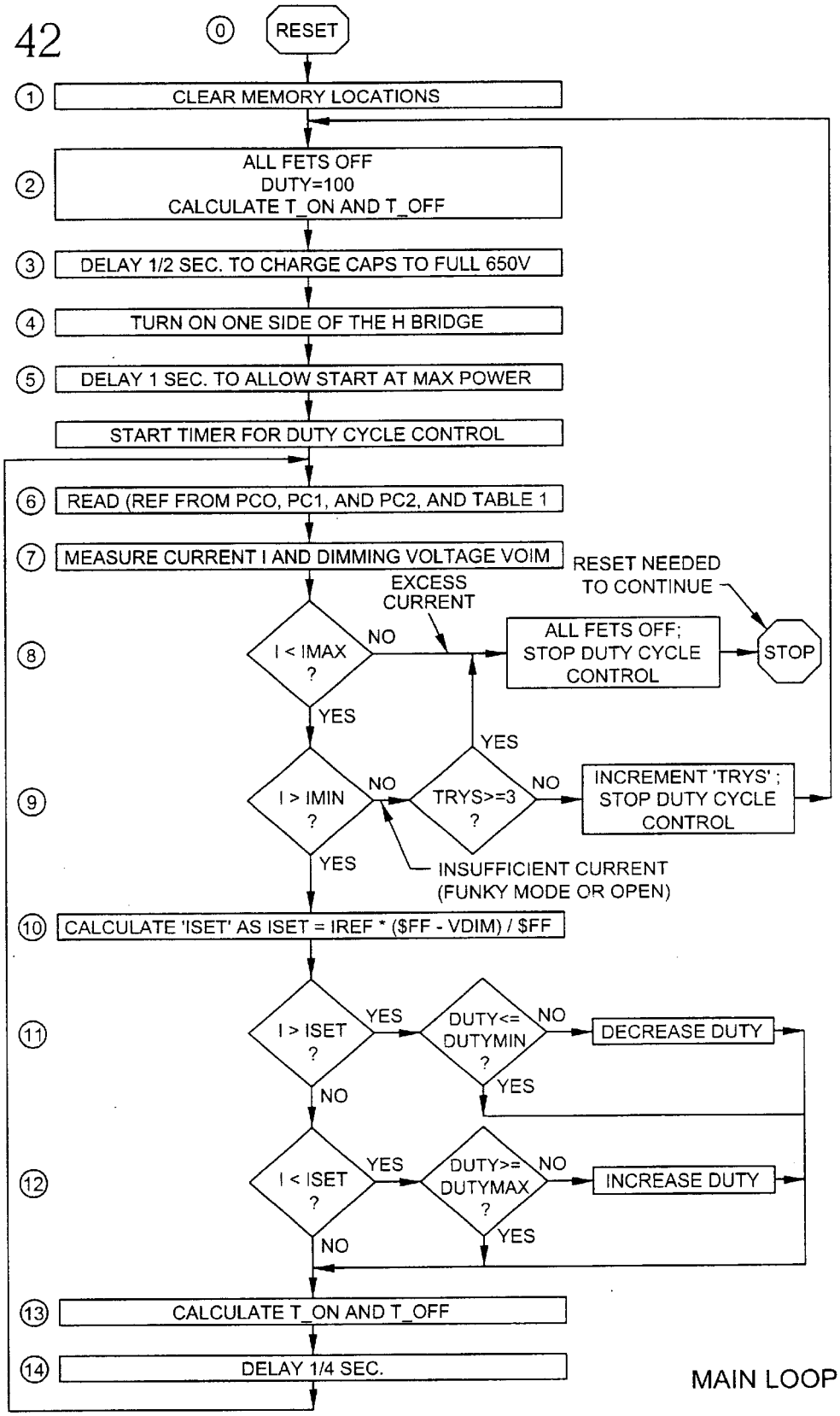
FIG. 42 depicts a flowchart of an exemplary main loop program routine for the microcontroller shown in FIGS. 38, 40 and 41.

With reference to FIG. 42, the main loop program preferably incorporates the capability of delaying the presentation of the lamp drive voltage for a predetermined period of time, allowing the output drive capacitors in the pulsed/rippled DC voltage source to substantially charge to the full 650 volts. This insures reliable starting of the lamp. The main loop program further preferably includes a routine to measure and maintain a constant predefined current in the lamp. This software routine also preferably includes a feature whereby if the measured current exceeds the user-preset reference current for greater than three measurement periods, the H-bridge FET devices are all held in the "off" state (thereby shutting down the lamp drive current) until either the microcontroller receives a reset signal, or the power to the microcontroller is removed and then re-applied. This provides important safety benefits by removing the presence of high voltage at the lamp terminals when, for example, this is no lamp present, thus reducing the possibility of electric shock. An additional exemplary program routine for performing the function of duty cycle control is shown in the flowchart of FIG. 43, and may be included as part of the main loop microcontroller program.

Referring again to FIG. 40A–40D, associated with microcontroller 3802 are various external components which are essential for proper operation of microcontroller 3802. For example, an oscillator circuit 3806, preferably comprising a crystal oscillator for providing oscillations of about 4 megahertz, is operatively connected to microcontroller 3802 in a conventional manner. External oscillator 3806 is used to generate the internal timing signals used by the microcontroller. Additionally, a dual in-line pin (DIP) switch package 3856 is preferably operatively connected to microcontroller 3802. DIP switch package 3856 preferably includes multiple single-pole single-throw (SPST) switches in the same package, with each individual switch electrically connected to a different microcontroller input. Preferably, pull-up resistors 3858 may be connected from the individual microcontroller inputs (used to select a lamp running current) to the positive five volt DC supply. This insures that the microcontroller 3802 inputs are not "floating" when any of switches 3856 are in the "off" (i.e., open circuit) position. Alternatively, pull-down resistors may be operatively connected from each microcontroller 3802 input to the negative DC supply (i.e., ground), as appreciated by one skilled in the art.

The position or state (i.e., "on" or "off") of the individual switches 3856 preferably enables a user to select a desired lamp run current. The resolution of the change in lamp current will generally depend upon the number of input lines to the microcontroller 3802. It is to be appreciated that DIP switches 3856 may be replaced by individual jumpers, which can be selectively configured to provide the desired lamp run current in a similar manner. An external momentary SPST switch 3860 is preferably operatively connected to microcontroller 3802 for generating a microcontroller reset signal. Alternatively, the circuit could be reset by removing and then re-applying power to the circuit.

As described above with reference to FIG. 38, the drive circuit of the present invention preferably includes a current sense transformer 3724', such as Thomson core T-2000A-A4 or equivalent. The current transformer 3724' is preferably electrically connected so that its primary winding is in series with the lamp 3726'. A sense current proportional to the lamp current will be induced in the secondary winding of transformer 3724'. This sense current may preferably be rectified by, for example, a conventional full-wave bridge rectifier circuit 3722' having a simple capacitor-input filter (e.g., a 4.7 $\mu$F capacitor and a 100 ohm resistor connected in parallel across the bridge rectifier output terminals).

It may be preferable to provide additional low pass filtering in order to substantially remove any remaining high frequency components present in the sense current. A simple single-pole low pass filter preferably includes a resistor 3862, connected in series between the output of bridge rectifier circuit 3722' and the embedded analog-to-digital converter (ADC) input of microcontroller 3802, and a capacitor 3864, connected between the ADC input and the negative voltage supply (i.e., ground). As known by those skilled in the art, the half-power (i.e., −3 dB) frequency will be determined by the values of resistor 3862 and capacitor 3864 according to the equation $p=1/(RC)$, where p is the half-power frequency (in radians per second, rad/s), R is the value of series resistor 3862 (in ohms, Ω) and C is the value of shunt capacitor 3864 (in Farads, F). Preferably, resistor 3862 is selected to be about 4.7 KΩ and capacitor 3864 is selected to be about 22 $\mu$F, thus establishing a −3 dB point of about 1.5 Hertz. Although only a simple low-pass filter is illustrated in FIGS. 40A–40D, the present invention similarly contemplates other suitable low pass filter arrangements which may be employed.

Table 1, shown below, illustrates values of the previously identified components used in an illustrative embodiment of the present invention shown in FIGS. 40A–40D.

| Reference Designation | Type | Value |
|---|---|---|
| 3802 | Microcontroller | MC68HC05P6A |
| 3804 | inductive-resistive tape | |
| 3806 | Crystal oscillator | 4.0 MHz |
| 3808 | Power supply controller IC | MC33362 |
| 3812 | Step-down xfmr | T-2210A-A9 core |
| 3814 | 5 VDC voltage regulator | 7805 |
| 3818 | Resistor | 10KΩ |
| 3820 | Resistor | 470Ω |
| 3822 | Resistor | 1KΩ |
| 3824 | Capacitor | 47 $\mu$F, 250 V |
| 3828 | Bridge rectifier | |
| 3838 | Capacitor | 1 $\mu$F |
| 3840 | Resistor | 39KΩ |
| 3842 | Capacitor | 150pF |
| 3844 | Capacitor | 3300pF |
| 3846 | Optocoupler | 4N28 |
| 3848 | Buffer IC | MC14050B |

-continued

| Reference Designation | Type | Value |
|---|---|---|
| 3850 | Resistor | 15KΩ |
| 3852 | Transistor | 2N4401 |
| 3854 | Resistor | 100Ω |
| 3856 | SPST DIP switch/jumpers | (OPTIONAL) |
| 3858 | Resistor | 22KΩ |
| 3860 | Momentary SPST switch | |
| 3862 | Resistor | 4.7KΩ |
| 3864 | Capacitor | 22 $\mu$F |
| 3714' | FET | MTP4N80E |
| 3716' | FET | MTP4N80E |
| 3718' | FET | MTP4N80E |
| 3720' | FET | MTP4N80E |
| 3724' | Transformer | T-2000A-A4 core |
| 3726' | Fluorescent lamp | |

Referring now to FIGS. 41A–41E, there is shown an alternative embodiment of the exemplary circuit illustrated in FIGS. 40A–40D, with like components receiving the same reference designation numbers as in FIGS. 40A–40D. In this alternative embodiment, the circuitry is essentially the same as the drive circuit depicted in FIGS. 40A–40D, with the primary exception of the current-sensing circuitry.

As shown in FIGS. 41A–41E, the current sense transformer 3724' and associated rectification circuitry 3722' of FIGS. 40A–40D are preferably replaced by some additional smaller, less expensive components. Rather than employing an expensive transformer to perform the current sense function, the drive circuit of FIGS. 41A–41E preferably uses a current sense resistor 3904 connected between the negative output terminal of the H-bridge 3924, formed at the junction of the source terminals of FET devices 3718' and 3720', and the negative voltage supply line 3740'. Preferably, a very low value of resistance (e.g., about one ohm, ½ watt) is used for current sense resistor 3904. A low resistance value insures that the differential voltage developed across sense resistor 3904 does not grow too large when the lamp current is high.

Additional circuitry 3902, the operation of which will be discussed herein below, is also preferably provided to measure at least a portion of the voltage developed across sense resistor 3904. This voltage, which is representative of the current flowing through lamp 3726', is preferably fed to the analog-to-digital converter embedded in microcontroller 3802 to monitor and maintain the user-defined lamp current (set by switches 3856), as described above with reference to FIGS. 40A–40D.

With continued reference to FIGS. 41A–41E, in order to accurately measure the voltage generated across sense resistor 3904, the two connection points 3924, 3740' of resistor 3904 are preferably electrically connected to the negative and positive inputs, respectively, of an operational amplifier (of ramp) 3910 via series input resistors 3918 and 3922. Operational amplifier 3910 is preferably configured as a conventional differential voltage subtracter-multiplier circuit having a feedback resistor 3912, connected between the negative (inverting) input and the output of op-amp 3910, and having a common-mode resistor 3920, connected between the positive (non-inverting) input and positive five volt source (generated at the output of five volt regulator 3814).

The voltage subtracter-multiplier is a basic circuit for forming the difference of voltages. With reference to FIGS. 41A–41E, it is to be appreciated by those skilled in the art that the voltage produced at the output of operational amplifier (op-amp) 3910 will be the analog representation of a scaled value of the voltage present at the inverting (−) input of op-amp 3910 subtracted from a scaled value of the voltage present at the non-inverting (+) input of the op-amp 3910.

Preferably, feedback resistor 3912 is of the same value as common-mode resistor 3920, and the two series input resistors 3918, 3922 are preferably the same value as each other. This simplifies the op-amp output voltage equation by allowing the multiplying constants for the two input voltages of the op-amp to be essentially the same. The value of the multiplying constant will be primarily determined by a ratio of the value of feedback resistor 3912 to the value of input resistor 3918 (or similarly, the value of resistor 3920 divided by the value of resistor 3922). This multiplying constant may be appropriately chosen so as to provide a sense voltage in the operable range of the analog-to -digital converter utilized in the drive circuit. Preferably, resistors 3912 and 3920 are chosen to have a value of 80.6K ohms with a tolerance of one percent (1%), and input resistors 3918, 3922 are chosen to have a value of 10K ohms with a tolerance of one percent (1%). This results in a multiplying factor (i.e., gain) of about 8.06.

It is preferred that the voltage developed across sense resistor 3904 be filtered to substantially remove any high frequency components that are present in the sense current prior to being fed to the voltage subtracter-multiplier circuit. For the drive circuit shown in FIGS. 41A–41E, a simple single-pole low pass filter network is preferably used, comprising a series-connected resistor 3914 and a shunt capacitor 3916. The values of resistor 3914 and capacitor 3916 are preferably chosen to provide the desired −3 dB corner (i.e., pole) frequency for the low pass filter, as previously described above. In the drive circuit of FIG. 41, a resistor value of about 4.7K ohms and a capacitor value of about 10 $\mu$F were chosen to establish a −3 dB corner frequency of about 3 Hertz. Although a simple single-pole low pass filter is preferred, any low pass filter circuit which substantially removes the high frequency components of the sense current may be used in the present invention. Various suitable low-pass filter arrangements are known by those skilled in the art and are presented in such texts as *Analog Filter Design*, by M. E. Van Valkenburg, published by Holt, Rinehart and Winston, Inc., 1982. A detailed discussion of low pass filters will, therefore, not be provided herein.

In order to isolate the microcontroller from the fluorescent lamp and any remote control signals, an isolation circuit 3908, such as manufacturer part number HCPL7840, or an equivalent thereof, may be operatively connected between sense resistor 3914 and op-amp 3910. It may also be preferable to provide a separate five volt regulated DC voltage supply 3906, such as manufacturer part number 7805 or equivalent. When isolation is employed, the gain of the differential subtracter-multiplier circuit is preferably unity, and thus resistors 3912 and 3920 are chosen to be a value substantially equal to input resistors 3918,3922 (i.e., 10K ohms). Where the accuracy of the multiplying constant (i.e., gain) is critical, the gain-determining resistors 3912, 3918, 3920 and 3922 will preferably have a tolerance of one percent (1%) or less to insure superior matching.

As illustrated in FIGS. 41A–41E, a resistor network 3926 may preferably be employed as a means of conserving valuable printed circuit board space. Resistor network 3926 may be manufactured as a plurality of individual resistors, each preferably having the same resistance value, combined, for example, in a conventional dual in-line pin (DIP) package. For the exemplary drive circuit of FIGS. 41A–41E, resistor network 3926 preferably comprises eight 15K ohm resistors. It is to be appreciated that when resistor network 3926 is employed, series current limiting resistors 3850 and pull-up resistors 3858, shown in FIGS. 40, may be omitted.

It should also be noted that in all of the embodiments of the invention set forth herein, the invention extends both to the assembly of the various components together with the fluorescent lightbulb (or other assembly of translucent housing, and fluorescent medium), as well as to the components without the fluorescent lightbulb, configured in a fashion to receive a fluorescent lightbulb from another source.

With particular reference again to FIG. 36, it should be noted that any of the apparatuses disclosed herein, whether preheat, rapid start, or instant start, which are utilized with AC, may benefit from the use of a low pass filter 3562. Such a filter can be located in series with the input power line (e.g., the "hot" lead) to correct the power factor and to improve total harmonic distortion by suppressing spurious harmonic transmission into the power lines. One preferred form of low pass filter 3562 includes a small inductive reactance, preferably on the order of millihenries. For example, using a four foot T12 lamp, a power factor of about 0.99 and a total harmonic distortion (THD) of about ten percent (10%) was achieved by placing an inductor of approximately 240 mH in series with the "hot" lead of the AC input.

Referring to FIGS. 44A–44E, there is shown an alternative embodiment of the exemplary circuit illustrated in FIGS. 41A–44E with similar components receiving the same reference designation numbers as in FIG. 41A–41E. The primary distinctions between the circuit shown in FIG. 41 and the alternative embodiment shown in FIG. 44 are discussed below.

The circuit shown in FIG. 44 preferably includes five sub-circuits: a main power supply, an auxiliary power supply, an isolated dimmer control, a ballast circuit, and a microcontroller. The main power supply preferably includes diodes CR1–CR4, a power factor controller U1 MC33262 (commercially available from Motorola Corporation, Tempe, Ariz.), a transistor Q5 IRF730, and associated components, as shown in FIG. 44A. This portion of the circuit converts the 115 volt alternating current (VAC) line voltage to a program-controlled direct current (DC) voltage between 220 and 330 volts DC, which is used to start and run the fluorescent lamp.

Figure 44A:
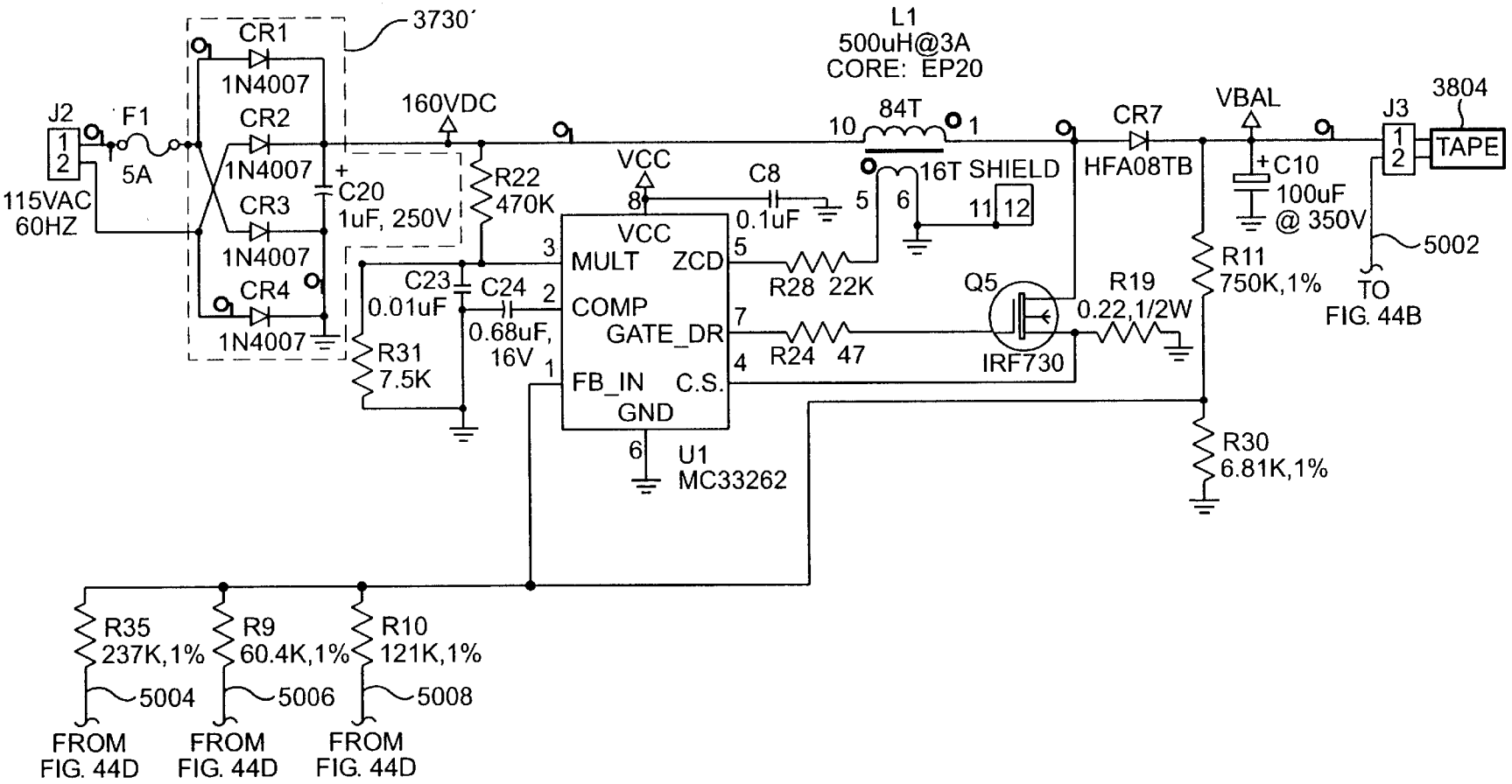
FIGS. 44A, 44B, 44C, 44D and 44E is an electrical schematic diagram of an alternative exemplary H-bridge fluorescent lamp drive circuit.
Figure 44B:
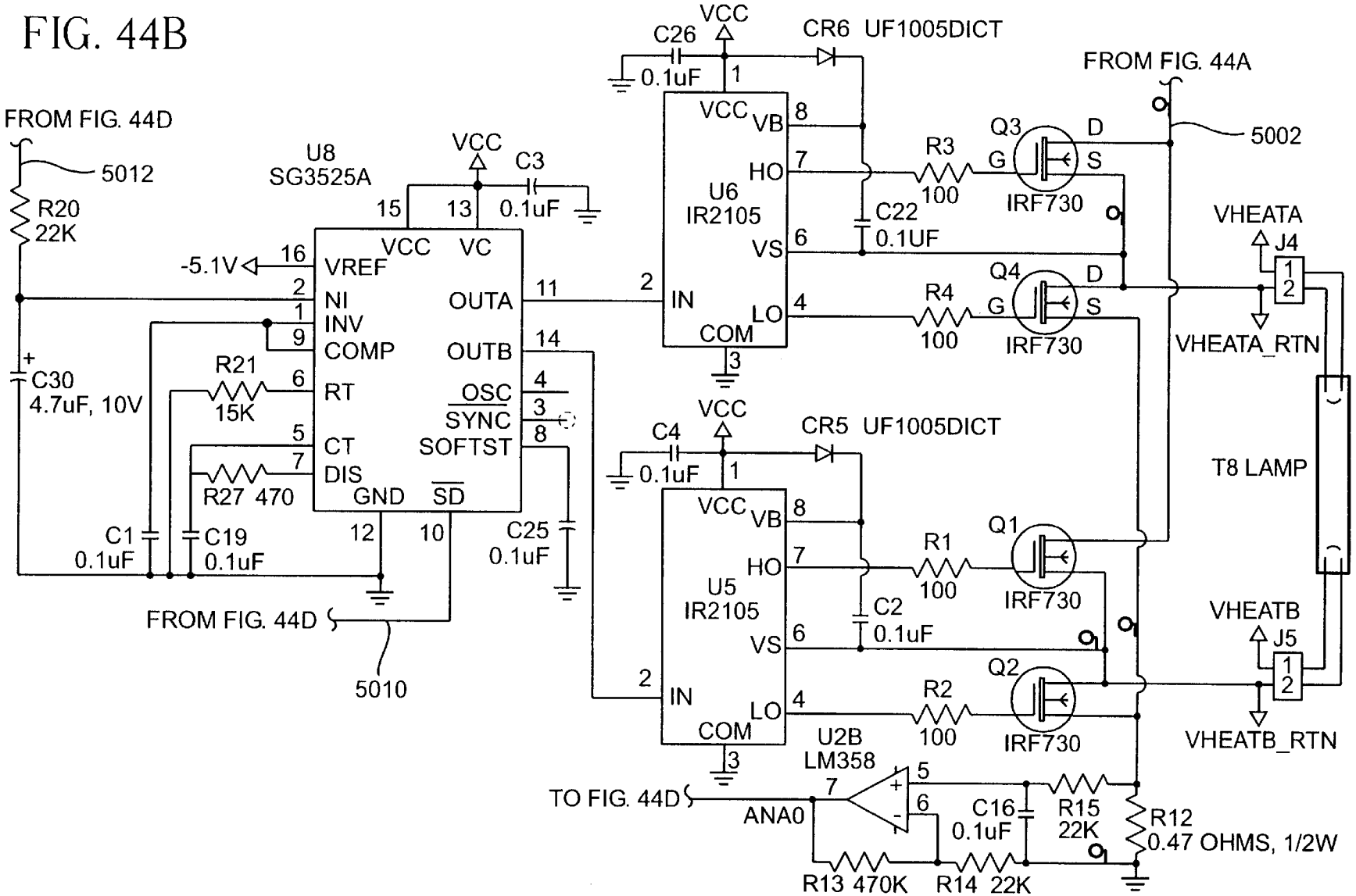
Figure 44C:
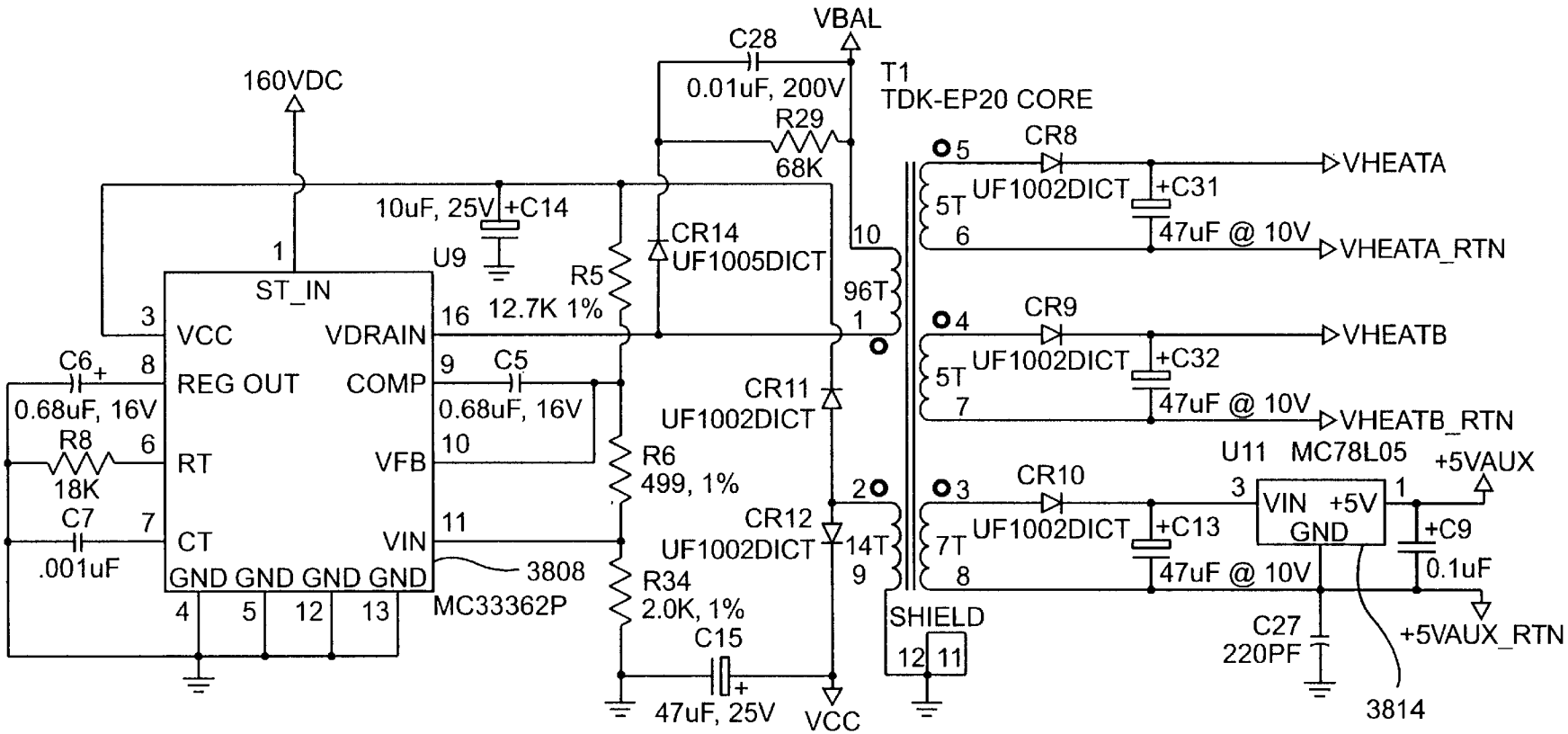

The auxiliary power supply sub-circuit preferably includes a high voltage switching regulator U9 MC33362 (commercially available from Motorola Corporation, Tempe, Ariz.) and a transformer T1, as shown in FIG. 44C. This portion of the circuit converts an input-rectified AC voltage (+160 VDC) to three isolated output voltages. These outputs drive the fluorescent lamp heaters and the remote dimming control circuit.

Figure 44D:
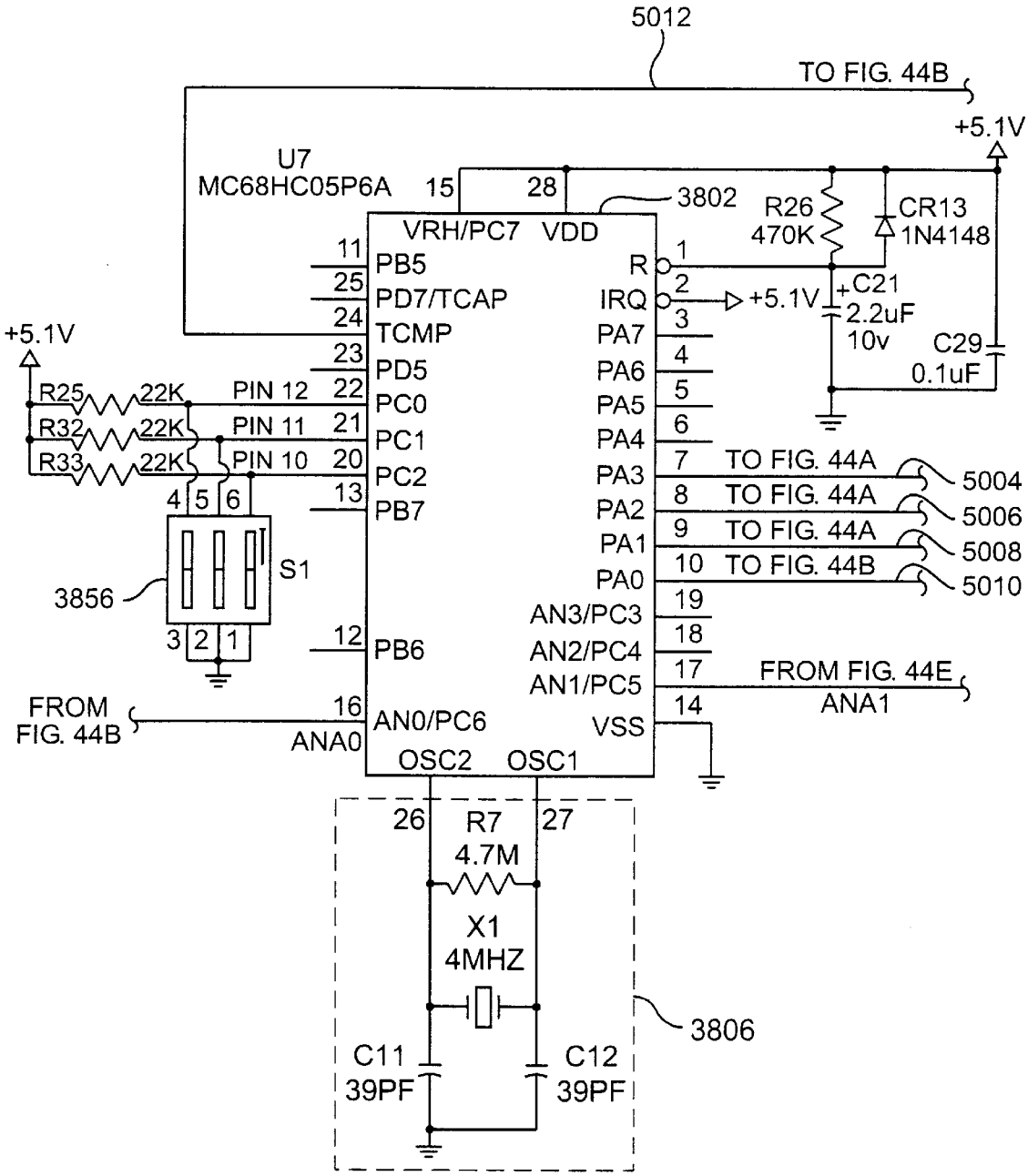
Figure 44E:
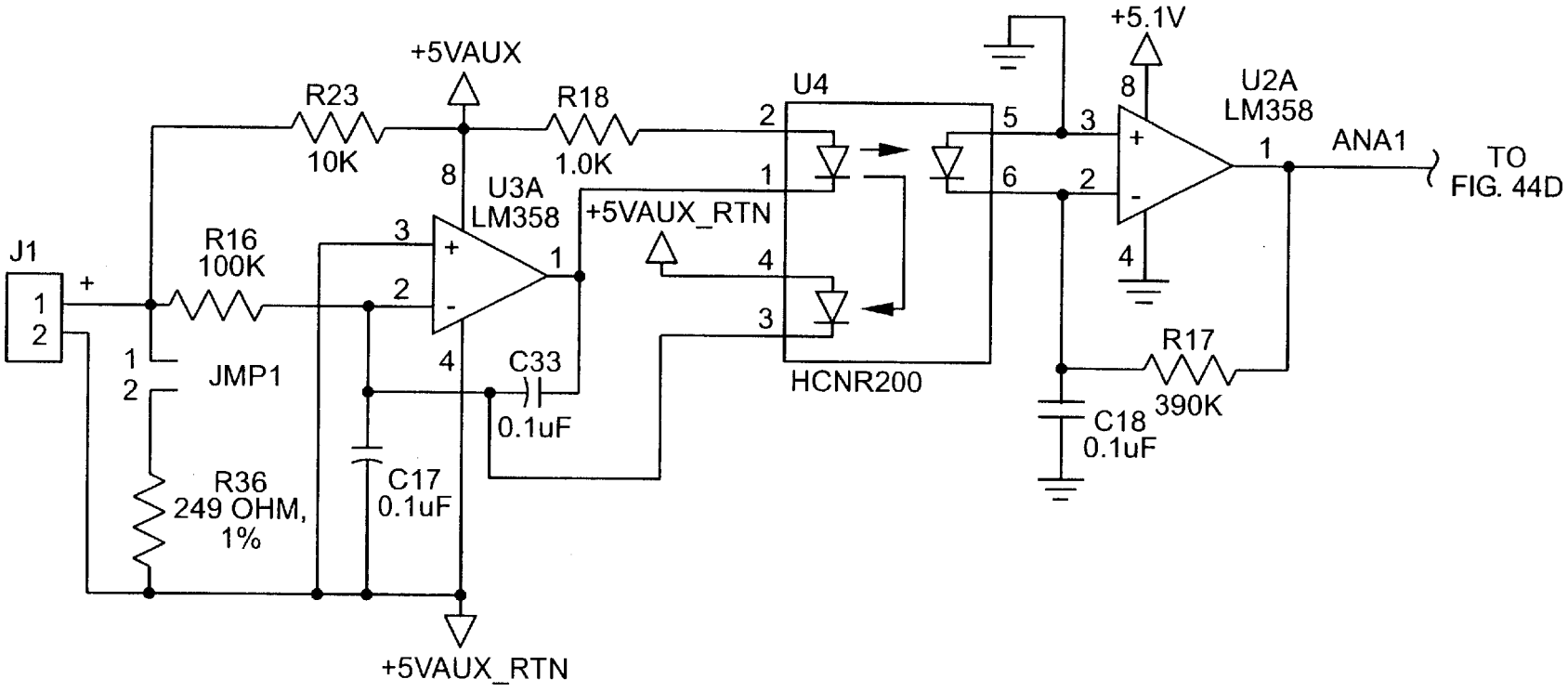

The isolated dimmer control sub-circuit preferably includes operational amplifiers U2A and U3A LM358 (commercially available from National Semiconductor, Santa Clara, Calif.) and a high linearity analog optocoupler U4 HCNR200 (commercially available from Agilent Technologies, San Francisco, Calif.) as shown in FIG. 44E. This portion of the circuit facilitates remote dimming with electrical isolation to protect the user from an electrical shock hazard.

The ballast sub-circuit preferably includes a Tapeswitch™ resistive ballast (connected to connector J3), two half bridge drivers U5 and U6 IR2105, a pulse width modulator control circuit U8 SG3525A (commercially available from Motorola Corporation, Tempe Ariz.), and transistors Q1–Q4, as shown in FIG. 44B. These elements provide a current-limited 5 KHz AC drive signal to the fluorescent lamp. The microcontroller U7 MC68HC05P6A (commercially available from Motorola Corporation, Tempe Ariz.) is shown in FIG. 44D and performs various control functions. The sub-circuits will now be described in greater detail.

The sub-circuit used for the fluorescent lamp main power supply is shown in FIG. 44A and is preferably similar to the circuit shown in FIG. 19 of the Motorola MC33262 (U1) data sheet, which is incorporated herein by reference.

In general, the main power supply sub-circuit preferably performs two functions. First, it boosts the voltage from +160 VDC (the rectified line voltage) to a voltage between 220 and 330 VDC. This is necessary for the operation of the fluorescent lamp, which preferably requires 330 VDC to start reliably, and a lower running voltage for normal lamp operation. Second, the main power supply sub-circuit maintains the power factor at 0.99 or better, thereby presenting a nearly ideal load to the line and keeping utility costs to a minimum.

A significant advantage of the main power supply sub-circuit shown in FIG. 44A is the inclusion of resistors R10, R20, and R35, which allow the microcontroller U7 to adjust the output voltage under program control. In general, the power factor controller U1 regulates the duty cycle of the transistor Q5 to maintain pin 1 of the power factor controller U1 at 2.5 VDC. For this to occur, it can be shown that the following is true:

$$\text{Vout} = \left\{\left(\frac{2.5 - PA1}{R10}\right) + \left(\frac{2.5 - PA2}{R9}\right) + \left(\frac{2.5 - PA3}{R35}\right) + \left(\frac{2.5}{R30}\right)\right\} \times R11 + 2.5 \quad (1)$$

If PA1, PA2, and PA3 are all at ground potential (0 VDC) then:

$$\text{Vout} = \left\{\left(\frac{2.5 - 0}{121.1\ K}\right) + \left(\frac{2.5 - 0}{60.4\ K}\right) + \left(\frac{2.5 - 0}{237\ K}\right) + \left(\frac{2.5}{6.81\ K}\right)\right\} \times 750\ K + 2.5 = 332\ \text{Volts} \quad (2)$$

if PA1, PA2, and PA3 are all high (+5 VDC) then:

$$\text{Vout} = \left\{\left(\frac{2.5 - 5}{121.1\ K}\right) + \left(\frac{2.5 - 5}{60.4\ K}\right) + \left(\frac{2.5 - 5}{237\ K}\right) + \left(\frac{2.5}{6.81\ K}\right)\right\} \times 750\ K + 2.5 = 223\ \text{Volts} \quad (3)$$

The eight possible combinations of microcontroller outputs PA1, PA2, and PA3 facilitate the generation of eight different output voltages preferably between about 223 VDC to 332 VDC. The user enters the required run voltage on switch S1 (depending on the lamp to be used). The microcontroller U7 then senses the value of switch S1 (or jumpers in place of switch S1) and sets PA1, PA2, and PA3 accordingly.

The microcontroller U7 preferably starts the lamp using a high voltage setting, such as 332 VDC After preferably about a second, the microcontroller U7 changes PA1, PA2, and PA3 to the desired run voltage as indicate by the value of switch S1.

The auxiliary power supply sub-circuit shown in FIG. 44C is preferably similar to the circuit shown in the Motorola data sheet for the high voltage switching regulator U9 MC33262, which is incorporated herein by reference. One of the distinctions between the circuit shown in the data sheet and the sub-circuit shown in FIG. 44C is the use of a multi-output inductor T1. Two of the output windings on the inductor T1 provide isolated fluorescent lamp heater voltages. The heaters are held at a constant voltage under all conditions of lamp operation.

A third winding of the inductor T1 provides an isolated voltage (+5 Vaux) for the dimming circuit. The electrical isolation afforded by magnetic coupling through the inductor T1 assures that a shock hazard does not exist at points accessible to an operator.

The isolated dimmer controller sub-circuit is shown in FIG. 44E. Lamp dimming is controlled by an input signal at a connector J1. The signal may be input from an external 100K potentiometer (not shown), or an external signal preferably in the range of about 4–20 ma. With a jumper JWP1 removed, an external 100K potentiometer will allow control of the signal ANA1 at the output of the operational amplifier U2A (pin 1). Specifically, the resistor R23 and the external 100K potentiometer form a voltage divider for the +5 Vaux voltage. This voltage is preferably controllable to be between about 0 and 4.5 VDC, and is preferably connected to pin 2 of operational amplifier U3A through a resistor R16. The resistor R16 and the capacitor C17 also form an RC filter to reduce noise. The output of the voltage divider at J1-1 can be represented as follows:

$$\text{Voltage Divider Output} = \text{Vaux} \times \left(\frac{\text{Pot}}{\text{Pot} + R_{23}}\right) \quad (4)$$

where "Pot" is the resistance of the potentiometer.

The high linearity analog optocoupler U4 HCNR200 isolates the dimming sub-circuit from the remaining circuitry. The optocoupler U4 includes an infrared light emitting diode (IR LED) electrically connected in series between pins 1 and 2 and matched photodiode receivers electrically connected in series between pins 3 and 4 and between pins 5 and 6.

A positive voltage at pin 2 of operational amplifier U3A causes the voltage at pin 1 of operational amplifier U3A to decrease, thereby turning the IR LED (pins 1 13 and 2 of U4) on. This causes the photodiodes (at pins 3 and 4, and pins 5 and 6 of U4) to generate currents. The current from the first diode flows from pin 2 of the operational amplifier U2A into the +5 Vaux rtn signal (pin 4 of U4) which causes a negative voltage drop across the resistor R16.

When the negative voltage drop across resistor R16 equals the positive voltage from the voltage divider, the circuit is stable, and the IR LED provides a constant light output. At this time, the voltage at pin 2 of the operational amplifier U3A is equal to the voltage at pin 3 of the operational amplifier U3A, which is zero volts. An equation representing the situation just described is as follows:

$$\text{Vaux}\left(\frac{\text{Pot}}{R_{23} + \text{Pot}}\right) - I_1 x R_{16} = 0 \quad (5)$$

where $I_1$=photodiode current of the diode between pins 3 and 4 of optocoupler U4.

Since the two photodiodes in the optocoupler U4 are matched, an identical photodiode current flows from pin 6 of U4 to pin 5 of U4. Since the net current into pin 2 of the operational amplifier U2A must be zero, the voltage at pin 1 of the operational amplifier U2A (signal ANA1) increases enough to send an equal current through resistor R17. This can be expressed by the following equation:

$$ANA1=I_2xR_{17} \quad (6)$$

where $I_2$=photodiode current of the diode between pins 5 and 6 of optocoupler U4.

Since the photodiodes are matched, $I_1=I_2$, and the equations can be solved for the signal ANA1 as follows:

$$ANA1 = \text{Vaux} \times \left\{\frac{R_{17}}{R_{16}}\right\} \times \left\{\frac{\text{Pot}}{\text{Pot} + R_{23}}\right\} \quad (7)$$

It is to be noted that the voltage of the signal ANA1 is similar to that of the corresponding voltage divider shown in FIGS. 40 and 41, except that a scale factor is provided. It is also electrically isolated from the user circuit. The analysis provided above is approximate since the output impedance of the voltage divider, which produces a worst case error of less than 10%, has been ignored.

With jumper JMP1 installed, preferably about a 4–20 ma current flows from J1-1 to J1-2, which creates a voltage drop between about 1 and 5 volts across resistor R36. The circuit operates in a similar fashion to the one described above, except that the input voltage is derived from a current source rather than from a voltage divider.

The ballast sub-circuit shown in FIG. 44B includes the pulse width modulator control circuit U8 SG3525A. The modulator U8 provides two variable duty cycle output signals, which are 180 degrees out of phase with each other (OUTA and OUTB). A DC voltage input at pin 2 of the modulator U8 controls the duty cycle of both outputs. The frequency of the output signal is set by a resistor R21 and a capacitor C19, which can be selected to generate any output frequency between about 50 Hz and 400 KHz. The ballast circuit preferably runs at about 5 kHz. Additional details concerning the modulator U8 are provided in a data sheet for the SG3525A, which is incorporated herein by reference.

The outputs of the modulator U8 are preferably connected to two half bridge drivers U5 and U6 IR2105 (commercially available from International Rectifier Corp. El Segundo, Calif.). The drivers U5 and U6 provide the appropriate electrical characteristics required to interface the modulator U8 to an H-bridge, which includes transistors Q1, Q2, Q3, and Q4. The H-bridge converts the DC voltage, which is preferably between about 220 and 330 VDC, on capacitor C10 to a 5 KHz AC voltage across the fluorescent lamp.

Specifically, since the input signals to drivers U5 and U6 are 180 degrees out of phase, whenever transistor Q3 is turned on by the driver U6, the transistor Q2 will simultaneously be turned on by the driver U5. Similarly, whenever transistor Q4 is turned on by driver U6, the transistor Q1 will simultaneously be turned on by driver U5.

When transistors Q3 and Q2 are on, a positive voltage is applied to the top of the fluorescent lamp J4–2. This causes current to flow from the top of the lamp to the bottom of the lamp shown in FIG. 44B. When transistors Q1 and Q4 are on, a positive voltage is applied to the bottom of the fluorescent lamp J5-2. This causes current to flow from the bottom of the lamp to the top of the lamp. In this fashion, the DC supply voltage is converted to an alternating voltage across the lamp.

The tape ballast 3804 is a resistor that limits lamp current during normal operation, and prevents destructive current spikes due to cross conduction in the H-bridge. It is selected to have as low a resistance as possible, consistent with the required running voltages and currents. It is preferably in the range of about 400 ohms for a 4-foot T-8 lamp.

A resistor R12 in conjunction with an operational amplifier U2B LM358 is used to sense lamp current. The resistor R15 and capacitor C16 form an RC filter to extract the average value of the lamp current, which is provided as signal ANA0 to the microcontroller U7.

The microcontroller U7 shown in FIG. 44D senses the signal ANA1, which is representative of the dimming voltage, and provides an appropriate output signal at in 24 of the microcontroller U7 (TCMP) that controls the duty cycle via the modulator U8 SG3525A. The output signal is itself a duty cycle waveform, the average value of which represents the desired DC control voltage. Filtering is accomplished by resistor R20 and capacitor C30.

The microcontroller U7 also senses the signal ANA0, which is representative of the lamp current and preferably shuts the system down if the current is either above or below one or more predetermined thresholds. In addition, the microcontroller U7 preferably provides a starting voltage for a predetermined period of time and then changes to the desired running voltage. Further, the microcontroller U7 senses the position of switch S1 (or jumpers in place of switch S1) and sets the corresponding running voltage with an appropriate digital signal at its outputs PA1, PA2, and PA3.

Figure 45:
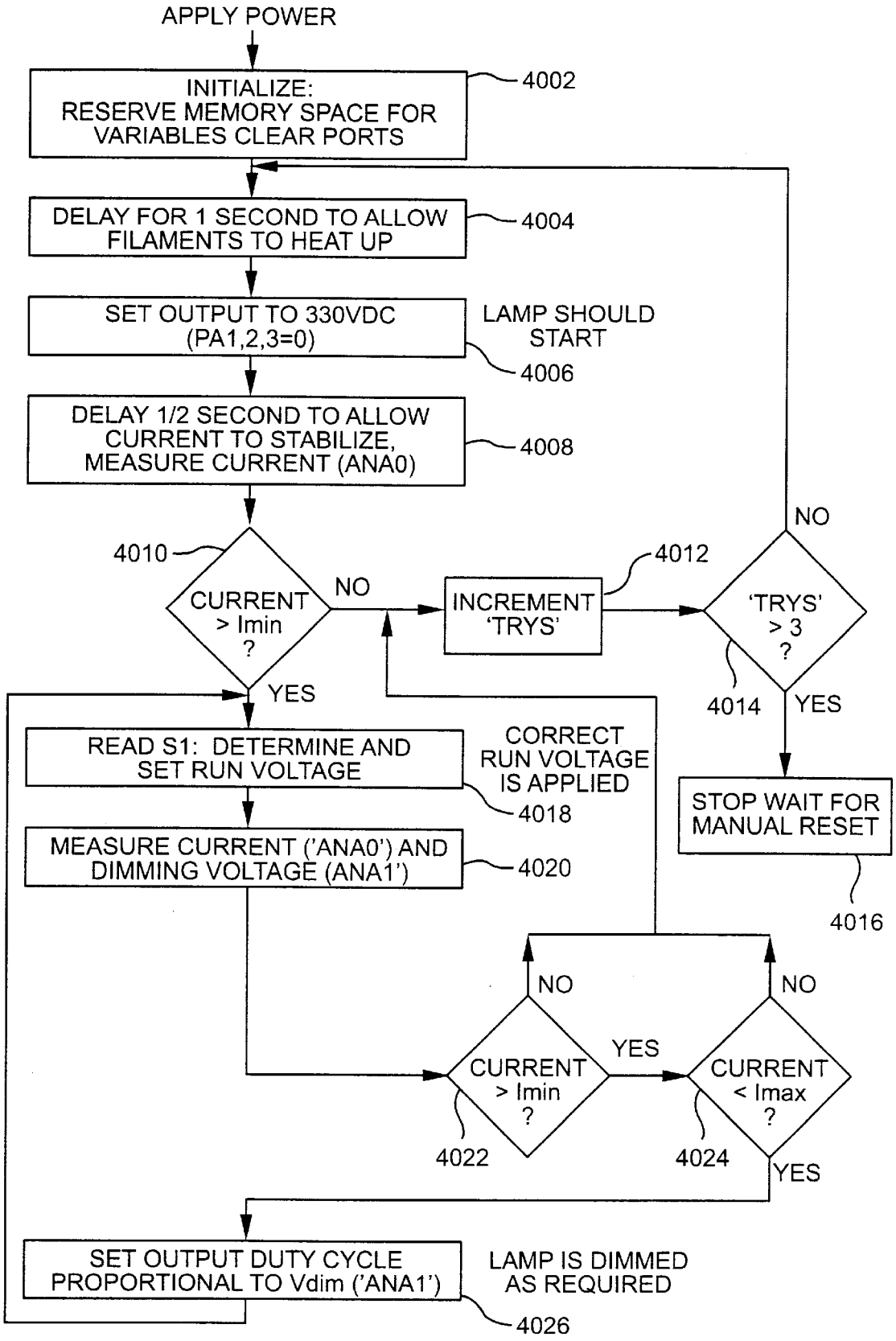
FIG. 45 depicts a flow chart of an exemplary main loop program routine for the microcontroller shown in FIG. 44.

The microcontroller U7 preferably permits three attempts at starting the lamp, and then shuts the system off if a proper start has not been achieved by that time. A flow chart describing the operations preferably performed by the microcontroller U7 is shown in FIG. 45, and a preferred program to be run by the microcontroller is provided in Table 2.

TABLE 2

| TS OL5.ASM | Assembled with CASM |
|---|---|
| | 1 Rapid Start Fluorescent Lamp Ballast Code |
| | 2 Author: Dana Geiger |
| | 3 |
| | 4 TS_ol5.asm (ol = open loop) |
| | 5 Revised 2/12/00 for FXB power supply. |
| | 6 Revised 2/18/99 to be an open loop controller |
| | 7 run directly from Vdim |
| | 8 |
| | 9 Revised 3/25/00. To include shutdown pin on 1525, |
| | 10 and an additional voltage control pin. |
| | 11 |

TABLE 2-continued

```
                12 Program is for rapid start (T-8) lamps
                13 Filament heating is all in hardware
                14
                15 ***** EQU'S
0000            16 porta equ 00
0000            17 portb equ 01
0000            18 portc equ 02
0000            19 portd equ 03
0000            20 ddra equ 04
0000            21 ddrb equ 05
0000            22 ddrc equ 06
0000            23 ddrd equ 07
0000            24 tcr equ 12
0000            25 tsr equ 13
0000            26 atrh equ la
0000            27 atrl equ lb
0000            28 ocrh equ 16
0000            29 ocrl equ 17
0000            30 adsc equ le
0000            31 adc equ ld
                32 ;MACROS
0000            33 $macro set_to_330V
                34 bclr 1,porta
                35 bclr 2,porta
                36 bclr 3,porta
0000            37 $macroend
0000            38 $macro set_to_310V
                39 bclr 1,porta
                40 bclr 2,porta
                41 bset 3,porta
0000            42 $macroend
0000            43 $macro set_to_290V
                44 bset 1,porta
                45 bclr 2,porta
                46 bclr 3,porta
0000            47 $macroend
0000            48 $macro set_to_270V
                49 bset 1,porta
                50 bclr 2,porta
                51 bset 3,porta
0000            52 $macroend
0000            53 $macro set_to_250V
                54 bclr 1,porta
                55 bset 2,porta
                56 bclr 3,porta
0000            57 $macroend
0000            58 $macro set to 230V
                59 bclr 1,porta
                60 bset 2,porta
                61 bset 3,porta
0000            62 $macroend
0000            63 $macro set to 220V
                64 bset 1,porta
                65 bset 2,porta
                66 bclr 3,porta
0000            67 $macroend
0000            68 $macro set_to_200V
                69 bset 1,porta
                70 bset 2,porta
                71 bset 3,porta
0000            72 $macroend
                73 ;
0000            74 $macro 1525_on
                75 bclr 0,porta
0000            76 $macroend
0000            77 $macro 1525 off
                78 bset 0,porta
0000            79 $macroend
                80 ;
                81 ;Note: These values can be adjusted to
                82 ;correspond to desired current levels
                83 ;by changing the values listed here.
                84 ;
0000            85 ;imax equ 200T ;
0000            86 imin equ 02T ;
                87 ;
                88 ;**** RMB'S****
0050            89 org $0050
0050            90 trys rmb 1
```

TABLE 2-continued

```
0051          91 duty rmb 1
0052          92 t_on rmb 1
0053          93 t_off rmb 1
0054          94 t_onx rmb 1
0055          95 t_offx rmb 1
0056          96 tx rmb 1
0057          97 i rmb 1
0058          98 vdim rmb 1
0059          99 templ rmb 1
005A          100 tempt rmb 1
005B          101 n rmb 1
005C          102 hibyte rmb 1
005D          103 lobyte rmb 1
005E          104 iref rmb 1
005F          105 tempo rmb 1
              106 ;vduty rmb 1
              107 ;bias rmb 1
              108 ;
              109 ;org $12f0
              110 ;table1 for selecting Iref
              111 ;fcb 25T
              112 ;fcb 50T
              113 ;fcb 75T
              114 ;fcb 100T
              115 ;fcb 125T
              116 ;fcb 150T
              117 ;fcb 175T
              118 ;fcb 200T
              119 ;
12BA          120 org $12ba
              121 ;arrive here upon interrupt
12BA CC0229   122 ;jmp service0
              123 ;
              124 ;vectors**************
1FF8          125 org $1ff8
1FF8 12BA     126 fdb $12ba ;timer
1FFA 0100     127 fdb $0100 ;irq
1FFC 0100     128 fdb $0100 ;swi
1FFE 0100     129 fdb $0100 ;reset
              130 ;
              131 ;***** Initialization *****
0100          132 org 100
              133 ;
0100 9B       134 reset0 sei; disable interrupts
0101 3F00     135 clr porta
0103 3F01     136 clr portb
0105 3F02     137 clr portc
0107 3F03     138 clr portd
0109 3F04     139 clr ddra
010B 3F05     140 clr ddrb
010D 3F06     141 clr ddrc; port c always an input
010E 3F07     142 clr ddrd
0111 3F50     143 clr trys
0113 3F5B     144 clr n
              145 ;
              146 ;configure PAO, PA1, PA2, and PA3 as outputs
0115 1004     147 bset 0,ddra; shutdown pin on 1525
0117 1204     148 bset 1,ddra
0119 1404     149 bset 2,ddra
011B 1604     150 bset 3,ddra
011D macro    151 1525_off;turn the 1525 off
              152 start
              153 ;***START THE LAMP USING HIGHEST VOLTAGE***
011F CD01F3   154 jsr delay500ms; allow filaments to heat up
0122 CD01F3   155 jsr delay500ms
0125 A699     156 lda #153t; 60% duty cycle to start, .6 × 255=153
0127 B752     157 sta t_on
              158 ;t_off = period-t_on
0129 A6FF     159 lda #255T
012B 8052     160 sub t_on
012D B753     161 sta t_off
              162 ;*******Start timer
012E A641     163 lda #%01000001; starts the interrupts
0131 3712     164 sta tcr
              165 ;bit 6 is the 'Output compare interrupt enable'
              166 ;bit 0 is the tcmp pin level at the next compare
0133 9A       167 cli; allow interrupts, tcmp pin going *******
              168 ;
0134 macro    169 set _to_330V; macro
```

TABLE 2-continued

```
013A macro     170 1525_on; turn on the 1525
               171 ;setup the A/D converter
013C A620      172 lda #%00100000; turn A/D on with AD0
013E B71E      173 sta adsc; (current) being measured
0140 CD01F3    174 jsr delay500ms; wait for current to stabilize
               175
0143 B61E      176 ql lda adsc
0145 A480      177 and #%10000000; look at the cc bit
0147 27FA      178 beq ql; waiting for the cc bit to be 1
0149 B61D      179 lda adc
014B A102      180 cmp #imin ;
014D 220B      181 bhi servoloop
014F 3C50      182 inc trys
0151 B650      183 lda trys; try again, not enough current
0153 A103      184 cmp #03
0155 23C8      185 bls start
0157 CC021C    186 jmp endlessloop
               187 ;
               188 ;***READ SETPOINT SWITCH AND DIMMER
               189 ;***AND ADJUST THE VOLTAGE AND DUTY CYCLE
               190 servoloop
015A 3F1E      191 clr adsc; turn off a/d subsystem
               192 ;to use port c as digital i/o
               193 ;
               194 ;Read PC0,1,2 to select run voltage
015C B602      195 lda portc; look at the jumpers (S1)
015E A407      196 and #%00000111; look only at PC0,1,2
0160 2608      197 bne v1
0162 macro     198 set_to_330V; macro
0168 204E      199 bra vdone
016A A101      200 vl cmp #01
016C 2608      201 bne v2
016E macro     202 set_to_310V; macro
0174 2042      203 bra vdone
0176 A102      204 v2 cmp #02
0178 2608      205 bne v3
017A macro     206 set_to_290V; macro
0180 2036      207 bra vdone
0182 A103      208 v3 cmp #03
0184 2608      209 bne v4
0186 macro     210 set_to_270V; macro
018C 202A      211 bra vdone
018E A104      212 v4 cmp #04
0190 2608      213 bne v5
0192 macro     214 set_to_250V; macro
0198 201E      215 bra vdone
019A A105      216 v5 cmp #05
019C 2608      217 bne v6
019E macro     218 set_to_230V; macro
01A4 2012      219 bra vdone
01A6 A106      220 v6 cmp #06
01A8 2608      221 bne v7
01AA macro     222 set_to_220V; macro
01B0 2006      223 bra vdone
01B2 macro     224 v7 set_to_200V macro
               225 vdone
               226 ;
               227 ;System now ruuning at selected voltage and 60%df
               228 ;Return to A/D conversions to get i and vdim
               229 ;Get i
01B8 A620      230 lda #%00100000; turn on ch.0 of A/D
01BA B71E      231 sta adsc ;portc now an analog input
               232 ;jsr delay50ms; allow A/D to stabilize
               233 ;and part of servo loop
01BC OFIEFD    234 wait0 brclr 7, adsc, wait0; wait for cc bit
01BF B61D      235 lda adc; A/D conv result stored in adc
01C1 B757      236 sta i
               237 ;
               238 ;Get Vdim
01C3 A621      239 lda #%00100001; turn on chl of A/D conv (Vdim)
01C5 B71E      240 sta adsc
01C7 OF1EFD    241 wait1 brclr 7, adsc, wait1; wait for cc bit
01CA B61D      242 lda adc
01CC B758      243 sta vdim
               244 ;
               245 ;lda i
               246 ;cmp #imin
               247 ;bhi onward2
               248 ;jmp start
```

TABLE 2-continued

```
                249 ;
                250 onward2
                251 ;Light output is controlled directly by Vdim.
                252 ;That is, nominally t_on = Vdim. But there are
                253 ;limitations. So t_onx is used until it meets
                254 ;all requirements, and then it is loaded into
                255 ;The following code checks that the DC voltage
                256 ;produced by the hc05 output duty cycle is between
                257 ;1.5 volts and 4 volts, corresponding to duty cycles
                258 ;between 30% and 80% This is equivalent to
                259 ;maintaining 77 < t_on < 204. (0.3 × 255 = 76.5)
01CE B658       260 lda vdim
01DO B754       261 stat_onx
01D2 A14D       262 cmp #77t;t_on must be at least 30%,=0.3 × 255 = 77
01D4 2404       263 bhs checkmax
01D6 A64D       264 lda #77t
01D8 B754       265 sta t_onx
                266 ;
01DA B654       267 checkmax lda t_onx
01DC A1CC       268 cmp #204t; (80% × 255 = 204)
01DE 2504       269 blo × 2
01EO A6CC       270 lda #204t
01E2 B754       271 sta t_onx
01E4 A6FF       272 ×2 lda #255t
01E6 B054       273 sub t_onx
01E8 9B         274 sei
01E9 B753       275 sta t off
01EB B654       276 lda t_onx
01ED B752       277 sta t_on
01EF 9A         278 cli
01F0 CC015A     279 jmp servoloop
                280 ;
                281 ;******* Subroutines *******
                282 delay500ms
01F3 CD01FA     283 jsr delay250ms
01F6 CD01FA     284 jsr delay250ms
01F9 81         285 rts
                286;
                287 delay250ms
                288 measured duration of 252ms on 5/6/98
01FA A6E0       289 Ida #$e0
01FC B759       290 sta temp1
01FE B75A       291 sta temp2
0200 3A59       292 ×1 dec temp1
0202 26FC       293 bne ×1
0204 B759       294 sta temp1; reload temp1
0206 3A5A       295 dec temp2
0208 26F6       296 bne ×1
020A 81         297 rts
                298 ;
                299 delay50ms
020B A625       300 lda #$25
020D B759       301 sta temp1
020F B75A       302 sta temp2
0211 3A59       303 ×11 dec temp1
0213 26FC       304 bne × 11
0215 B759       305 sta tempi;reload temp1
0217 3A5A       306 dec temp2
0219 26F6       307 bne × 11
021B 81         308 rts
                309 ;
                310 ;A reset is needed to escape this loop
                311 endlessloop
021C macro      312 set_to_200v; lowest voltage
0222 4F         313 clra
0223 B751       314 sta duty; set 0% duty cycle
0225 macro      315 1525_off; shut down the 1525
0227 20F3       316 bra endlessloop
                317 ;
                318 ;
                319 ;Timer Interrupt Service Routine
                320 ;Duty cycle waveform created at TCMP
                321 service0
0229 011208     322 brclr 0, tcr, aa
022C 1112       323 bclr 0, tcr; tcmp pin goes hi
022E B652       324 lda t_on
0230 B756       325 sta tx
0232 2006       326 bra goaheadl
0234 1012       327 aa bset 0, tcr; tcmp pin goes lo
```

TABLE 2-continued

| | |
|---|---|
| 0236 B653 | 328 lda t_off |
| 0238 B756 | 329 sta tx |
| | 330 goaheadl |
| 023A 9B | 331 sei;disable interrupts |
| 023B B61A | 332 lda atrh |
| 023D B75C | 333 sta hibyte |
| 023F B61B | 334 lda atrl |
| 0241 BB56 | 335 add tx |
| 0243 B75D | 336 sta lobyte; new value to put in ocrl |
| 0245 4F | 337 clra; carry bit unaffected |
| 0246 B95C | 338 adc hibyte |
| | 339 ; |
| | 340 ;acca contains proper ocrh, |
| | 341 ;lobyte has proper ocrl |
| | 342 ; |
| 0248 B716 | 343 sta ocrh; carry doesn't matter |
| 024A B613 | 344 lda tsr;clear ocf bit by reading tsr |
| 024C B65D | 345 lda lobyte |
| 024E B717 | 346 sta ocrl |
| | 347 new compare values now in place |
| 0250 9A | 348 cli |
| 0251 80 | 349 rti |
| | 350 ;********** |
| | 351 |

Symbol Table

| | |
|---|---|
| AA | 0234 |
| ADC | OO1D |
| ADSC | OO1E |
| ATRH | OO1A |
| ATRL | OO1B |
| CHECKMAX | 01DA |
| DDRA | 0004 |
| DDRB | 0005 |
| DDRC | 0006 |
| DDRD | 0007 |
| DELAY250MS | 01FA |
| DELAY500MS | 01F3 |
| DELAY50MS | 020B |
| DUTY | 0051 |
| ENDLESSLOOP | 021C |
| GOAHEAD1 | 023A |
| HIBYTE | 005C |
| I | 0057 |
| IMAX | 00C8 |
| IMIN | 0002 |
| IREF | 005E |
| LOBYTE | 005D |
| N | 005B |
| OCRH | 0016 |
| OCRL | 0017 |
| ONWARD2 | 01CE |
| PORTA | 0000 |
| PORTB | 0001 |
| PORTC | 0002 |
| PORTD | 0003 |
| Q1 | 0143 |
| RESETO | 0100 |
| SERVICEO | 0229 |
| SERVOLOOP | 015A |
| START | 011F |
| TCR | 0012 |
| TEMPO | 005E |
| TEMP1 | 0059 |
| TEMP2 | 005A |
| TRYS | 0050 |
| TSR | 0013 |
| TX | 0056 |
| T_OFF | 0053 |
| T_OFFX | 0055 |
| T_ON | 0052 |
| T_ONX | 0054 |
| V1 | 016A |
| V2 | 0176 |
| V3 | 0182 |
| V4 | 018E |
| V5 | 019A |
| V6 | 01A6 |

TABLE 2-continued

| | |
|---|---|
| V7 | 01B2 |
| VDIM | 0058 |
| VDONE | 01B8 |
| WAITO | 01BC |
| WAIT1 | 01C7 |
| X1 | 0200 |
| X11 | 0211 |
| X2 | 01E4 |

As shown in FIG. 45, following the application of power, the microcontroller U7 performs an initialization routine in step 4002, which includes the reservation of memory space for variables and the clearing of input/output ports. The microcontroller U7 then delays for preferably about 1 second to allow the filaments of the lamp to heat in step 4004, and then sets the output voltage to preferably about 330 VDC by applying the appropriate digital signals to the microcontroller outputs PA1, PA2, and PA3 (preferably PA1=PA2=PA3=0 VDC) in step 4006. At this point, the lamp should start.

The microcontroller U7 then delays for preferably about 0.5 seconds to allow the current in the lamp to stabilize, and then measures the current available from pin 7 of the operational amplifier U2B (signal ANA0), which is input to pin 16 of the microcontroller U7 in step 4008. If the measured current is not greater than a minimum threshold current $I_{min}$ in step 4010, a variable C(YS) representative of the number of attempts at starting the lamp is incremented in step 4012. If the number of attempts is greater than three in step 4014, the microcontroller U7 halts and waits for a manual reset in step 4016. If the number of attempts is less than three in step 4014, the microcontroller U7 returns to step 4004 and attempts to start the lamp again.

If the measured current is greater than $I_{min}$ in step 4010, the switch S1 is read by the microcontroller U7, and the appropriate run voltage is set by microcontroller outputs PA1, PA2, and PA 3 in step 4018. The current through the lamp, which is represented by signal ANA0, and the dimming voltage, which is represented by signal ANA1, are measured in step 4020.

If the measured current is not greater than $I_{min}$ in step 4022, the microcontroller U7 returns to steps 4012 to increment the variable representing the number of attempts at starting the lamp and restarts the lamp by executing steps 4004–4010 if there have been less than three attempts. If the measured current is greater than Imin in step 4022, the microcontroller U7 determines whether the current is less than a predetermined maximum threshold current $I_{max}$ in step 4024.

If the measured current is not less than $I_{max}$ in step 4024, the microcontroller U7 returns to increment the variable representing the number of attempts at starting the lamp in 4012 and restarts the lamp by executing steps 4004–4010 if there have been less than three attempts. If the measured current is less than $I_{max}$ in step 4024, the microcontroller U7 sets the output duty cycle in the ballast circuit in accordance with the signal ANA1 representing the dimming voltage provided by the isolated dimmer controller in step 4026, which dims the lamp. Following step 4026, the microcontroller U7 returns to step 4018 and re-executes the loop containing steps 4018–4026 as long as the measured current is greater than $I_{min}$ and less than $I_{max}$.

EXAMPLES

Example 1

An inductive-resistive fluorescent apparatus was constructed in accordance with FIGS. 4 and 5. Bulb 68 was a General Electric 20 watt 24 inch (61 cm) preheat type kitchen and bath bulb model number F20T12. KB. A McMaster-Car number 1623K1 starter bulb was employed. An inductive-resistive structure was assembled in the form of a conductive-resistive medium and substrate assembly 58 as shown in FIG. 6. The assembly had a length of 24 inches (61 cm) and a width of 1.5 inches (3.8 cm). Substrate 78 was in the form of a 0.002 inch (0.05 mm) polyester film. One-eighth inch (3.2 mm) wide by 0.002 inch (0.05 mm) thick copper conductors 88, 96 were positioned with approximately 1.25 inches (3.2 cm) between their inside edges. They were then covered with a medium temperature conductive-resistive coating, to be discussed below, to a depth of 0.008 inches (0.2 mm) wet, which dried to a thickness of 0.004 inches (0.1 mm). The thicknesses refer to the total height of the coating 114 above the top surface of the substrate 78. The goal was to achieve a nominal DC resistance of 200 Ohms between the conductors 88, 96.

Structure 58 was maintained about 3/32 inch (2.4 mm) from the bulb and was run on a nominal 60 Hz 120 VAC line current which had an actual measured value of 117.8 VAC. Once the bulb had started, a voltage drop of 61 VAC was measured across the bulb. The bulb would not start unless maintained in proximity to the conductive-resistive medium and substrate assembly. However, once it was started, it could be removed from the region of the assembly and would remain illuminated. Thus, it is believed that the conductive-resistive medium and substrate assembly aids in starting the bulb by means of an electromagnetic (e.g., magnetic and/or electrostatic) field interaction with the bulb, and also acts as a series impedance to absorb excess voltage during steady-state operation of the bulb.

The conductive-resistive medium was prepared as follows. A slurry was formed consisting of 97.95 parts by weight water, 58.84 parts by weight ethyl alcohol, and 48.80 parts by weight GP-38 graphite 200–320 mesh as sold by the McMaster-Carr supply Company, P.O. Box 440, New Brunswick, N.J. 08903–0440. 52.38 parts by weight of polyvinyl acetate 17–156 heater emulsion, available from Camger Chemical Systems, Inc. of 364 Main Street, Norfolk, Mass. 02056, were blended into the aforementioned slurry. Finally, 35.09 parts by weight of China Clay available from the Albion Kaolin Company, 1 Albion Road, Hephzibah, Ga. 30815 were added to the blended slurry mixture. The mixture was then applied to the substrate and allowed to dry, leaving an emulsion of graphite and china clay dispersed in polyvinyl acetate polymer.

Example 2

Another example was constructed in accordance with FIGS. 4 and 5, and using a conventional fluorescent fixture with the ballast removed. The conductive-resistive medium and substrate assembly 58 was assembled to the fixture on the top 124 of the housing assembly 126 of the fixture, as shown in FIG. 8. The metal of the housing 126 was ferromagnetic. A GE F20T12. CW 24 inch (61 cm) 20 watt cool white preheat type bulb was employed. The inductive-resistive structure was maintained approximately 3/16 of an inch (4.8 mm) away from the bulb. The inductive-resistive structure measured approximately 2-5/16 by 26-½ inches (5.9×67 cm), with the copper conductor strips (similar to those used in Example 1) spaced about 1-13/16 of an inch (4.6 cm) inside edge to inside edge. A dry coating thickness of 0.004 inches (0.1 mm) was used to obtain a DC resistance of 282 Ohms. The same composition of conductive-resistive material was employed as in Example 1. The example operated successfully.

Example 3

Again, in this example, the apparatus was assembled in accordance with FIGS. 4 and 5. In accordance with FIG. 9, conductive-resistive medium and substrate assembly 58 was applied to the underside 128 of the housing assembly 126 of the fixture. The tape was maintained approximately 3/32 of an inch (2.4 mm) plus the thickness of the fixture (approximately 1/64 of an inch (0.4 mm)) from the bulb. The inductive structure was essentially similar to that used in Example 2, with the copper conductors being spaced approximately 1¾ of an inch (4.4 cm) inside edge to inside edge. The metal of the housing 126 of the fixture was, again, ferromagnetic. The example operated successfully.

Example 4

An embodiment of the invention was constructed in accordance with FIG. 10. Starter bulb 212 was a McMaster-Carr number 1623K2. The bulb was a Philips F40/CW 40 watt, 48 inch (120 cm) preheat type bulb marked "USA 4K 4L 4M". The step-up transformer 240 was a unit which came with the fixture which was used, and which produced 240 VAC from standard line voltage. Dimmer 234 was a Leviton 600 watt, 120 VAC standard incandescent dimmer. The high-impedance conductive-resistive coating 214 had a nominal 1000 Ohm DC resistance value and was formed from 3M "Scotch Brand" recording tape, 2 inch wide, number 0227-003. This product is known as a studio recording tape. Copper foil strips having a conductive adhesive on the reverse (available from McMaster-Carr Supply Company of New Brunswick, N.J.) were attached to the back side of the recording tape and were laminated with an insulative polyester film and an acrylic adhesive. The low-impedance conductive-resistive coating 230 had a nominal 200 Ohm value and was formed using the composition discussed in the above examples. The coating 230 was applied to a tape structure which was mounted on the underside of the magnetic recording tape. The assembled inductive-resistive structure was located about ⅜ of an inch (9.5 mm) from the surface of the bulb 168. The inductive-resistive structure was located under the metal of the fixture as shown in FIG. 9. Essentially continuous dimming of lamp 168 was possible when the apparatus of Example 4 was tested.

Example 5

A self-dimming example of the invention was constructed in accordance with the circuit diagram of FIG. 13. Bulb 568 was an Ace F20 T12. CW USA cool white 24 inch (61 cm) preheat model bearing the label UPC 0 82901-30696 2. Starter bulbs 612, 712 were both of the McMaster-Carr number 1623K1 variety. Resistor 708 was a Radio Shack 3.3 kΩ rated at ½ watt Diode 714 was a Radio Shack 1.5 kV, 2.5 amp diode. Polarized capacitor 710 had a capacitance of 10 μF and was rated for 350 volts. The photoresistor 706 was of a type available from Radio Shack having a resistance of 50 Ohms in full light conditions and 106 Ohms in full dark conditions. Control relay 704 was a Radio Shack model number SRUDH-S-1096 single pole double throw miniature printed circuit relay having a 9 volt DC, 500 Ohm coil with contacts rated for 10 amps and 125 VAC.

The inductive-resistive structure included a nominal 100 Ohm low-impedance conductive-resistive coating 630 and a nominal 2500 Ohm high-impedance conductive-resistive coating 614. The low-impedance and high-impedance coatings were assembled on separate substrates which were then applied one on top of the other. The example according to FIG. 13 was assembled and was operated successfully. Bulb 568 dimmed when photoresistor 706 was exposed to high ambient light. When photoresistor 706 was shielded from ambient light, and thus was in a relatively dark environment, bulb 568 burned at full intensity.

Example 6

An "instant-start" example of the invention was constructed in accordance with FIGS. 14 and 20. The bulb was a Philips F20T12/CW 24 inch (61 cm) preheat type bulb which had burned out filaments. Electrical connections were made to one pin only at each end, whichever pin was connected to the biggest remaining stub of the burned-out electrode. The source 1030 was a rectifier assembled in accordance with FIG. 20 using two Atom model TVA-1503 USA 9541H+85° C. 185° F.+8 μF 250 VDC capacitors. Two PTC205 1 kV 2.5 ampere diodes were employed. Ordinary AC line voltage of 120 VAC, 60 Hz was applied across terminals 1032", 1034". 157 VDC was measured across terminals 1036", 1038". This DC voltage exhibited a ripple component such that a frequency of 120 Hz was measured with a frequency meter for the nominal DC signal.

A single inductive-resistive structure constructed from a 1⅛ inch×22-½ inch piezo magnetic recording tape and having a nominal DC resistance of 1 kΩ (0.695 kΩ measured) was employed. The structure employed two 0.002 inch (0.05 mm) by ⅛ inch (3.2 m m) copper foils located near the edges of the recording tape, which were electrically connected, with a third strip between them (providing two parallel current paths between outside and inner strip). The spacing between strips was about ⅓ inch (8.5 mm). A polyester film with acrylic adhesive was applied over the foils. The exemplary embodiment operated successfully.

Example 7

An example of the invention was constructed in accordance with FIGS. 16 and 21. A capacitor tripler in accordance with FIG. 21 had a first capacitor 1422 with a capacitance of 40 μF rated at 150 volts; a second capacitor 1424 with a capacitance of 22 μF rated at 250 volts; and a third capacitor 1426 with a capacitance of 40 μF rated at 150 volts. Diodes 1416, 1418 and 1420 were all 1.5 kV, 2.5 ampere diodes. Bulbs 1202, 1256 were both GE F4AT12CW 48 inch (120 cm) bipin (instant-start) type.

The inductive structure 1220 was fabricated from 2 separate pieces of 3M "Scotch Brand" 0227-003 two inch wide studio recording tape mounted on a rigid, non-conducting base. The main piece measured 2 inches (5.1 cm) by 48 inches (120 cm) and had five copper conductor foils located on it. The outer foils were located approximately 1/16 of an inch (1.6 mm) from the edges. The foils were spaced about 9/32 inches (7.1 mm) apart. A nominal DC resistance of 1.5 kΩ was present between each foil. Accordingly, nominal values of 1.5, 3, 4.5 and 6 kΩ were available from the main piece. An extra piezo magnetic recording tape, also 2 inches (5.1 cm) wide, and having a length of 31 inches (79 cm) had two copper foils located near its edges and spaced 1 9/16 inch (4.0 cm) apart, and was selectively connectable in series with the last foil of the main tape so that the overall nominal resistance values available were 1.5, 3, 4.5, 6 and 10 kΩ ($Z_1$–$Z_5$). Measured values were 1.29, 2.51, 3.92, 5.09 and 12.82 kΩ. The exemplary embodiment operated successfully.

Example 8

An example of the invention was constructed essentially in accordance with FIGS. 15 and 20, except that only two extra conductive-resistive coatings 1150, 1152 were employed (instead of three as in FIG. 15), and they were each selectively connectable in series with primary structure 1148, but not in parallel with each other as in FIG. 15. The bulb was a circular "Lights of America" FC8T9/WW/RS preheat type, with only one pin at each end of the bulb connected. The main inductive-resistive structure 1148 was a ½ inch wide strip of conductive-resistive material (the same composition as in Example 1) which was painted directly on the light in order to obtain a nominal 50 Ohm DC resistance between the ⅛ inch (3.2 mm) wide copper conductors, which were located essentially adjacent the side edges of the strip of conductive material. The material was painted over essentially the entire circumference of the circular fluorescent lightbulb. The rippled/pulsed DC source was a rectifier which employed two 1.5 kV, 2.5 ampere diodes number 1N5396, and two identical Atom TVA-1504 capacitors, having capacitances of 10 μF, rated at 250 VDC, and marked USA 9526H+85° C. 185° F.+.

Coatings 1150, 1152 were formed on the same piezo 3M "Scotch Brand" (0227-003) 2 inch (5.1 cm) wide studio recording tape. The tape was about 8½ inches (21.6 cm) long. Five copper foil conductors were spaced across the tape with about 5/16 inch (7.9 mm) between them. The second and fourth foils were connected, as were the third and fifth foils, such that an effective length of about twice 8–½ inches (21.6 cm), or 17 inches (43.2 cm), was present between them. Coating 1150 was located between foils 1 and 2, and had a DC resistance of about 7.5 kΩ, while coating 1152 was located between foils 2–4 and 3–5, with a DC resistance of about 3.7 kΩ. The exemplary apparatus could be easily adapted to a fixture intended for a three-way incandescent socket with switching as shown in FIG. 15. The tape including the extra conductive-resistive coatings could be wrapped around a circular portion of the fixture which screws into the socket.

Example 9

Another example of the invention was constructed in accordance with FIG. 14 and FIG. 19. The rectifier of FIG. 19 included a single 10 μF capacitor and two 1 kV, 2.5 ampere diodes. 120 VAC line voltage was stepped up to 220 VAC and applied to terminals 1032', 1034'. The bulb was a Philips Econ-O-Watt FB40CW/6/EW 40 watt unshaped preheat type, with only one pin at each end connected. The inductive structure was ⅝ inch (16 mm) wide recording tape applied to the entire outside circumference of the lightbulb. Only a single tape, corresponding to impedance $Z_1$ (reference number 1026) was employed. The ⅝ inch (16 mm) wide strip of recording tape was cut down from 3M "Scotch Brand" (0227-003) 2 inch (5.1 cm) wide studio recording tape and there was approximately 5/16 of an inch (7.9 mm) spacing between the inside edges of the copper conductors. The bulb operated successfully when 120 VAC stepped up to 220 VAC was applied at terminals 1032', 1034'. The nominal DC resistance of the inductive structure was about 1000 Ohms. The exemplary embodiment operated successfully. When the invention was tested with a 100 μF capacitor instead of a 10 g capacitor, the lightbulb exhibited undesirable strobing effects, and the inductive structure overheated. It is believed that strobing could also be alleviated by employing a capacitor tripler circuit, such as that shown in FIG. 21, instead of the rectifier of FIG. 19.

Example 10

A preheat example of the invention was constructed in accordance with FIG. 12. The bulb 368 was a Philips F40/CW 40 watt 4K 4L 4M 48 inch (120 cm) preheat type. Switch 444 was a double pole single throw type. A transformer was used to step up the input voltage from 120 to 220 VAC. The transformer was a Franzus Travel Classics 50 watt reverse electricity converter distributed by Franzus Company, West Murtha Industrial Park, Beacon Falls, Conn. 06043. 3M "Scotch Brand" 0227-003 2 inch (5.1 cm) wide magnetic recording tape, cut down to 1 inch (2.5 cm) wide, was used to form high-impedance conductive-resistive coating 414. The length was approximately 48 inches (120 cm). ⅛ inch (3.2 mm) copper conductor strips were positioned close to the opposed edges of the cut-down tape. A nominal DC resistance of 1000 Ohms was used. The low-impedance coating 430 was formed from the conductive-resistive mixture discussed above, and had a nominal 400 Ohm DC resistance. The exemplary embodiment of the invention operated successfully.

Example 11

An example of the invention was constructed in accordance with FIGS. 21 and 22. Bulb 1502 was a 72 inch (1.8 m) instant-start bulb operated at 48 watts. First, second and third diodes 1416, 1418, 1420 of the rectifier used as source 1530 were 1 kV, 2.5 Ampere models. First capacitor 1422 was a Sprague 10 μF 250 V model; second capacitor 1424 was a Mallory 10 μF 300 V model; and third capacitor 1426 was a Mallory 33 μF 100 V model. 110 VAC at 60 Hz was supplied to terminals 1032''', 1034''' with 310 VDC resulting at terminals 1036''', 1038'''. The DC had a "pulse" or "ripple" component such that a frequency meter recorded 60 Hz. Conductive foil 1576, which was similar to those used in Example 1, was applied to the lightbulb 1502 as shown. Bulb 1502 would start and remain illuminated when kept a distance Δ which was about 12 inches (30 cm) away from structure 1520. Without foil 1576, bulb 1502 had to be maintained within about 1 inch (2.5 cm) of structure 1520 to start.

Example 12

A 300 Ω. 24 inch (61 cm) inductive tape structure was fabricated, and was mounted on a non-ferromagnetic surface. This structure would only illuminate a fluorescent lamp when maintained within about ¼ inch (6.4 mm) of the lamp. When the inductive structure was instead mounted on a 24 inch (61 cm) long, 4 inch (10 cm) wide×2 inch (5.1 cm) high U-shaped fixture made of a thin ferromagnetic material, the lamp could be illuminated when placed within 2 inches (5.1 cm) of the structure. This was true when the tape was placed on any surface of the fixture. This example is believed to illustrate the "focusing" effect.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A method of driving a fluorescent lamp, the method comprising the steps of:

providing a source of rippled/pulsed direct current (DC) electrical potential;

passing a current through an inductive-resistive structure adjacent to the fluorescent lamp in an amount sufficient to induce fluorescence in the presence of the electrical potential imposed on the fluorescent lamp;

delaying the application of the electrical potential to the fluorescent lamp for a first time period until the electrical potential imposed on the fluorescent lamp causes the fluorescent lamp to heat to a first temperature;

providing the electric potential imposed on the fluorescent lamp at a first level;

delaying a second time period to allow a value of the rippled/pulsed direct current to stabilize;

measuring the value of the rippled/pulsed direct current;

providing the electric potential imposed on the fluorescent lamp at a second level;

measuring the value of the rippled/pulsed direct current;

measuring the value of a dimming voltage; and adjusting the value of the electric potential in response to the measured dimming voltage.

2. The method defined by claim 1, further comprising the steps of:

comparing the value of the rippled/pulsed direct current to a minimum current level;

delaying the application of the electrical potential to the fluorescent lamp for the first time period until the electrical potential imposed on the fluorescent lamp causes the fluorescent lamp to heat to the first temperature if the value of the rippled/pulsed direct current is less than the minimum current level;

providing the electric potential imposed on the fluorescent lamp at the first level;

delaying the second time period to allow the value of the rippled/pulsed direct current to stabilize; and measuring the value of the rippled/pulsed direct current.

3. The method defined by claim 2, further comprising the steps of:

incrementing a variable if the value of the rippled/pulsed direct current is less than the minimum current level; and waiting until a reset occurs if the value of the variable is equal to a first value.

4. The method defined by claim 1, further comprising the steps of:

comparing the value of the rippled/pulsed direct current to a maximum current level;

delaying the application of the electrical potential to the fluorescent lamp for the first time period until the electrical potential imposed on the fluorescent lamp causes the fluorescent lamp to heat to the first temperature if the value of the rippled/pulsed direct current is greater than the maximum current level;

providing the electric potential imposed on the fluorescent lamp at the first level;

delaying the second time period to allow the value of the rippled/pulsed direct current to stabilize; and measuring the value of the rippled/pulsed direct current.

5. The method defined by claim 4, further comprising the steps of:

incrementing a variable if the value of the rippled/pulsed direct current is greater than the maximum current level; and waiting until a reset occurs if the value of the variable is equal to a first value.

6. The method defined by claim 1, further comprising the steps of:

periodically reversing the polarity of the rippled/pulsed direct current electric potential applied to the fluorescent lamp, thereby producing an alternating current lamp drive voltage having a duty cycle;

providing a control sub-circuit capable of varying the duty cycle;

measuring a dimming voltage, the dimming voltage being representative of a desired brightness of the fluorescent lamp; and adjusting the duty cycle in response to the measured dimming voltage.

7. A fluorescent illuminating apparatus comprising:

a fluorescent lamp including:

a translucent housing having a chamber for supporting a fluorescent medium, the housing having first and second ends;

electrical connections located on the housing to provide an electrical potential across the chamber, the connections being in the form of first and second electrical terminals;

a fluorescent medium supported in the chamber; and first and second electrodes located respectively at the first and second ends of the translucent housing, the first and second electrodes being respectively electrically interconnected with the first and second electrical terminals;

an inductive-resistive structure fixed sufficiently proximate to the housing of the fluorescent lamp to induce fluorescence in the fluorescent medium when an electric current is passed through the inductive-resistive structure while an electric potential is applied across the housing, the inductive-resistive structure having third and fourth electrical terminals thereon, the second and third electrical terminals being electrically interconnected; and a source of rippled/pulsed direct current (DC) voltage having first and second output terminals electrically interconnected with the first and fourth electrical terminals, the source having first and second alternating current (AC) input voltage terminals;

a control sub-circuit, the source of rippled/pulsed direct current being responsive to the control sub-circuit, the control sub-circuit outputting a lamp voltage signal representative of a value of the electric potential to be imposed on the fluorescent lamp; and a power supply sub-circuit, the power supply sub-circuit being responsive to the control sub-circuit, the power supply sub-circuit imposing the electric potential on the fluorescent lamp at the value represented by the lamp voltage signal.

8. The fluorescent illuminating apparatus defined by claim 7, wherein the control sub-circuit includes at least one of a microcontroller and microprocessor.

9. The fluorescent illuminating apparatus defined by claim 7, further comprising an auxiliary power supply sub-circuit electrically connected to the power supply sub-circuit, the auxiliary power supply sub-circuit including an inductor, the inductor including a plurality of substantially isolated outputs, at least one of the plurality of outputs being electrically connected to a fluorescent lamp heater.

10. The fluorescent illuminating apparatus defined by claim 7, further comprising a dimmer control sub-circuit, the dimmer control sub-circuit inputting a dimming signal and outputting a dimming voltage signal, the control sub-circuit being responsive to the dimming voltage signal, the control sub-circuit outputting a lamp voltage signal representative of the dimming voltage signal.

11. The fluorescent illuminating apparatus defined by claim 10, wherein the dimming signal is output from a potentiometer.

12. The fluorescent illuminating apparatus defined by claim 10, wherein the dimming signal is an external signal inputted to the dimmer control sub-circuit, the external circuit being about 4 to about 20 ma.

13. The fluorescent illuminating apparatus defined by claim 10, wherein the dimmer control sub-circuit includes an analog optocoupler, the analog optocoupler electrically isolating the dimming signal from the dimming voltage signal.

14. The fluorescent illuminating apparatus defined by claim 7, further comprising a ballast sub-circuit responsive to the lamp voltage signal, the ballast sub-circuit being capable of periodically reversing the polarity of the rippled/pulsed direct current electric potential imposed on the fluorescent lamp producing an alternating current lamp drive voltage having a duty cycle, the ballast sub-circuit being capable of varying the duty cycle of the lamp drive voltage in response to the lamp voltage signal outputted from the control sub-circuit, thereby selectively dimming the fluorescent lamp.

15. The fluorescent illuminating apparatus defined by claim 14, wherein the ballast sub-circuit includes a pulse width modulator circuit, the pulse width modulator circuit providing at least two variable duty cycle output signals about 180 degrees out of phase with each other, the pulse width modulator circuit being responsive to the lamp voltage signal outputted from the control sub-circuit.

16. The fluorescent illuminating apparatus defined by claim 15, wherein the ballast sub-circuit includes at least two half bridge drivers, the at least two half bridge driver circuits being electrically connected to the pulse width modulator circuit, the at least two half bridge driver circuits providing an electrical interface between the pulse width modulator and an H-bridge.

17. The fluorescent illuminating apparatus defined by claim 14, wherein the ballast circuit includes a resistor and a capacitor, the resistor and the capacitor being configured as an RC filter and electrically connected to the fluorescent lamp, the resistor and the capacitor extracting an average value of current flowing through the fluorescent lamp and outputting the average value to the control sub-circuit.

18. The fluorescent illuminating apparatus defined by claim 17, wherein the control sub-circuit turns the fluorescent lamp off in response to the average value of the current flowing through the fluorescent lamp being one of above a maximum current level and below a minimum current level.

* * * * *

UNITED STATES PATENT AND TRADEMARK OFFICE

CERTIFICATE OF CORRECTION

PATENT NO. : 6,456,015 B1 
DATED : September 24, 2002
INVENTOR(S) : Walter C. Lovell et al.

It is certified that error appears in the above-identified patent and that said Letters Patent is hereby corrected as shown below:

Column 14,
Line 17, now reads "drop across the to bulb as for" should read -- drop across the bulb as for --;
Line 23, now reads "required nominal In resistance" should read -- required nominal resistance --;

Column 23,
Line 43, now reads "to start at a distance A" should read -- to start at a distance Δ --;

Column 25,
Line 9, now reads "3038 is a fall wave ripple" should read -- 3038 is a full wave ripple --;

Column 30,
Line 51, now reads "$R=\rho L_c(W_c t)$" should read -- $R=\rho L_c/(W_c t)$ --;

Column 31,
Line 67, now reads "Suitable an starting" should read -- Suitable starting --;

Column 32,
Line 3, now reads "to FIGS. 33(*a*1), 33(*a*) and 33(*b*)" should read -- to FIGS. 33 (*a*1), 33(*a*2) and 33 (*b*) --;

Column 35,
Lines 42-43, now reads "namely, 10 percent (10)), fifty" should read -- namely, 10 percent (10%), fifty --;

Column 42,
Lines 53-54, now read "operational amplifier (of ramp)" should read -- operational amplifier (op-amp) --;

Column 46,
Line 46, now reads "(pins 1 13 and 2 of U4)" should read -- (pins 1 and 2 of U4) --;

UNITED STATES PATENT AND TRADEMARK OFFICE

CERTIFICATE OF CORRECTION

PATENT NO. : 6,456,015 B1 
DATED : September 24, 2002
INVENTOR(S) : Walter C. Lovell et al.

It is certified that error appears in the above-identified patent and that said Letters Patent is hereby corrected as shown below:

Column 48,
Line 29, now reads "appropriate output signal at in 24" should read -- appropriate output signal at pin 24 --;

Column 59,
Line 29, now reads "a variable C(YS)" should read -- a variable (TRYS) --; and Column 62,
Line 2, now reads "light conditions and 106 Ohms" should read -- light conditions and $10^6$ Ohms --.

Signed and Sealed this

Eleventh Day of March, 2003

JAMES E. ROGAN
*Director of the United States Patent and Trademark Office*